United States Patent [19]

Whitehouse

[11] Patent Number: 4,776,146

[45] Date of Patent: Oct. 11, 1988

[54] PACKAGING APPARATUS

[75] Inventor: John A. Whitehouse, Mulbarton, England

[73] Assignee: Wilson Foods Corporation, Oklahoma City, Okla.

[21] Appl. No.: 921,621

[22] Filed: Oct. 22, 1986

[30] Foreign Application Priority Data

Oct. 26, 1985 [GB] United Kingdom ..... 8526449

[51] Int. Cl.[4] ..... B65B 57/00

[52] U.S. Cl. ..... 53/58; 53/250; 53/446; 53/500; 53/517; 53/534

[58] Field of Search ..... 53/58, 67, 244, 249, 53/251, 435, 475, 250, 443, 446, 447, 498, 500, 534, 544, 52, DIG. 1, 517, 514, 513; 198/423

[56] References Cited

U.S. PATENT DOCUMENTS

| | | | |
|---|---|---|---|
| 3,314,213 | 4/1967 | Peppler | 53/534 X |
| 3,316,103 | 4/1967 | Scopelite et al. | 53/446 |
| 3,700,127 | 10/1972 | Kurk et al. | 53/446 X |
| 3,729,895 | 5/1973 | Kramer et al. | 53/244 X |
| 3,805,484 | 4/1974 | Rossi | 53/251 X |
| 3,996,723 | 12/1976 | Greenwell | 53/500 |
| 4,135,616 | 1/1979 | Pellaton | 198/423 |
| 4,173,107 | 11/1979 | Wilson | 53/250 X |
| 4,258,530 | 3/1981 | Mukumoto | 53/249 X |

*Primary Examiner*—James F. Coan

*Attorney, Agent, or Firm*—Laney, Dougherty, Hessin & Beavers

[57] ABSTRACT

Apparatus for loading trays with cut product typically meat chops is described, comprising a delivery conveyor (22) onto which are delivered the pieces of cut product (76) in sequence for movement to a delivery station (26), a tray conveyor (32) extending transversely to the delivery conveyor (22) and adapted to deliver in succession each of a plurality of trays (90) to the delivery station to receive cut product, and a product detector (94, 96) at the delivery station to detect the passage of each piece of cut product therethrough. The tray conveyor drive (230) operates in response to the detection of cut pieces by the detector (94, 96) to move the tray conveyor through a small amount sufficient to present the next available region of a tray to the delivery station, to receive the next piece of cut product so as to fill each tray in turn. A transfer conveyor (34) downstream from the delivery station moves the filled trays away from the delivery station.

10 Claims, 52 Drawing Sheets

MODULE No. 123ABC PROGRAM 2

| PRODUCT | 2 | | P | 4 | | P | 8 | | P |
|---|---|---|---|---|---|---|---|---|---|
| | C1 | | C2 | C1 | | C2 | C1 | | C2 |
| A 5/8" BONE-IN | 2 | | 3 | 4 | | 6 | 8 | | 10 |
| B 3/4" BONELESS | 2 | | 2 | 5 | | 6 | 7 | | 8 |
| C 1" BONE-IN | – | | – | 2 | | 3 | 4 | | 5 |

Fig. 16

CPU TYPE

| INPUT NO. | DESCRIPTION OF SIGNAL |
|---|---|
| 000 | CHOP SENSOR CHANEL 1 |
| 001 | TRAY SENSOR CHANEL 1 |
| 002 | TRAY MAG. SENSOR (1) |
| 003 | TRAY MAG. SENSOR (2) |
| 004 | SYSTEM START SELECTED |
| 005 | RIGHT LINE SELECTED (MODE) |
| 006 | BOTH OR SYNC. SELECTED (MODE) |
| 007 | SYNC. SELECTED (MODE) |
| 008 | 2P TRAY (RIGHT) (FROM CPUR) |
| 009 | 8P TRAY (RIGHT) (FROM CPUR) |
| 010 | ALARM (RIGHT) (FROM CPUR) |
| 011 | APS 1R READY (FROM APS) |

| OUTPUT NO. | DESCRIPTION OF SIGNAL |
|---|---|
| 012 | VACUUM ON |
| 013 | INDEX SPEED SELECT |
| 014 | ALARM |
| 015 | AIR BLAST ON |
| 016 | TRAY CHANGE SPEED SELECT |
| 017 | DESTACKER ARM UP |
| 018 | CHANEL 2 AIR BLAST SELECT |
| 019 | TRAY LOAD SPEED SELECT |

Fig 18a'

| EUL 1 | 1/0 UNIT TYPE | ID411 | EUL 5 | 1/0 UNIT TYPE | ID411 |
|---|---|---|---|---|---|
| 1/0 NO. | DESCRIPTION OF SIGNAL | | 1/0 NO. | DESCRIPTION OF SIGNAL | |
| 020 | APS 2R READY (FROM APS) | | 036 | RIGHT BUFFER OK (E) | |
| 021 | CONVERGER TIMING RIGHT | | 037 | RIGHT BUFFER LO (F) | |
| 022 | TRAY LOAD PUSH BUTTON | | 038 | TRAY AT BUFFER GATE (RIGHT) | |
| 023 | CHOP SENSOR CHANEL 2 | | 039 | - SPARE - | |
| EUL 2 | 1/0 UNIT TYPE | ID411 | EUL 6 | 1/0 UNIT TYPE | OC221 |
| 1/0 NO. | DESCRIPTION OF SIGNAL | | 1/0 NO. | DESCRIPTION OF SIGNAL | |
| 024 | TRAY SENSOR CHANEL 2 | | 040 | - SPARE - | |
| 025 | FLIGHT SENSOR | | 041 | - SENSOR - | |
| 026 | TRAY DOWN SENSOR | | 042 | 2P TRAY (LEFT) | |
| 027 | APS 1L READY (FROM APS) | | 043 | 8P TRAY (LEFT) | |
| EUL 3 | 1/0 UNIT TYPE | ID411 | EUL 7 | 1/0 UNIT TYPE | OC221 |
| 1/0 NO. | DESCRIPTION OF SIGNAL | | 1/0 NO. | DESCRIPTION OF SIGNAL | |
| 028 | APS 2L READY (FROM APS) | | 044 | APS 1L DRUM RUN/STOP | |
| 029 | LEFT BUFFER H1 (A) | | 045 | APS 2L DRUM RUN/STOP | |
| 030 | LEFT BUFFER OK (B) | | 046 | WRONG MODULE ALARM | |
| 031 | LEFT BUFFER LO (C) | | 047 | BUFFER GATE RAISE (RIGHT) | |
| EUL 4 | 1/0 UNIT TYPE | ID411 | EUL 8 | 1/0 UNIT TYPE | OC221 |
| 1/0 NO. | DESCRIPTION OF SIGNAL | | 1/0 NO. | DESCRIPTION OF SIGNAL | |
| 032 | TRAY AT BUFFER GATE (LEFT) | | 048 | BUFFER GATE RAISE (LEFT) | |
| 033 | - SPARE - | | 049 | CONVERGER SPEED SELECT H1 | |
| 034 | CONVERGER TIMING LEFT | | 050 | CONVERGER SPEED SELECT LO | |
| 035 | RIGHT BUFFER H1 (D) | | 051 | TRAY MISSING ALARM | |

Fig 18a''

| EUL 9 | 1/0 UNIT TYPE | OC221 |
|---|---|---|
| 1.0 NO. | DESCRIPTION OF SIGNAL | |
| 052 | APS 1L LAMP DRIVE | |
| 053 | APS 2L LAMP DRIVE | |
| 054 | APS 1R LAMP DRIVE | |
| 055 | APS 2R LAMP DRIVE | |

| EUL 10 | 1/0 UNIT TYPE | OC221 |
|---|---|---|
| 1/0 NO. | DESCRIPTION OF SIGNAL | |
| 056 | START CONVEYORS | |
| 057 | APS 1R DRUM RUN/STOP | |
| 058 | APS 2R DRUM RUN/STOP | |
| 059 | TRAY MISMATCH ALARM | |

| EUL 11 | 1/0 UNIT TYPE | ID411 |
|---|---|---|
| 1/0 NO. | DESCRIPTION OF SIGNAL | |
| 060 | PRODUCT 1 LEFT (FROM CPU-R) | |
| 061 | PRODUCT 2 LEFT (FROM CPU-R) | |
| 062 | COUNT 1 LEFT (FROM CPU-R) | |
| 063 | LEFT MODULE CHECK | |

Fig 18b'

| AUXILIARY RELAY NO. | DESCRIPTION OF SIGNAL | AUXILIARY RELAY NO. | DESCRIPTION OF SIGNAL |
|---|---|---|---|
| 064 | CHOP READY | 084 | PROGRAM DECODE 6 |
| 065 | INDEX DONE | 085 | PROGRAM DECODE 7 |
| 066 | AIR BLAST MASTER | 086 | PROGRAM DECODE 8 |
| 067 | APS 1L CLEAR TO START | 087 | PROGRAM DECODE 9 |
| 068 | APS 2L CLEAR TO START | 088 | PROGRAM DECODE 10 |
| 069 | TRAY FULL | 089 | PROGRAM DECODE 11 |
| 070 | TRAY READY (LATCH) | 090 | PROGRAM DECODE 12 |
| 071 | 4P TRAY SELECTED | 091 | PROGRAM DECODE 13 |
| 072 | TRAY SENSOR ONE-SHOT | 092 | PROGRAM DECODE 14 |
| 073 | APS 1R CLEAR TO START | 093 | PROGRAM DECODE 15 |
| 074 | APS 2R CLEAR TO START | 094 | PROGRAM DECODE 16 |
| 075 | - SPARE - | 095 | PROGRAM DECODE 17 |
| 076 | - SPARE - | 096 | PROGRAM DECODE 18 |
| 077 | - SPARE - | 097 | HDM COUNT DONE |
| 078 | - SPARE - | 098 | CONVERGER TIMING LATCH (L) |
| 079 | PROGRAM DECODE 1 | 099 | CONVERGER TIMING LATCH (R) |
| 080 | PROGRAM DECODE 2 | KR 00 | TRAY CHANGE LATCH |
| 081 | PROGRAM DECODE 3 | KR 01 | DESTACKER LATCH |
| 082 | PROGRAM DECODE 4 | KR 02 | TRAY LOAD LATCH |
| 083 | PROGRAM DECODE 5 | KR 03 | CONVERGER HI SPEED LATCH |
| | | KR 04 | CONVERGER LO SPEED LATCH |
| | | KR 05 | - SPARE - |
| | | KR 06 | SYSTEM START LATCH |
| | | KR 07 | - SPARE - |

Fig.18b''

| CHOPS/TRAY COUNT | | |
|---|---|---|
| REVERSIBLE (RDM) COUNTER VALUE SETTING TABLE | | |
| OUTPUT SETTING NO. | PRESET VALUE A | PRESET VALUE B |
| RDM 00 | * | 999 |
| RDM 01 | * | 999 |
| RDM 02 | * | 999 |
| RDM 03 | * | 999 |
| RDM 04 | * | 999 |
| RDM 05 | * | 999 |
| RDM 06 | * | 999 |
| RDM 07 | * | 999 |
| RDM 08 | * | 999 |
| RDM 09 | * | 999 |
| RDM 10 | * | 999 |
| RDM 11 | * | 999 |
| RDM 12 | * | 999 |
| RDM 13 | * | 999 |
| RDM 14 | * | 999 |
| RDM 15 | * | 999 |
| RDM 16 | * | 999 |
| RDM 17 | * | 999 |
| RDM 18 | NOT USED | |
| RDM 19 | NOT USED | |
| RDM 20 | NOT USED | |
| RDM 21 | NOT USED | |
| RDM 22 | NOT USED | |
| RDM 23 | NOT USED | |
| RDM 24 | NOT USED | |
| RDM 25 | NOT USED | |
| RDM 26 | NOT USED | |
| RDM 27 | NOT USED | |
| RDM 28 | NOT USED | |
| RDM 29 | NOT USED | |
| RDM 30 | NOT USED | |
| RDM 31 | 002 | 999 |

| CHOPS SPACING | | |
|---|---|---|
| HIGH SPEED COUNTER (HDM) VALUE SETTING TABLE | | |
| OUTPUT SETTING NO. | PRESET VALUE A | PRESET VALUE B |
| HDM 00 | * | 999 |
| HDM 01 | * | 999 |
| HDM 02 | * | 999 |
| HDM 03 | * | 999 |
| HDM 04 | * | 999 |
| HDM 05 | * | 999 |
| HDM 06 | * | 999 |
| HDM 07 | * | 999 |
| HDM 08 | * | 999 |
| HDM 09 | * | 999 |
| HDM 10 | * | 999 |
| HDM 11 | * | 999 |
| HDM 12 | * | 999 |
| HDM 13 | * | 999 |
| HDM 14 | * | 999 |
| HDM 15 | * | 999 |
| HDM 16 | * | 999 |
| HDM 17 | * | 999 |
| HDM 18 | * | NOT USED |
| HDM 19 | | NOT USED |
| HDM 20 | | NOT USED |
| HDM 21 | | NOT USED |
| HDM 22 | | NOT USED |
| HDM 23 | | NOT USED |
| HDM 24 | | NOT USED |
| HDM 25 | | NOT USED |
| HDM 26 | | NOT USED |
| HDM 27 | | NOT USED |
| HDM 28 | | NOT USED |
| HDM 28 | | NOT USED |
| HDM 30 | | NOT USED |
| HDM 31 | | NOT USED |

Fig.18c'

| TIMER (TIM) VALUE SETTING TABLE | |
|---|---|
| TIMER NO. | PRESET VALUE |
| TIM 0 | INDEX DWELL |
| TIM 1 | TRAY ONE-SHOT |
| TIM 2 | WATCHDOG |
| TIM 3 001 | DESTACKER DWELL |
| TIM 4 | - SPARE - |
| TIM 5 | TRAY LOAD OVERRUN |
| TIM 6 | CHOP SENSOR TIME-OUT |
| TIM 7 | DELAY CONVERGER H1 |

| COUNTER (CNT) VALUE SETTING VALUE | |
|---|---|
| COUNTER NO. | PRESET VALUE |
| CNT 0 | TRAY SKIP - 3 |
| CNT 1 | SYS. START WARNING - 2 |
| CNT 2 | APS 21 HOLD-OFF-4 |
| CNT 3 | APS 2R HOLD-OFF-4 |
| CNT 4 | HDM x 3 (DIFF SPACING) |
| CNT 5 | HDM x 2 (DIFF SPACING) |
| CNT 6 | BUFFER GATE DELAY (L) |
| CNT 7 | BUFFER GATE DELAY (R) |

Fig 18c"

CPU TYPE

| INPUT NO. | DESCRIPTION OF SIGNAL | OUTPUT NO. | DESCRIPTION OF SIGNAL |
|---|---|---|---|
| 000 | CHOP SENSOR CHANEL 1 | 012 | VACUUM ON |
| 001 | TRAY SENSOR CHANEL 1 | 013 | INDEX SPEED SELECT |
| 002 | TRAY MAG. SENSOR 1 | 014 | ALARM |
| 003 | TRAY MAG. SENSOR 2 | 015 | AIR BLAST ON |
| 004 | RIGHT LINE SELECTED (MODE) | 016 | TRAY CHANGE SPEED SELECT |
| 005 | PRODUCT 1 SELECTED (PROGRAM) | 017 | DESTACKER ARM UP |
| 006 | PRODUCT 2 SELECTED (PROGRAM) | 018 | CHANEL 2 AIR BLAST SELECT |
| 007 | COUNT 1 SELECTED (PROGRAM) | 019 | TRAY LOAD SPEED SELECT |
| 008 | PROGRAM LOAD BUTTON | | |
| 009 | SYNC. | | |
| 010 | RIGHT MODULE CHECK | | |
| 011 | RIGHT MODULE CHECK | | |

Fig. 19a'

| EUL 1 | 1/0 UNIT TYPE | ID411 | EUR 5 | 1/0 UNIT TYPE | OC221 |
|---|---|---|---|---|---|
| 1/0 NO. | DESCRIPTION OF SIGNAL | | 1/0 NO. | DESCRIPTION OF SIGNAL | |
| 020 | EXT STOP | | 036 | LED DRIVE COUNT 1R | |
| 021 | CONVERGER HI SPEED (FROM PC - L) | | 037 | LED DRIVE COUNT 1L (TO PC-L) | |
| 022 | TRAY LOAD PUSH BUTTON | | 038 | LED DRIVE 2P R (TO PC-L) | |
| 023 | CHOP SENSOR CHANEL 2 | | 039 | LED DRIVE 8P R (TO PC-L) | |
| EUR 2 | 1/0 UNIT TYPE | ID411 | EUR 6 | 1/0 UNIT TYPE | OC221 |
| 1/0 NO. | DESCRIPTION OF SIGNAL | | 1/0 NO. | DESCRIPTION OF SIGNAL | |
| 024 | TRAY SENSOR CHANEL 2 | | 040 | LED DRIVE EXTERNAL STOP | |
| 025 | FLIGHT SENSOR | | 041 | LED DRIVE WRONG MODULE | |
| 026 | TRAY DOWN SENSOR | | 042 | LED DRIVE TRAY MISSING | |
| 027 | - SPARE - | | 043 | LED DRIVE BUFFER OVERFLOW | |
| EUR 3 | 1/0 UNIT TYPE | ID411 | EUR 7 | 1/0 UNIT TYPE | OC221 |
| 1/0 NO. | DESCRIPTION OF SIGNAL | | 1/0 NO. | DESCRIPTION OF SIGNAL | |
| 028 | APS 2R START (FROM PC-L) | | 044 | PROGRAM DISPLAY ON/OFF | |
| 029 | RESET (MODE) | | 045 | - SPARE - | |
| 030 | APS 1R START (FROM PC-L) | | 046 | - SPARE - | |
| 031 | ALARM LEFT (FROM PC-L) | | 047 | - SPARE- | |
| EUR 4 | 1/0 UNIT TYPE | OC221 | | 1/0 UNIT TYPE | |
| 1/0 NO. | DESCRIPTION OF SIGNALS | | 1/0 NO. | DESCRIPTION OF SIGNAL | |
| 032 | LED DRIVE PRODUCT 1R | | 048 | | |
| 033 | LED DRIVE PRODUCT 2R | | 049 | | |
| 034 | LED DRIVE PRODUCT 1L | | 050 | | |
| 035 | LED DRIVE PRODUCT 2L | | 051 | | |

Fig. 19a"

| AUXILIARY RELAY NO. | DESCRIPTION OF SIGNAL | AUXILIARY RELAY NO. | DESCRIPTION OF SIGNAL |
|---|---|---|---|
| 064 | CHOP READY | 084 | PROGRAM DECODE 6 |
| 065 | INDEX DONE | 085 | PROGRAM DECODE 7 |
| 066 | AIR BLAST MASTER | 086 | PROGRAM DECODE 8 |
| 067 | - SPARE - | 087 | PROGRAM DECODE 9 |
| 068 | - SPARE - | 088 | PROGRAM DECODE 10 |
| 069 | TRAY FULL | 089 | PROGRAM DECODE 11 |
| 070 | TRAY READY (LATCH) | 090 | PROGRAM DECODE 12 |
| 071 | 4P TRAY SELECTED (R) | 091 | PROGRAM DECODE 13 |
| 072 | TRAY SENSOR ONE-SHOT | 092 | PROGRAM DECODE 14 |
| 073 | - SPARE - | 093 | PROGRAM DECODE 15 |
| 074 | - SPARE - | 094 | PROGRAM DECODE 16 |
| 075 | PRODUCT 3R SELECTED | 095 | PROGRAM DECODE 17 |
| 076 | PRODUCT 3L SELECTED | 096 | PROGRAM SELECTED 18 |
| 077 | COUNT 2R SELECTED | 097 | HDM COUNT DONE |
| 078 | COUNT 2L SELECTED | 098 | - SPARE - |
| 079 | PROGRAM DECODE 1 | 099 | - SPARE - |
| 080 | PROGRAM DECODE 2 | KR 00 | TRAY CHANGE LATCH |
| 081 | PROGRAM DECODE 3 | KR 01 | DESTACKER LATCH |
| 082 | PROGRAM DECODE 4 | KR 02 | TRAY LOAD LATCH |
| 083 | PROGRAM DECODE 5 | KR 03 | PROGRAM RESET LATCH |
| | | KR 04 | - SPARE - |
| | | KR 05 | - SPARE - |
| | | KR 06 | - SPARE - |
| | | KR 07 | - SPARE - |

Fig. 19b

| CHOPS/TRAY COUNT | | | CHOP SPACING | | |
|---|---|---|---|---|---|
| REVERSIBLE (RDM) COUNTER VALUE SETTING TABLE | | | HIGH SPEED COUNTER (HDM) VALUE SETTING TABLE | | |
| OUTPUT SETTING NO. | PRESET VALUE A | PRESET VALUE B | OUTPUT SETTING NO. | PRESET VALUE A | PRESET VALUE B |
| RDM 00 | * | 999 | HDM 00 | * | 999 |
| RDM 01 | * | 999 | HDM 01 | * | 999 |
| RDM 02 | * | 999 | HDM 02 | * | 999 |
| RDM 03 | * | 999 | HDM 03 | * | 999 |
| RDM 04 | * | 999 | HDM 04 | * | 999 |
| RDM 05 | * | 999 | HDM 05 | * | 999 |
| RDM 06 | * | 999 | HDM 06 | * | 999 |
| RDM 07 | * | 999 | HDM 07 | * | 999 |
| RDM 08 | * | 999 | HDM 08 | * | 999 |
| RDM 09 | * | 999 | HDM 09 | * | 999 |
| RDM 10 | * | 999 | HDM 10 | * | 999 |
| RDM 11 | * | 999 | HDM 11 | * | 999 |
| RDM 12 | * | 999 | HDM 12 | * | 999 |
| RDM 13 | * | 999 | HDM 13 | * | 999 |
| RDM 14 | * | 999 | HDM 14 | * | 999 |
| RDM 15 | * | 999 | HDM 15 | * | 999 |
| RDM 16 | * | 999 | HDM 16 | * | 999 |
| RDM 17 | * | 999 | HDM 17 | * | 999 |
| RDM 18 | NOT USED | | HDM 18 | NOT USED | |
| RDM 19 | NOT USED | | HDM 19 | NOT USED | |
| RDM 20 | NOT USED | | HDM 20 | NOT USED | |
| RDM 21 | NOT USED | | HDM 21 | NOT USED | |
| RDM 22 | NOT USED | | HDM 22 | NOT USED | |
| RDM 23 | NOT USED | | HDM 23 | NOT USED | |
| RDM 24 | NOT USED | | HDM 24 | NOT USED | |
| RDM 25 | NOT USED | | HDM 25 | NOT USED | |
| RDM 26 | NOT USED | | HDM 26 | NOT USED | |
| RDM 27 | NOT USED | | HDM 27 | NOT USED | |
| RDM 28 | NOT USED | | HDM 28 | NOT USED | |
| RDM 29 | NOT USED | | HDM 29 | NOT USED | |
| RDM 30 | NOT USED | | HDM 30 | NOT USED | |
| RDM 31 | 002 | 999 | HDM 31 | NOT USED | |

Fig.19c'

| TIMER (TIM) VALUE SETTING TABLE | |
|---|---|
| TIMER NO. | PRESET VALUE |
| TIM 0 | INDEX DWELL |
| TIM 1 | TRAY ONE - SHOT |
| TIM 2 | WATCHDOG |
| TIM 3 001 | DESTACKER DWELL |
| TIM 4 | - SPARE - |
| TIM 5 | INITIAL POSN O/RUN |
| TIM 6 | |
| TIM 7 | |

| COUNTER (CNT) VALUE SETTING TABLE | |
|---|---|
| COUNTER NO. | PRESET VALUE |
| CNT 0 | TRAY SKIP - 3 |
| CNT 1 | - SPARE - |
| CNT 2 | - SPARE - |
| CNT 3 | - SPARE - |
| CNT 4 | HDM x 3 (DIFF SPACING) |
| CNT 5 | HDM x 2 (DIFF SPACING) |
| CNT 6 | - SPARE - |
| CNT 7 | - SPARE - |

Fig 19c"

PACKAGING APPARATUS

FIELD OF INVENTION

This invention concerns packaging apparatus and in particular apparatus by which cut pieces of a product can be delivered to tray like supports into which they are to be packed in a desired manner.

BACKGROUND TO THE INVENTION

It is known to cut product into pieces ready for packaging particularly in the food industry. Meat and cheese are typical of such products where relatively small pieces are required for the retail outlet whereas the raw material is only available in large pieces at the wholesale level.

Dedicated cutting machines provide a stream of cut pieces which must be packaged and in the case of meat it has become common practice to layer two or three or more pieces of cut meat on a preformed plastics or (foamed plastics) material tray and to then wrap the latter in a clear film material so that the product can be seen and inspected before purchase but is nevertheless kept airtight during storage and display.

Such a process is of particular application in the packaging of meat chops.

It is an object of the present invention to provide apparatus for use in a packaging line adapted to receive a stream of cut meat pieces typically chops and to lay the cut pieces of meat in a particular manner on a tray-like support ready for wrapping.

It is a further object of the invention to provide such apparatus which is capable of operating at relatively high speed so that a large quantity of such cut product can be handled each hour.

It is a further object of the invention to provide apparatus which can handle the output from two product cutting machines so that whilst one cutting apparatus is operating the other can be cleaned and reloaded.

SUMMARY OF THE INVENTION

According to one aspect of the present invention apparatus for loading trays with cut product comprises:

1. a delivery conveyor onto the input end of which are delivered the cut pieces in sequence so as to lie one after another along the length of the delivery conveyor as it moves to a delivery station, 2. a tray conveyor extending transversely to the delivery conveyor through the delivery station and adapted to deliver in succession a plurality of trays to the delivery station to receive cut product from the delivery conveyor, 3. product sensing means at the delivery station to detect the passage of each cut piece therethrough, 4. drive means for the tray conveyor operable in response to drive signals which are generated in response to the detection of cut pieces by the product sensing means each signal serving to move the tray conveyor through a distance sufficient to present the next available region of the tray to the delivery station, to receive the next piece of cut product until the tray is full, and 5. transfer conveyor means downstream from the delivery station onto which filled trays pass after being filled to move the filled trays away from the delivery station in a continuous manner toward a wrapping station.

Preferably the trays are arranged in abutting end to end relationship along the tray conveyor.

Where different lengths of shift are required between the delivery of one cut piece and the next, counting means may be provided to determine how many pieces have been loaded per tray and further control means is provided to adjust the distance by which the tray which is being loaded is shifted, by the next drive to arrive.

According to a preferred feature of the invention, where the product is cut pieces of meat, one or more air jets are located at the delivery end of the delivery conveyor and control signals therefor are derived from the product sensing means to generate a controlled puff of air a predetermined period of time after the detection of a cut piece of meat at the output of the delivery conveyor, the timing being such as to cause the cut piece of meat to be tilted by the puff of air during its flight from the end of the delivery conveyor onto the tray on the tray conveyor, to thereby cause the product to adopt an inclined position in the tray.

Preferably tray sensing means is provided, in association with the tray conveyor, to detect the presence and absence of trays at the delivery station, and control means is provided responsive to signals from the tray sensing means to inhibit the operation of the delivery conveyor in the event that no tray is detected at the delivery station.

Conveniently the tray conveyor comprises a pair of guide rails along which the trays can slide and a driving conveyor having driving dogs situated at intervals therealong running between the rails. In this way each tray is engaged by one of the driving dogs and is pushed in a forward direction along the conveyor path into and through the delivery station.

Preferably the guide rails are adjustable both in height and relative spacing so as to enable the apparatus to be tailored to any particular tray size within a range of sizes.

Since the motion of each tray through the delivery station is made up of a series of steps each of which involves the acceleration of the tray from rest followed almost immediately by a deceleration as it arrives at its next required position, friction braking means is preferably provided at the delivery station to arrest the forward movement of each tray as it passes therethrough and prevent overshoot of each tray following each stepwise forward movement thereof. The friction braking means typically comprises spring loaded fingers which engage one or both sides or edge regions of the tray.

Preferably guide means is provided upstream of the output end of the delivery conveyor for positioning the cut product on the delivery conveyor to a precise position across the outlet thereof so that as each piece of cut product arrives at the output of the delivery conveyor, at least one edge thereof is positioned precisely across the width of the delivery conveyor and therefore in turn along the length of the tray conveyor, thereby enabling the position of the cut product as it leaves the delivery conveyor to be precisely known.

Upstream from the delivery station, the trays are conveniently stacked one above the other in a column above the tray conveyor and means is provided for removing the trays in turn from the bottom of the stack and depositing them on the tray conveyor.

Where the latter as indicated above comprises a pair of rails on which the trays can slide in conjunction with a driving conveyor having driving dogs which move between the rails to effect movement of the trays along the rails, the mechanism for removing the trays from the bottom of the stack conveniently locates the bottom-most tray on the rails in a position in which it can be engaged by the next driving dog, to arrive after which the tray will be pushed forwardly relative to the rest of the stack, towards the delivery station.

Conveniently the driving dogs are mounted on an endless belt or chain which extends parallel to the rails forming the remainder of the tray conveyor.

Where the apparatus is designed to operate with different sizes of tray, the latter are preferably coded typically along an edge region thereof and decoding means is provided at a position along the tray conveyor for determining the particular tray size and generating control signals indicative thereof.

To this end the drive means for the tray conveyor conveniently operates in a series of incremental steps and either the step size or the number of incremental steps making up each transfer movement of the tray conveyor is controllable in response to the signals from the tray decoding means.

The invention also provides a method of cutting meat into pieces and loading same into trays comprising the steps of:

(1) cutting the meat into relatively small similarly shaped pieces;

(2) delivering the pieces in succession by means of a delivery conveyor to a delivery station for loading into a tray located thereat;

(3) incrementally moving the tray relative to the delivery station after each cut piece of meat has been delivered thereto;

(4) sensing the arrival of each piece of meat at the delivery station and generating and applying a puff of air towards the cut of meat as the latter is in free flight between the outlet of the delivery conveyor and the tray, to tilt each piece of meat so as to cause the meat to be inclined as it comes to rest in the tray, to enable the pieces of meat to be shingled as it is laid in the tray.

In a preferred embodiment there are two cutters and meat from one cutter and then the other is delivered to the delivery conveyor.

According to another aspect of the invention in a method of loading pieces of meat into trays using the apparatus and methods as aforesaid, improved performance and reliability is obtained by controlling the temperature of the meat portions so that the meat is of appropriate texture to land on the trays with minimal bounce.

Where pork chops are involved a preferred temperature has been found to be in the range 26 to 30 degrees Fahrenheit preferably 28 degrees Fahrenheit.

The invention will now be described by way of example with reference to the accompanying drawings in which.

Figure 1:
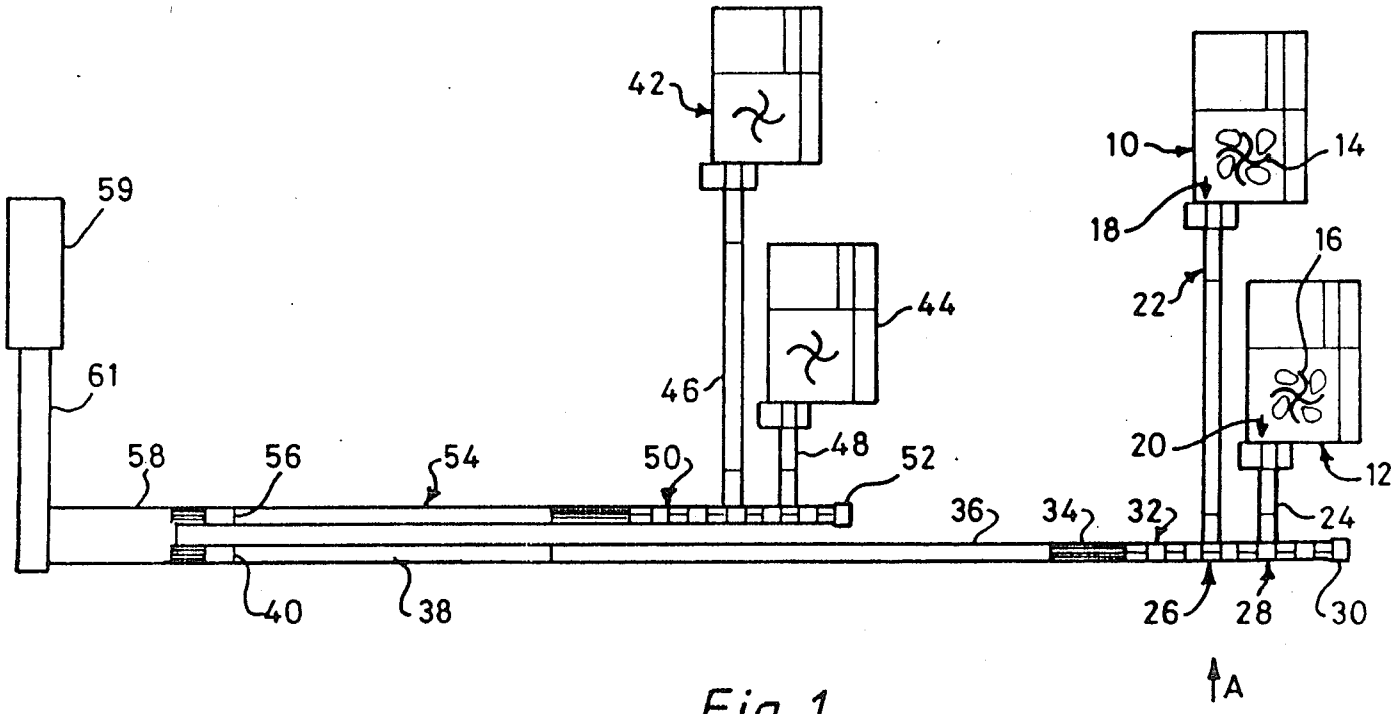
FIG. 1 is a diagrammatic plan view of a packaging line incorporating apparatus embodying the invention.
Figure 2:
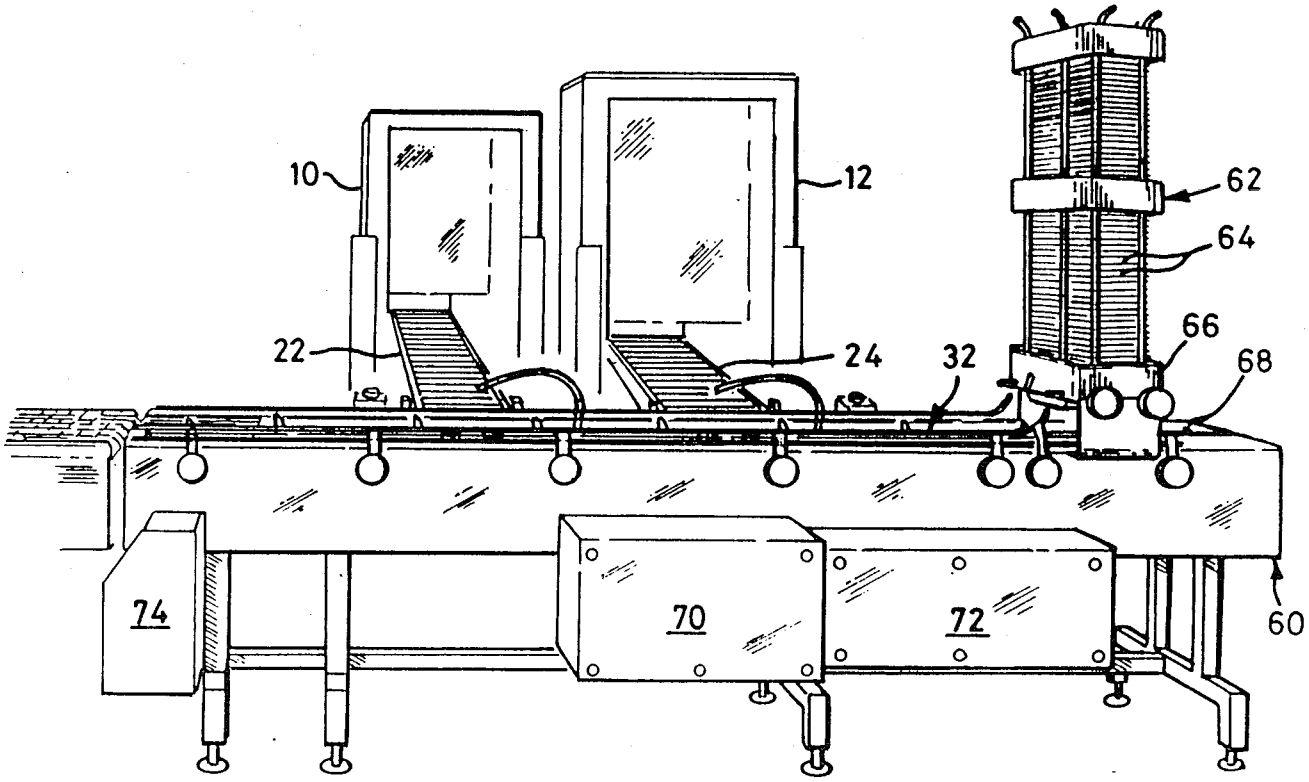
FIG. 2 is a general view in the direction the arrow A of part of the apparatus shown in FIG. 1.
Figure 3:
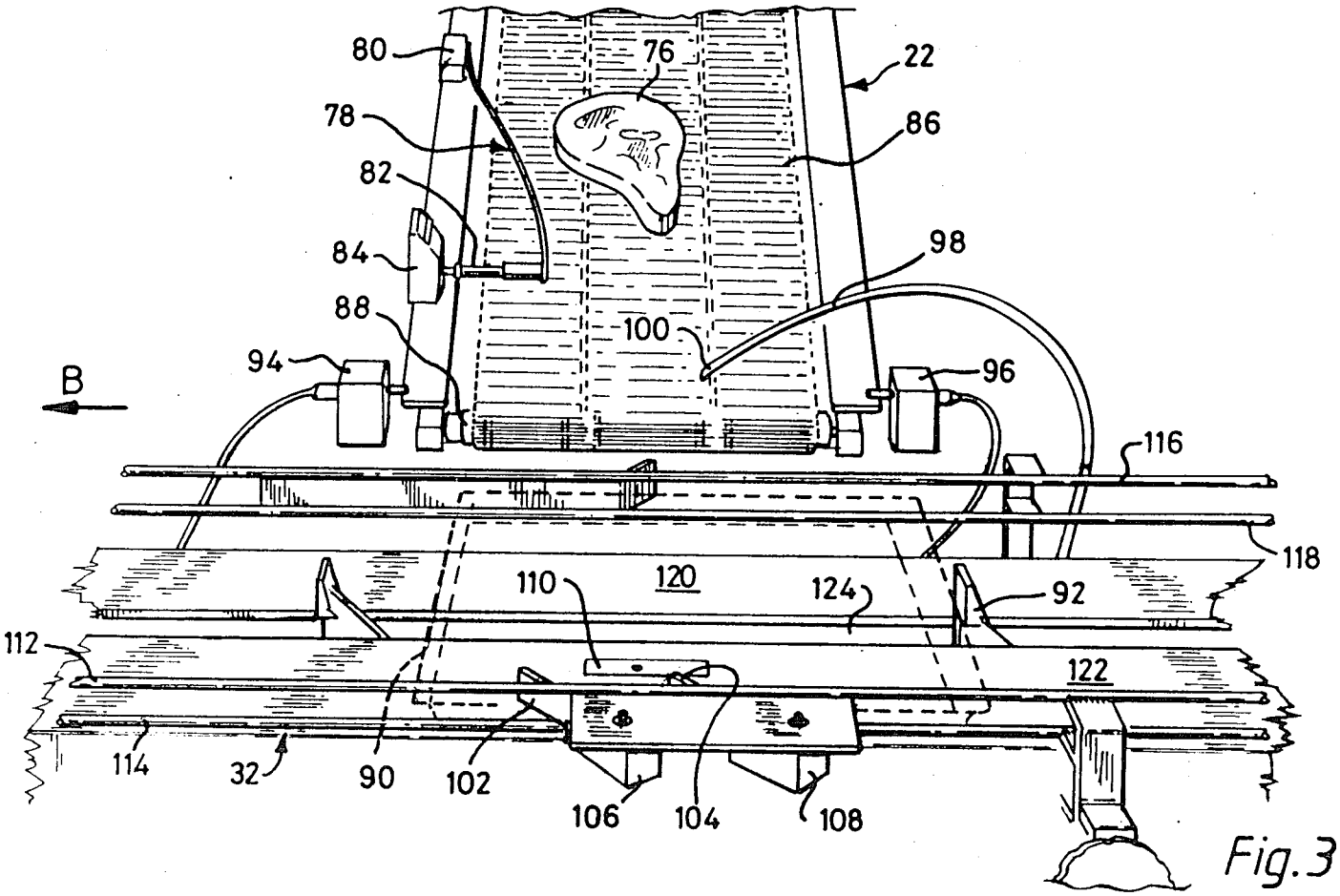
FIG. 3 is a perspective view from above of the outlet end of one of the delivery conveyors shown in FIG. 2.
Figure 4:
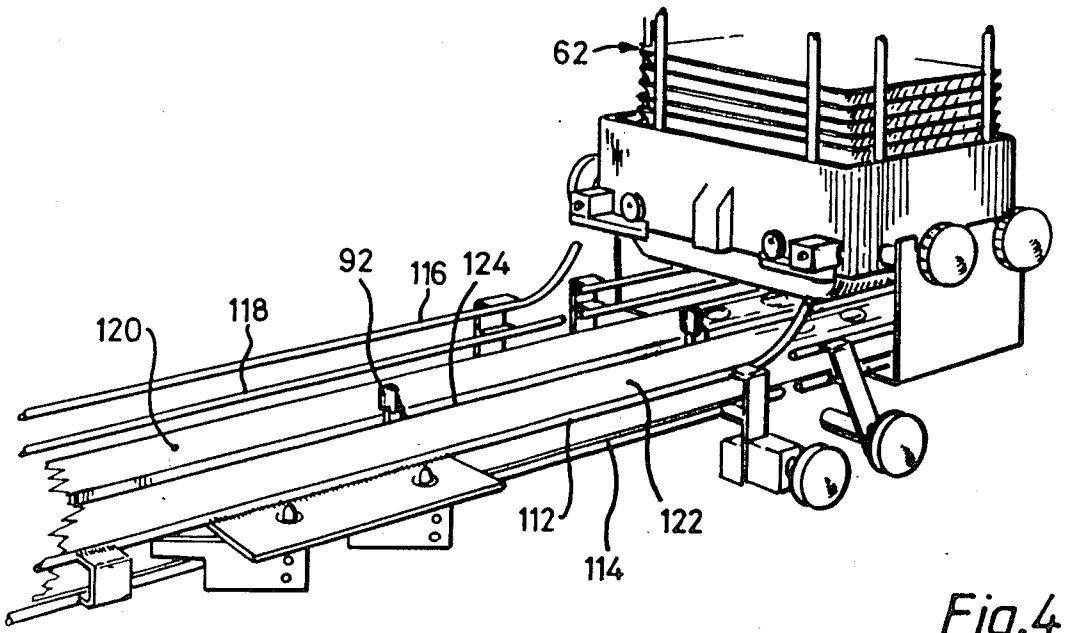
FIG. 4 is a perspective view of the lower end of the tray stack.
Figure 5:
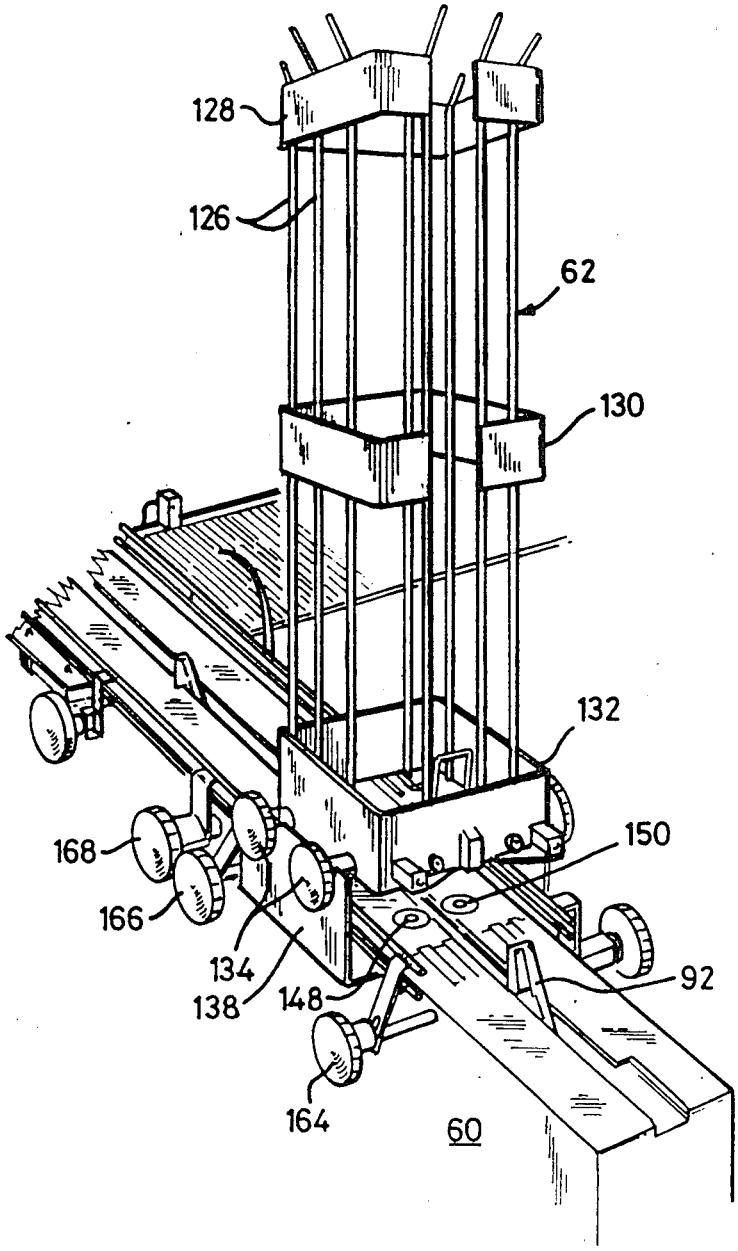
FIG. 5 is another perspective view of the tray stack, this time shown empty.
Figure 6:
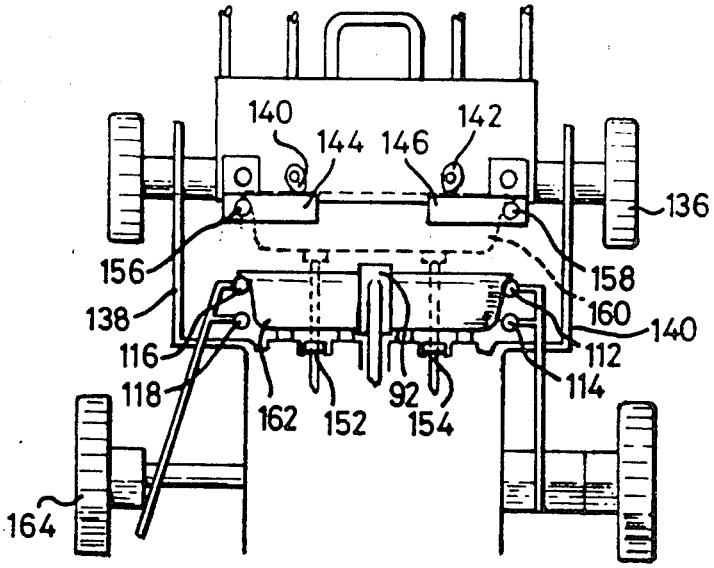
Figure 7A:
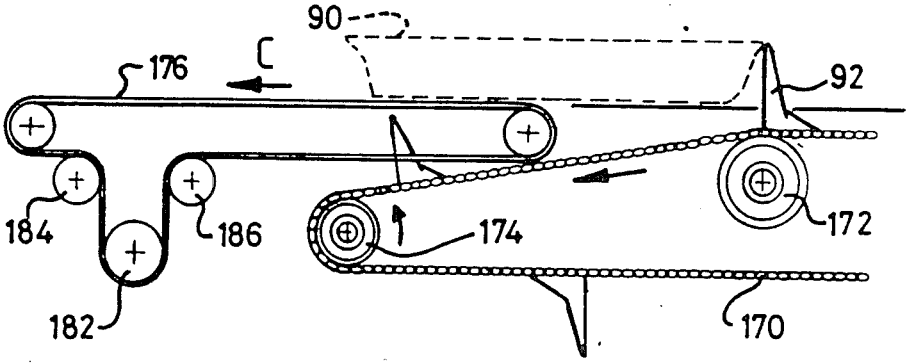
Figure 7B:
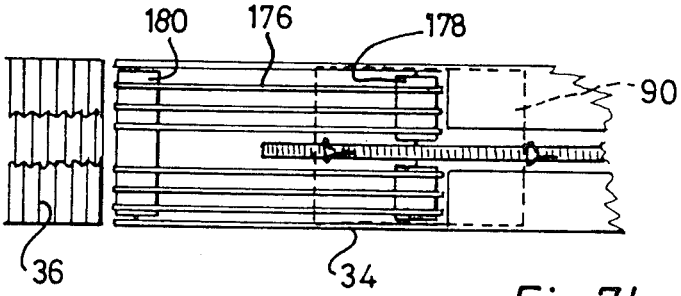
Figure 9:
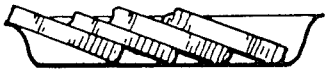
Figure 8:
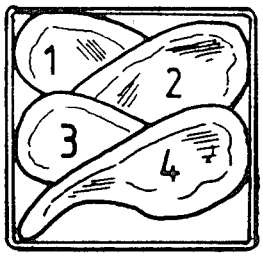
Figure 10:
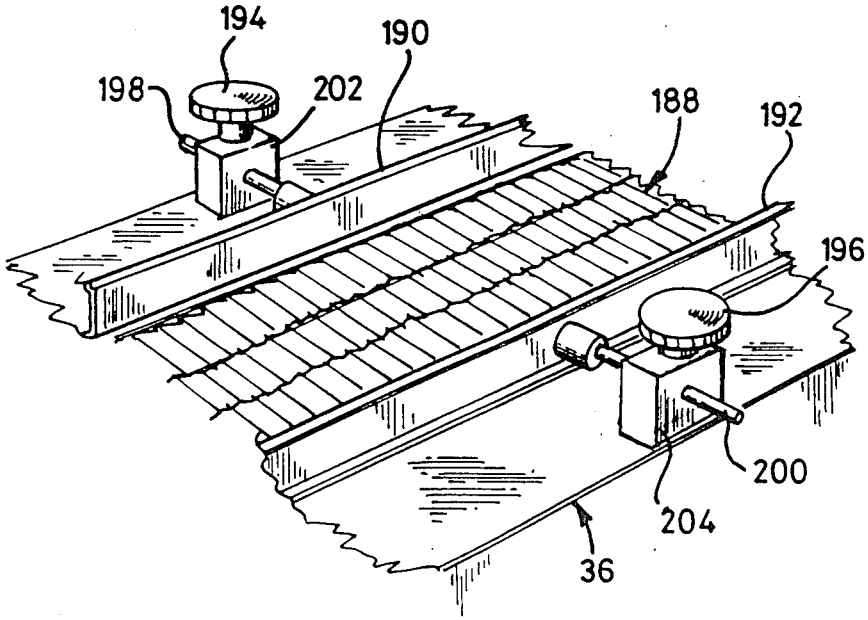
Figure 11:
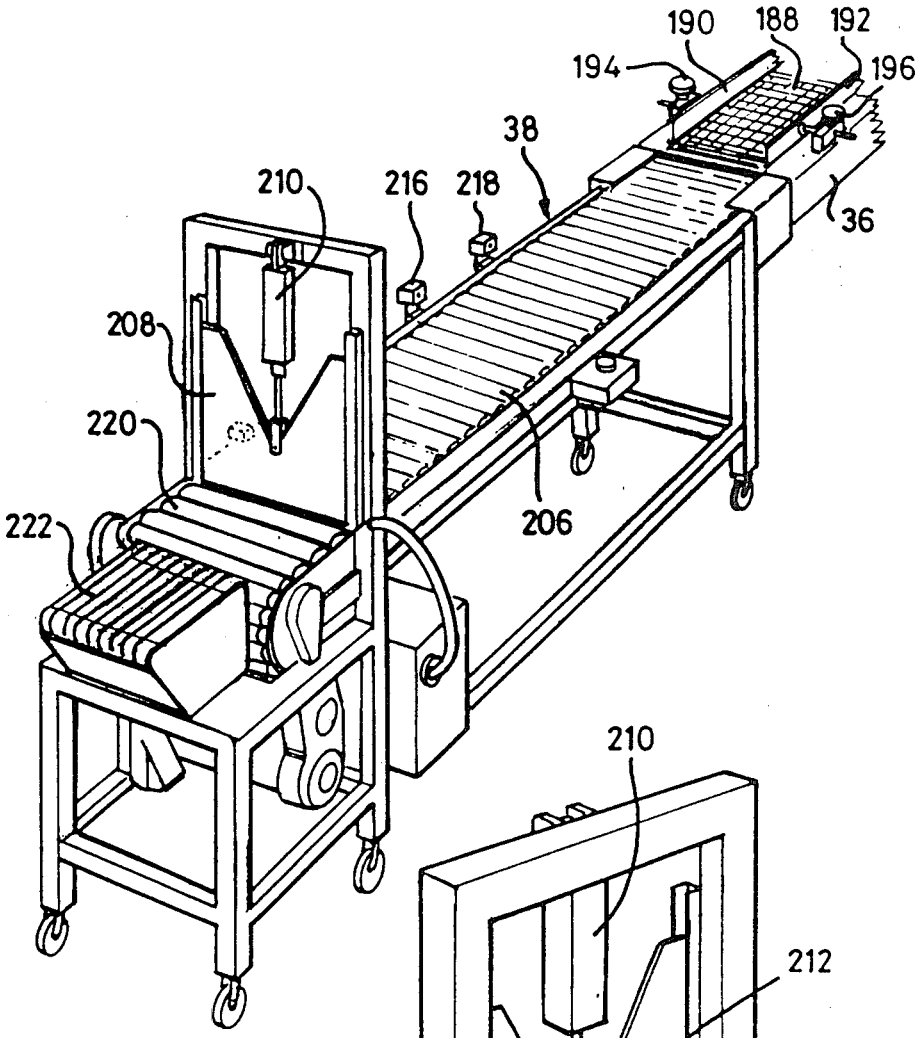
Figure 12:
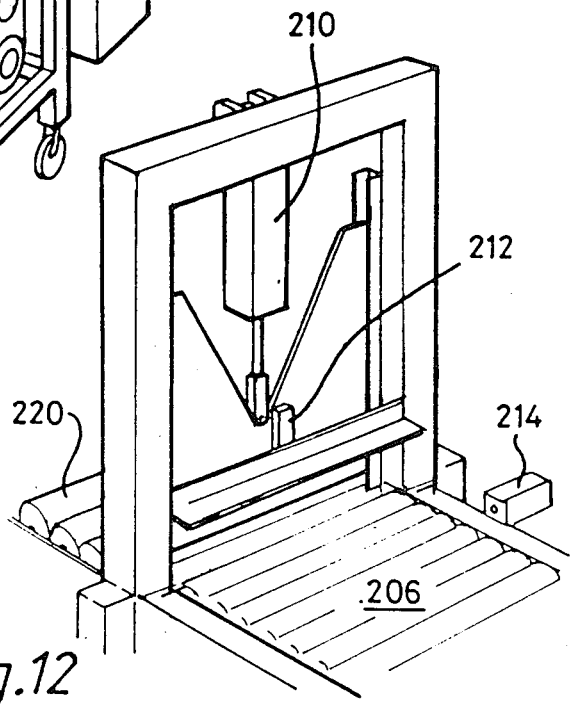
Figure 13:
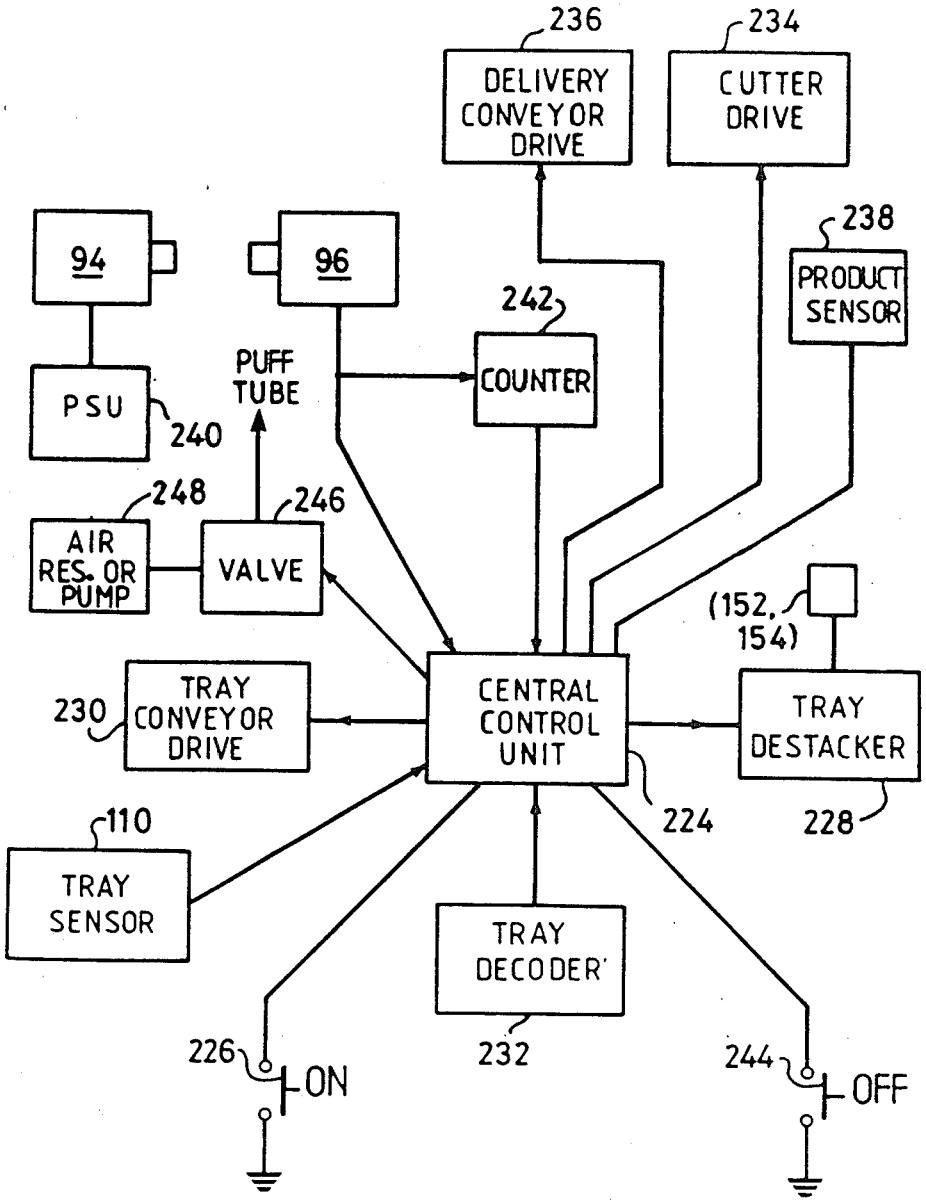

FIG. 6 is an end view of the lower end of the tray stack support and shows the mechanism by which trays are removed from the bottom of the stack and loaded onto the tray conveyor, FIGS. 7A and 7B are diagrammatic side and top views of the delivery end of the tray conveyor, FIG. 8 is a top view of a tray loaded with 4 meat chops after passing through the loading station shown in FIG. 3, FIG. 9 is a side view of the tray of FIG. 8 with the nearer side of the tray removed to enable the lay of the chops to be seen, FIG. 10 is a perspective view of part of the main conveyor onto which the filled tray is delivered from the transfer conveyor of FIG. 7A, FIG. 11 is a perspective view of a buffer conveyor and gate to which the filled trays are delivered by the main conveyance of FIG. 10, and FIG. 12 is a perspective view of the gate mechanism of FIG. 11 from the opposite side, FIG. 13 is a schematic block circuit diagram of part of the control system associated with the apparatus of FIGS. 1 to 12.

Figure 14:
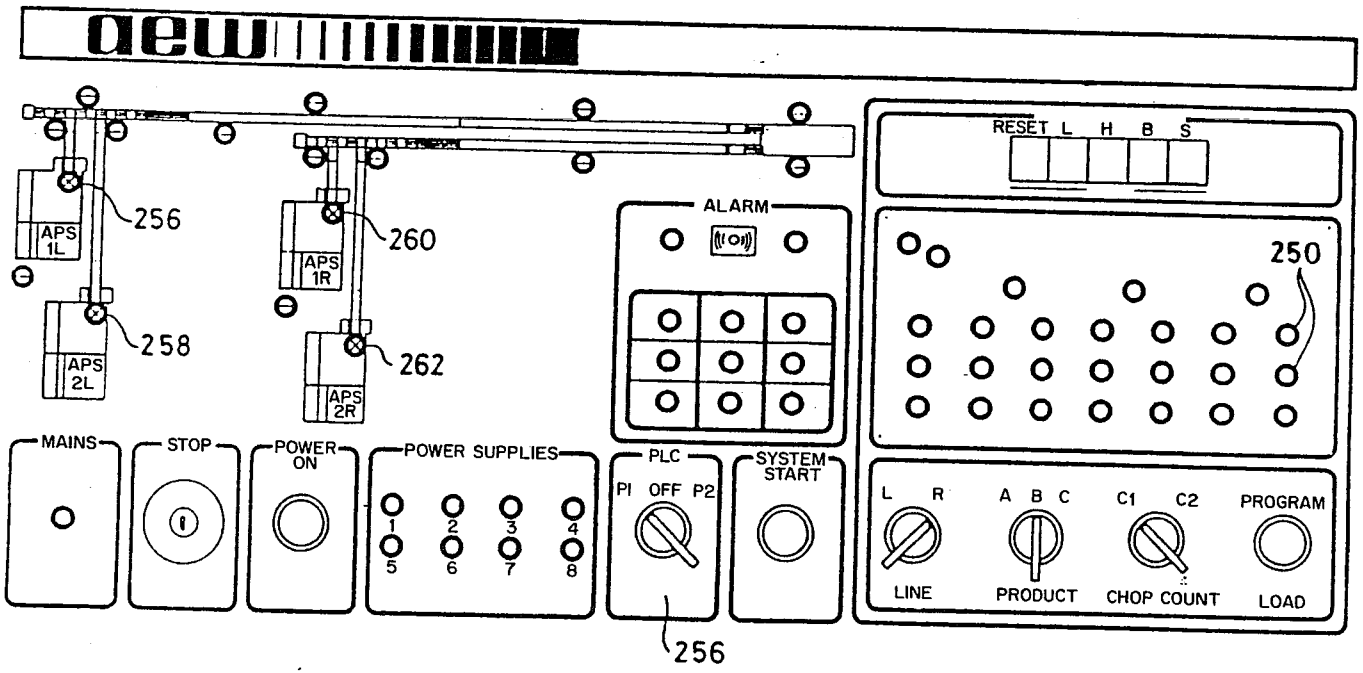
Figure 15:
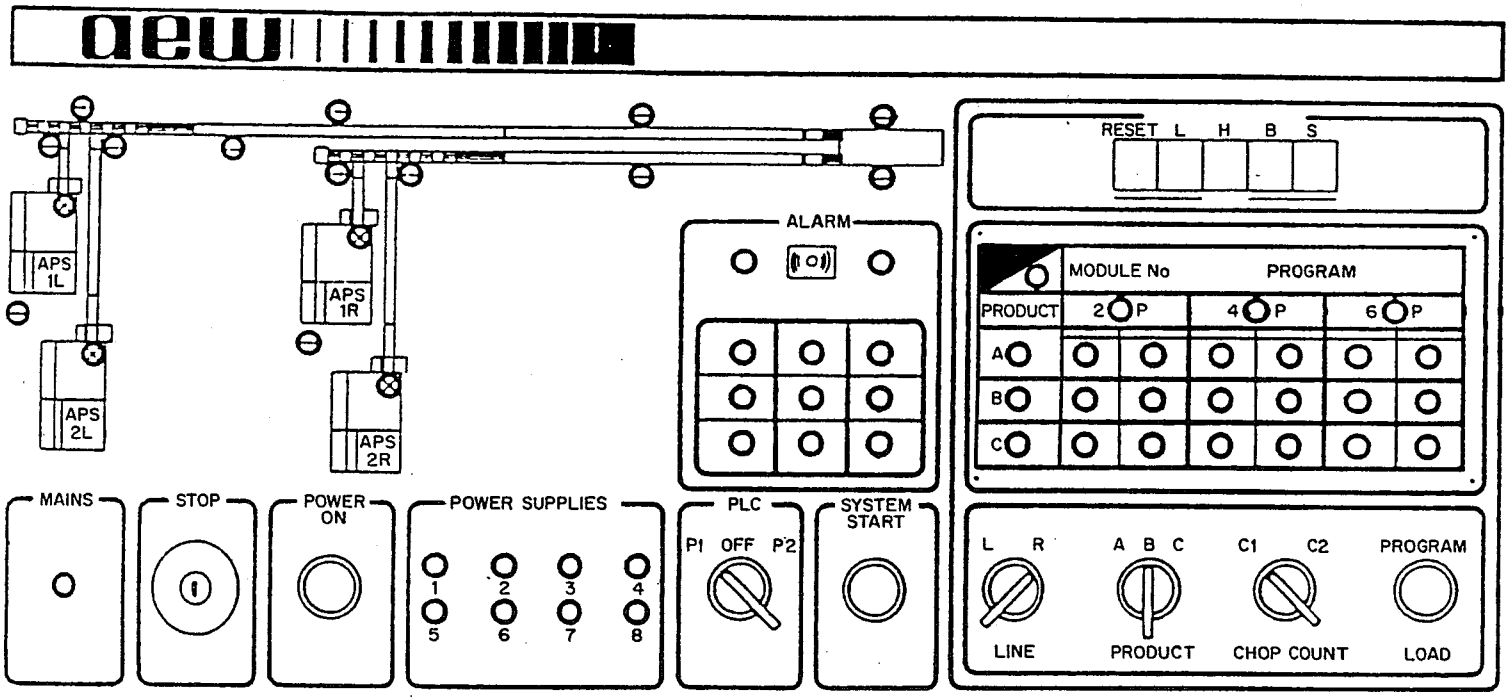
Figure 17:
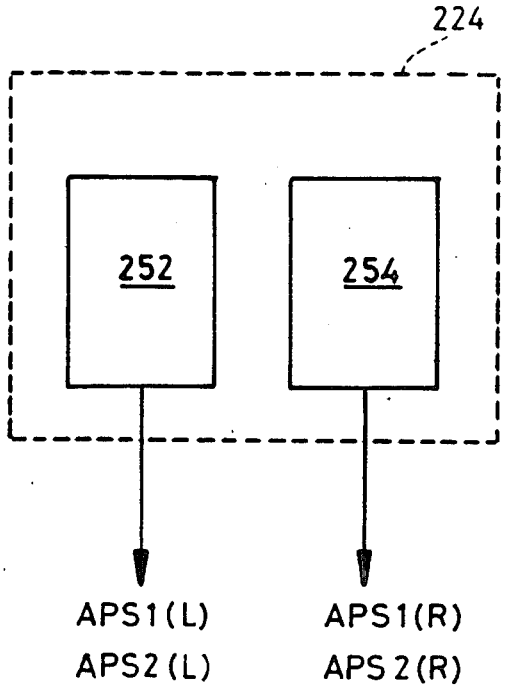
Figure 20A:
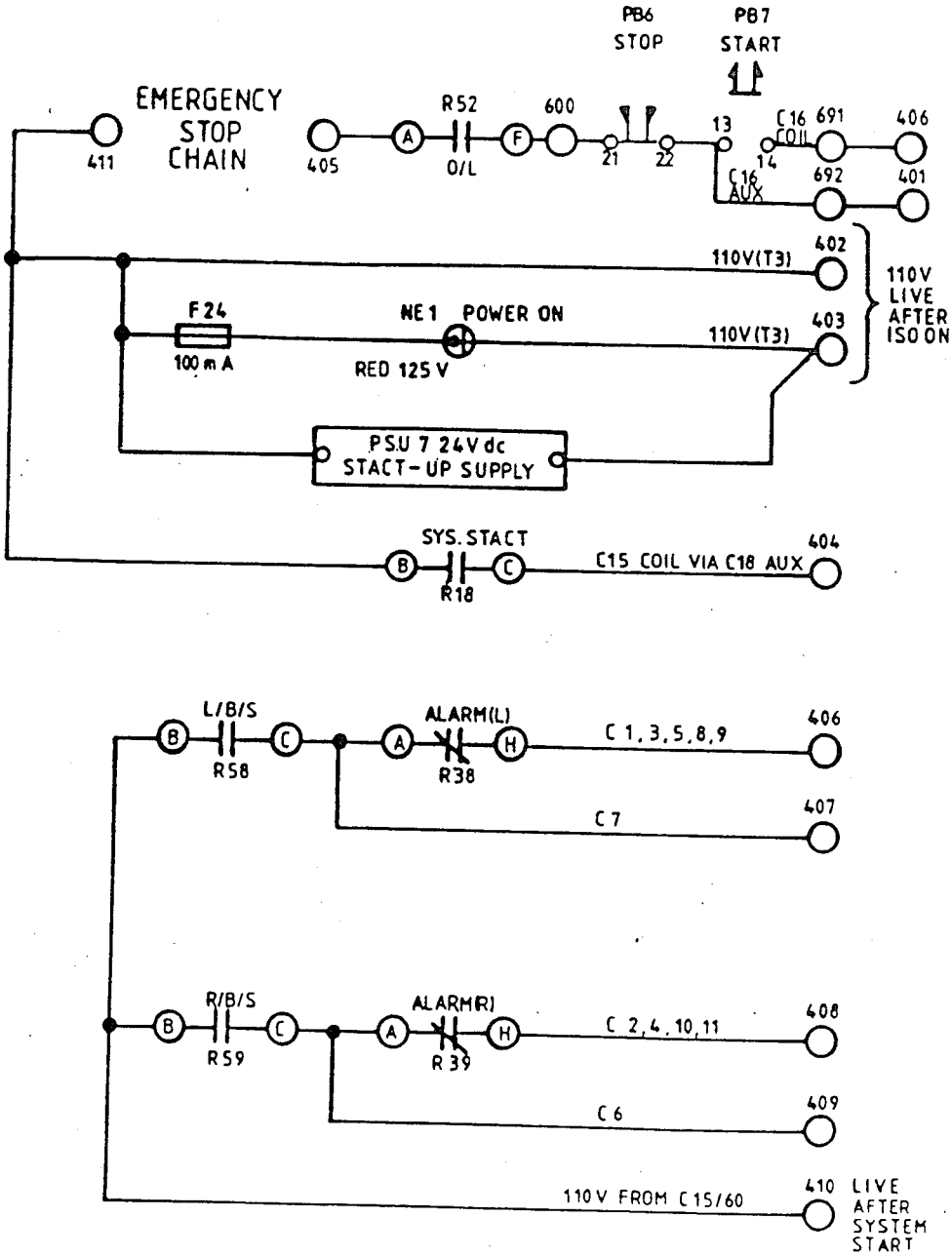
Figure 20B:
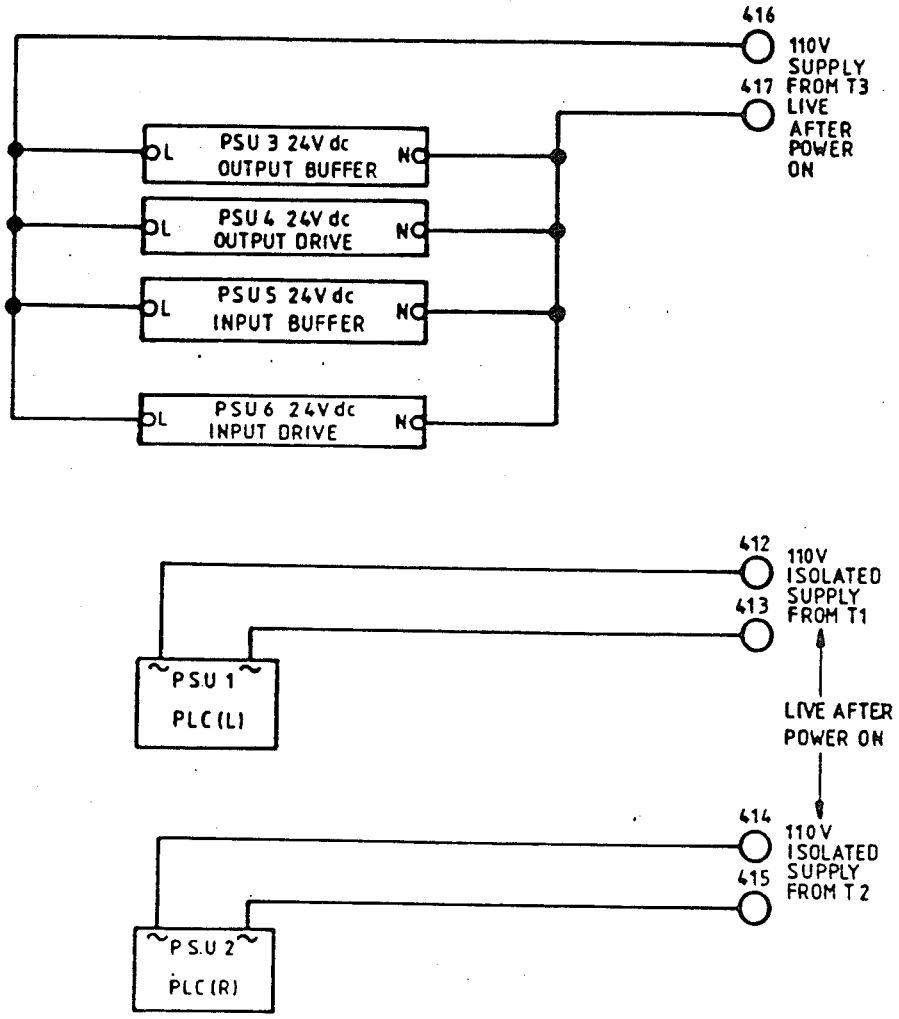
Figure 20C:
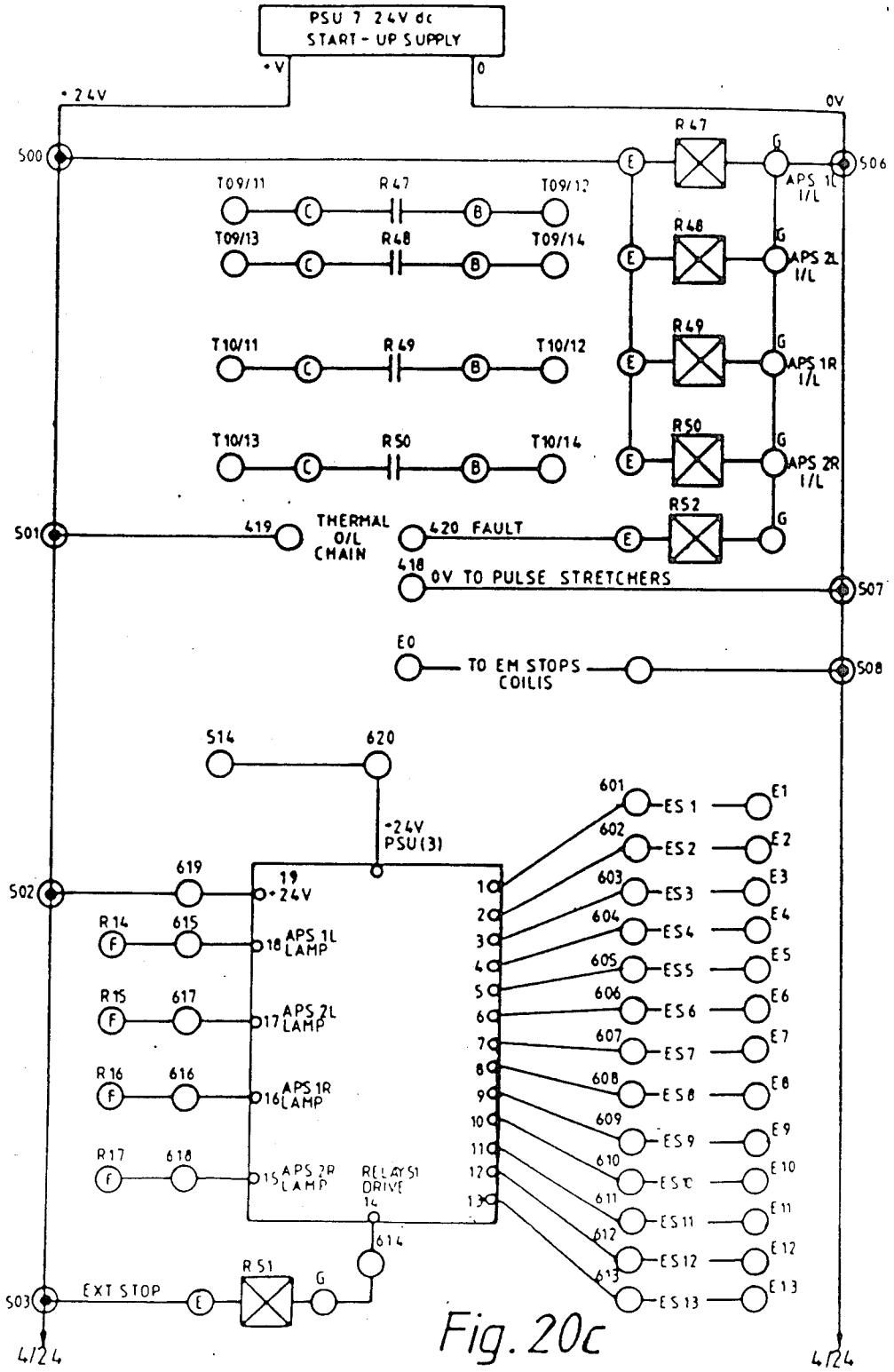
Figure 20D:
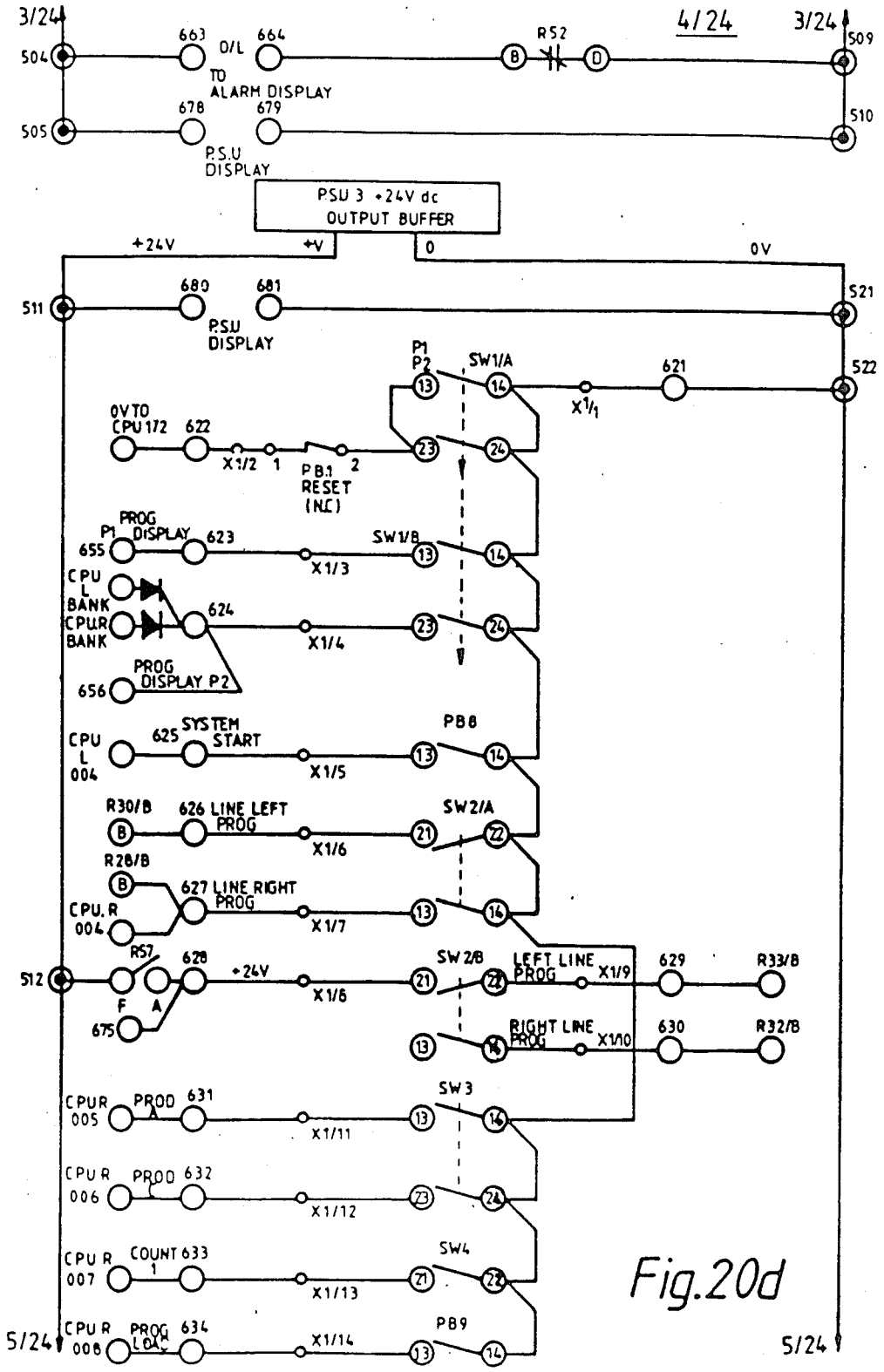
Figure 20E:
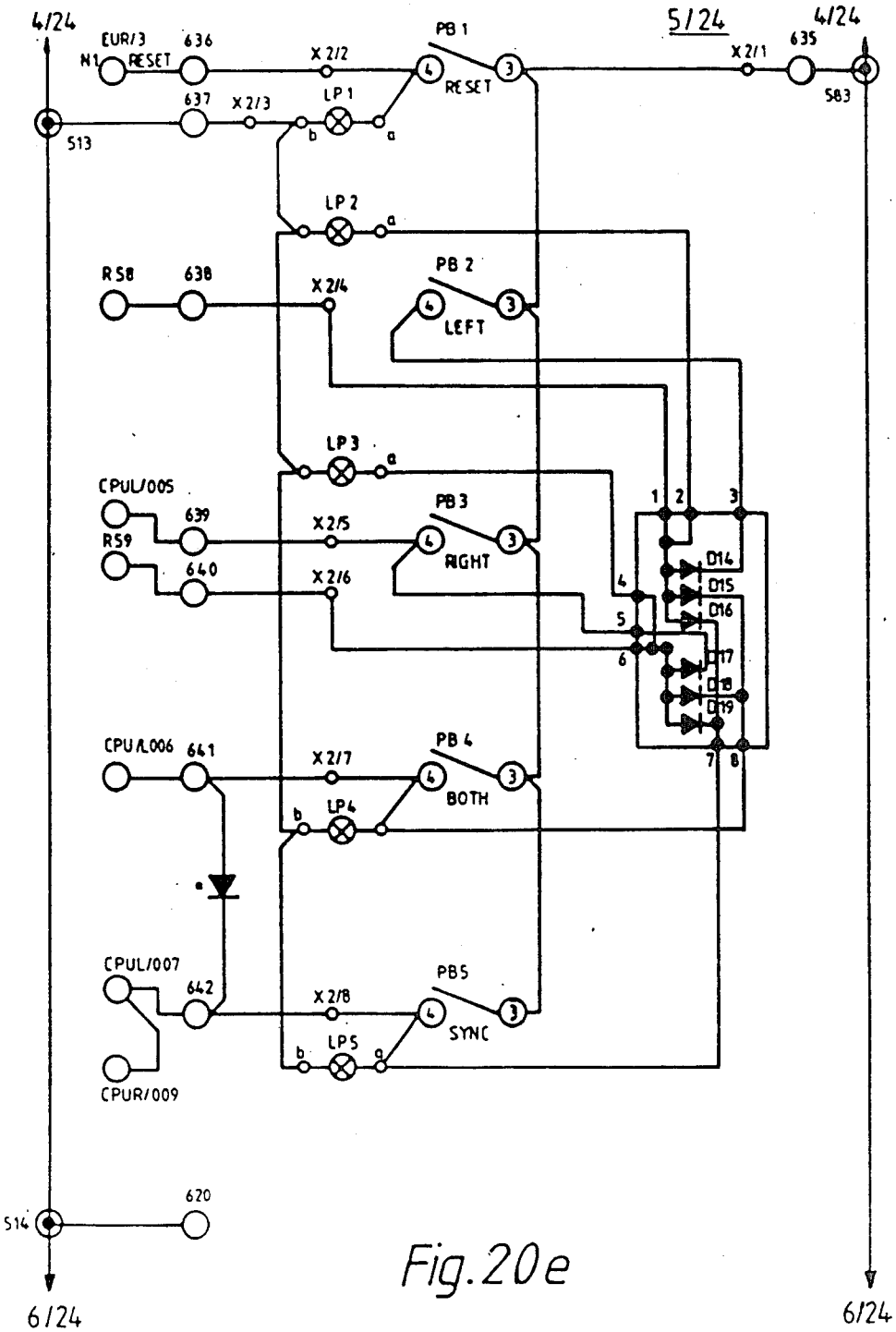
Figure 20F:
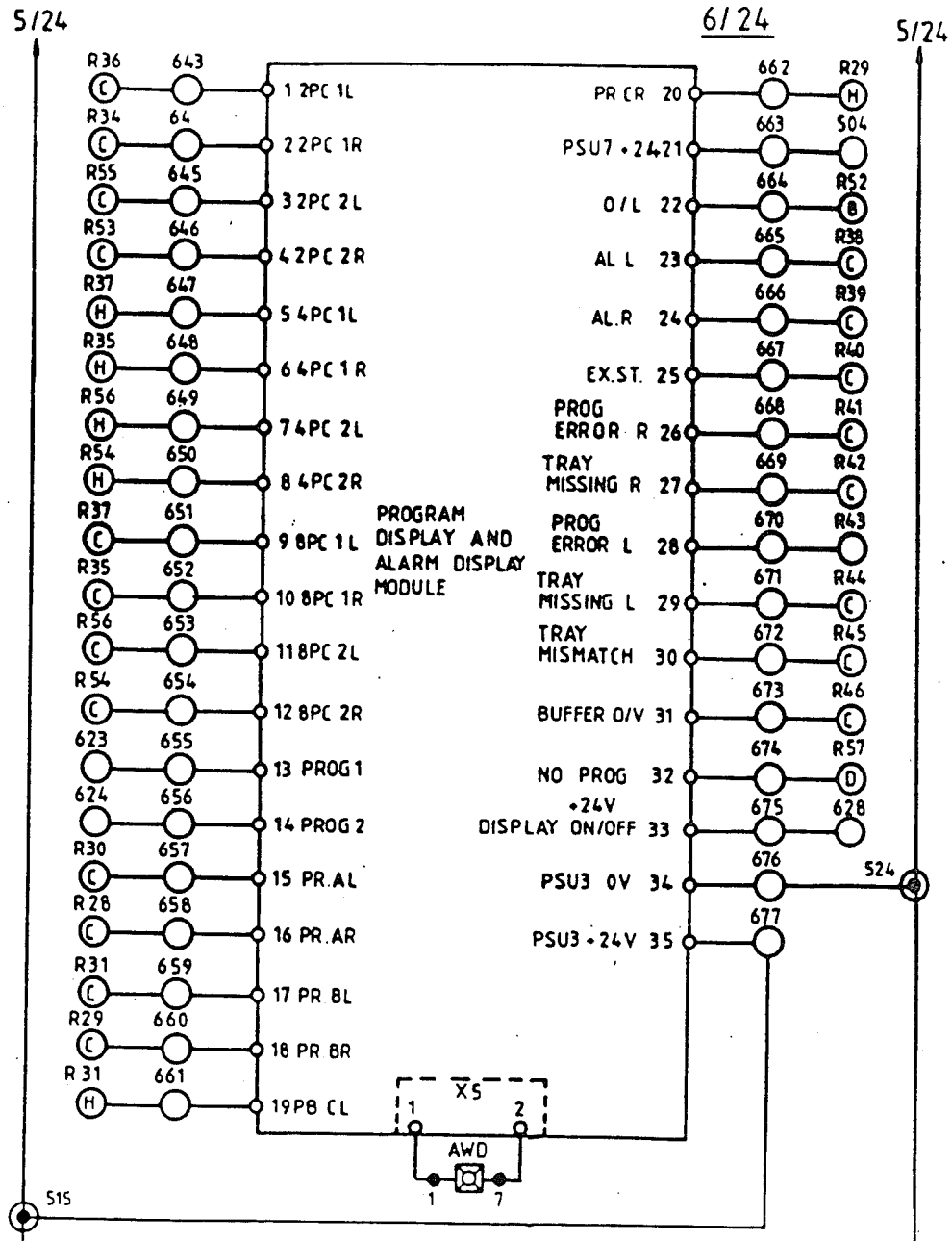
Figure 20G:
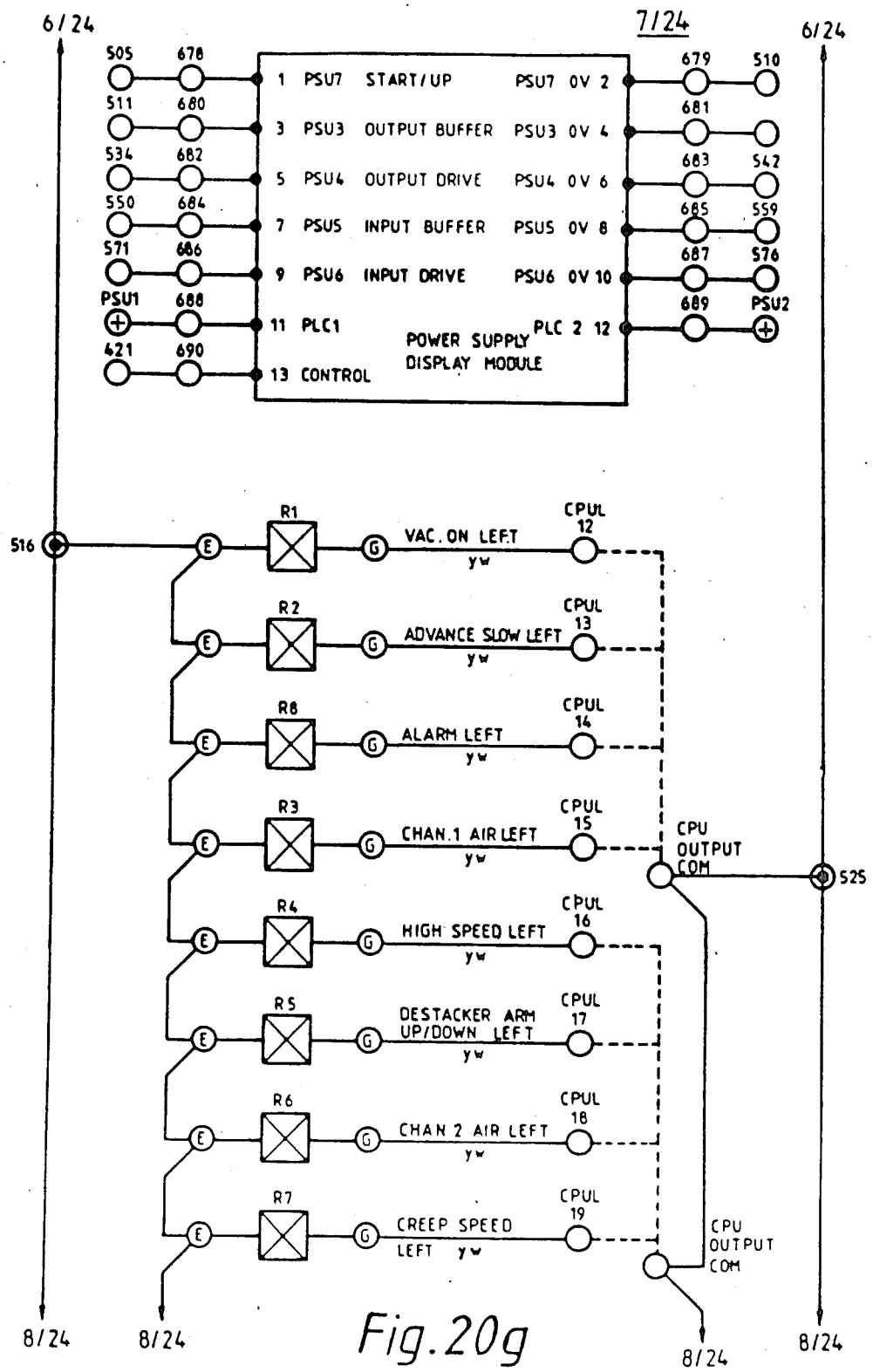
Figure 20H:
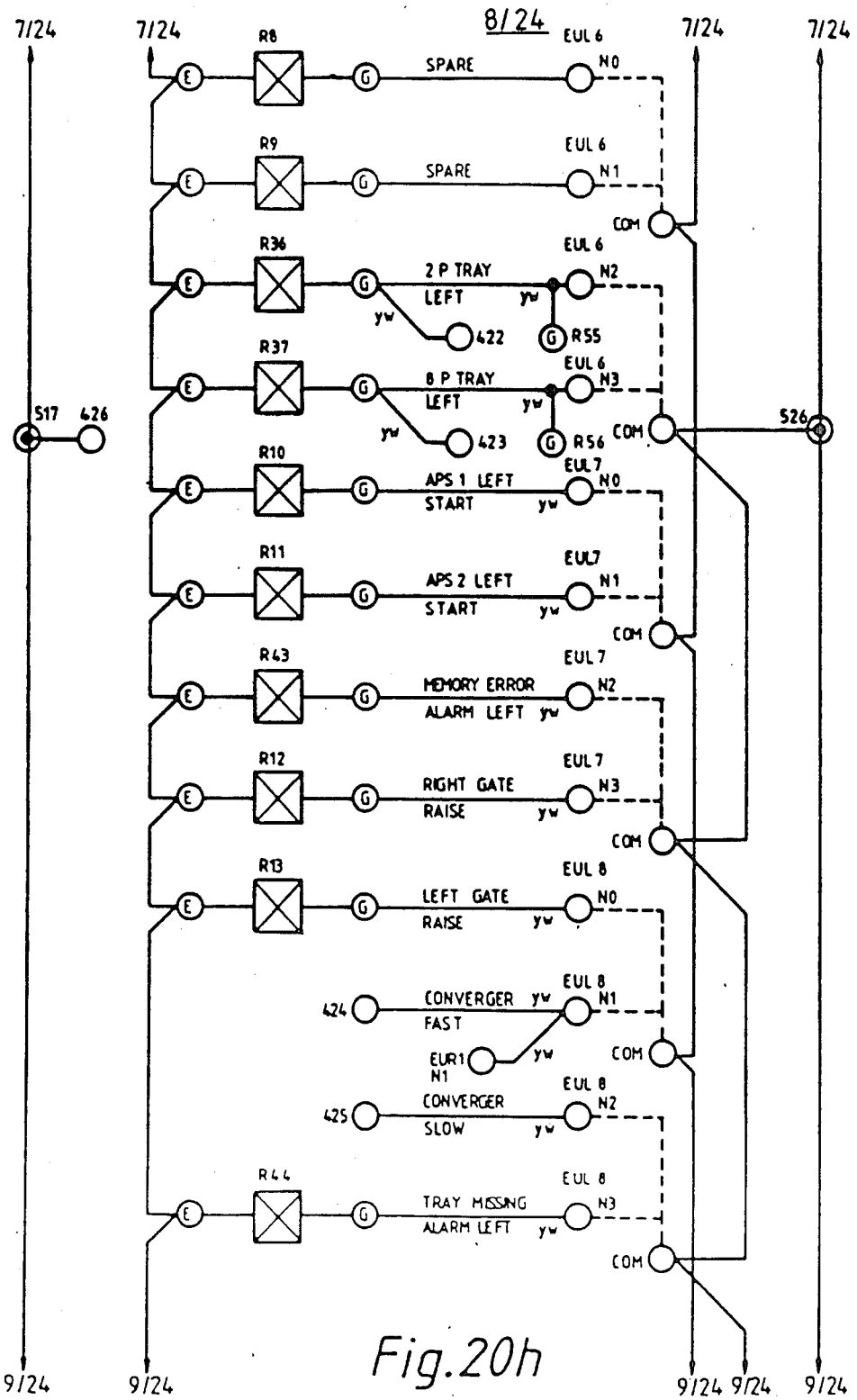
Figure 20I:
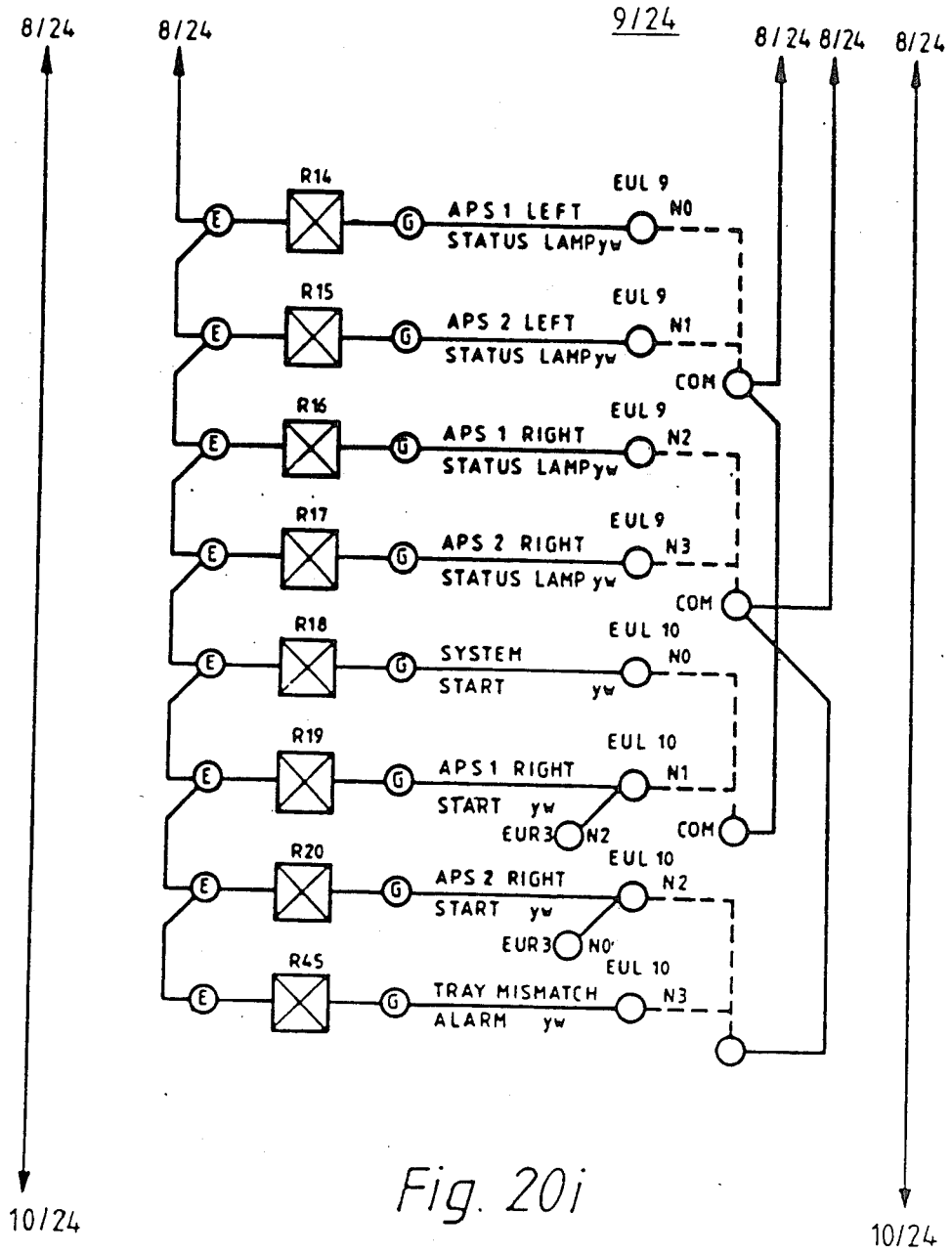
Figure 20J:
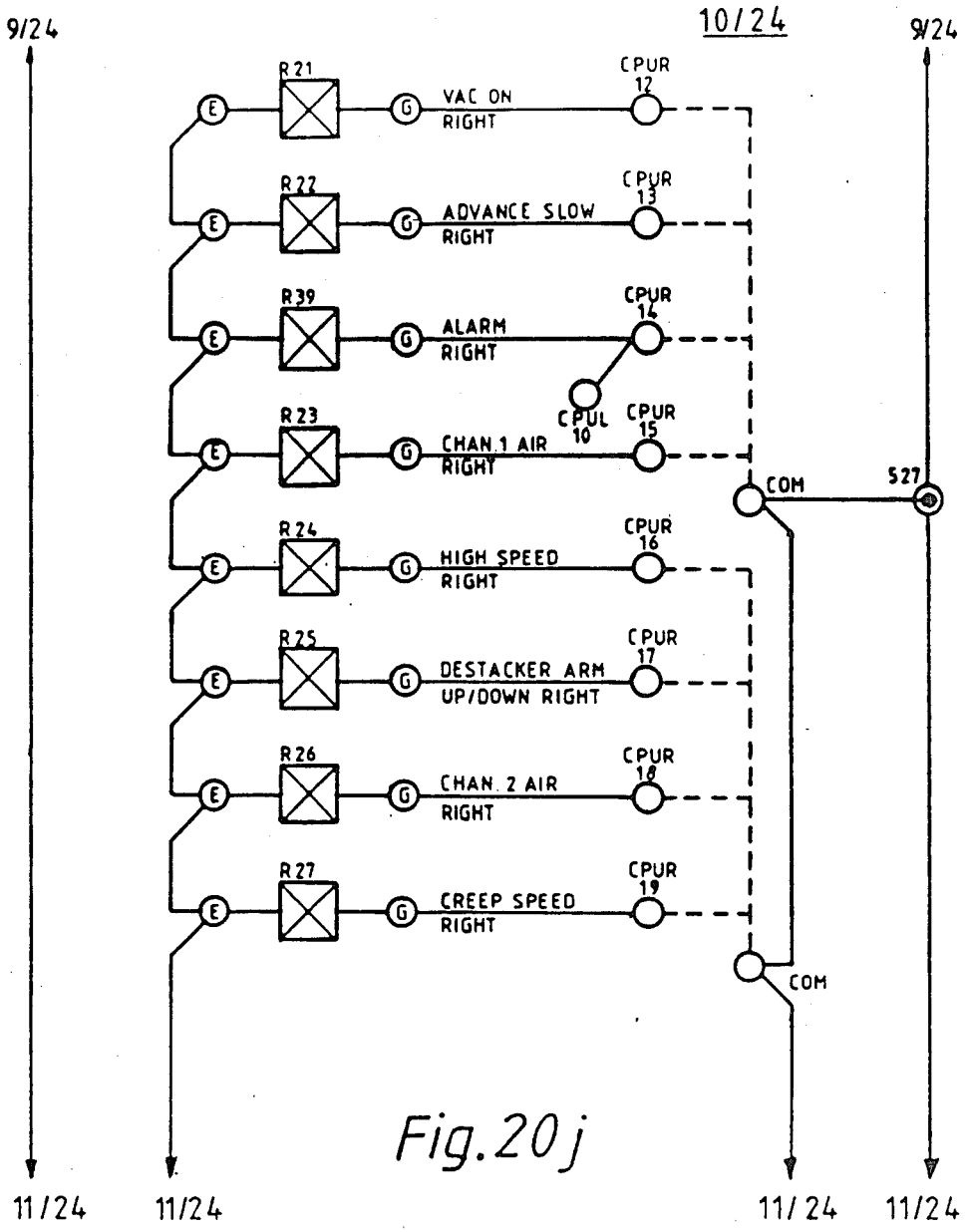
Figure 20K:
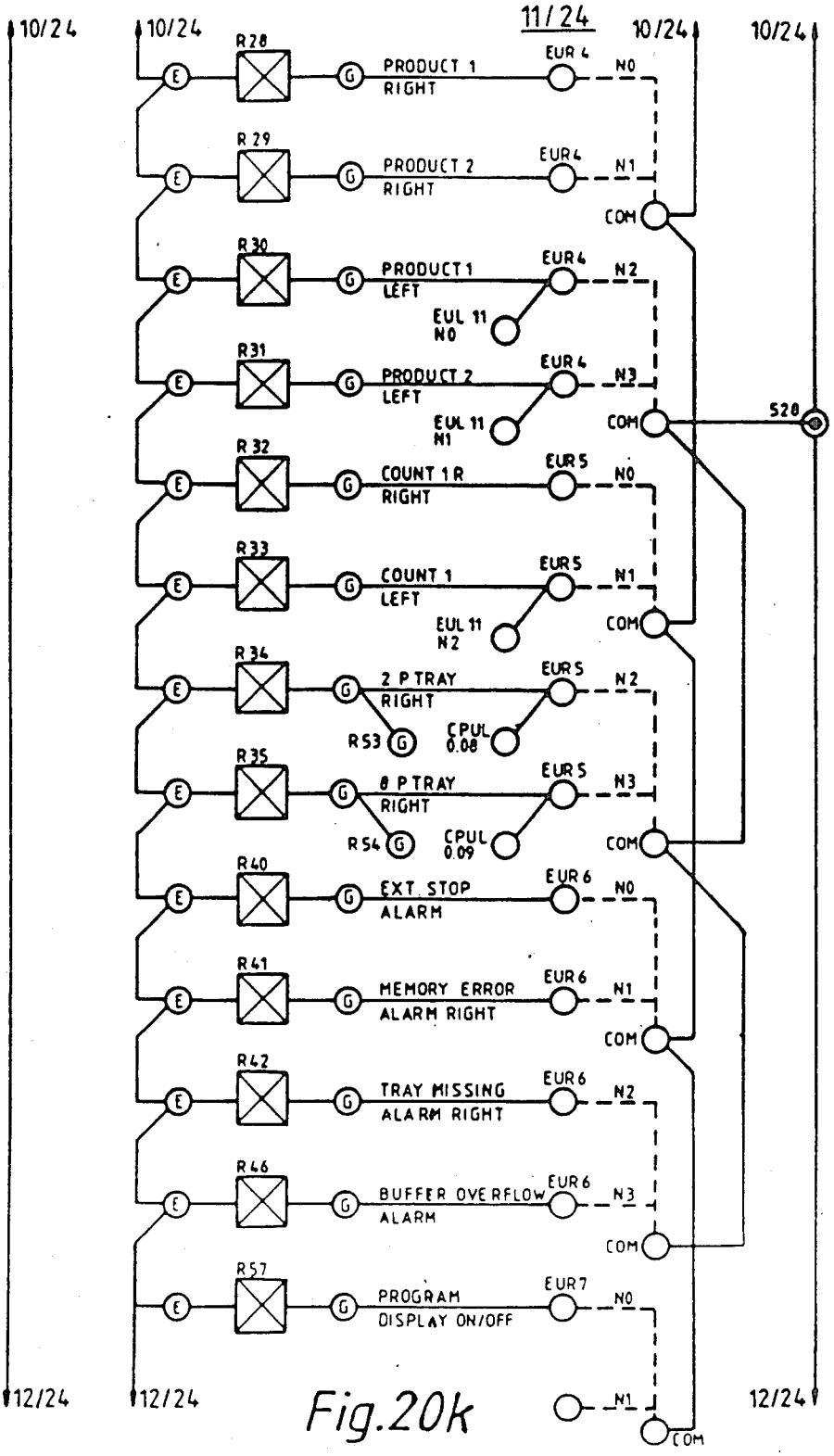
Figure 20L:
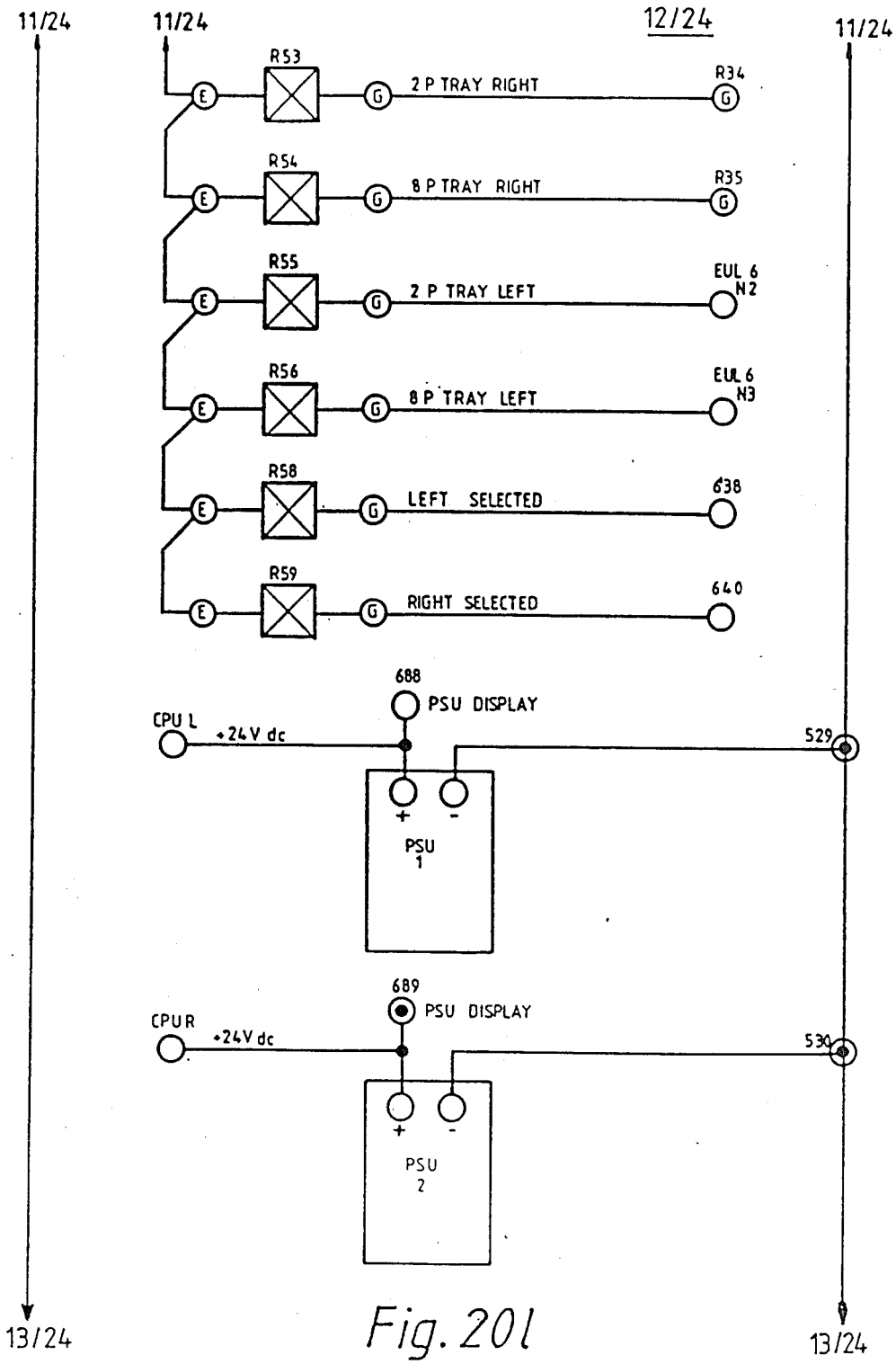
Figure 20M:
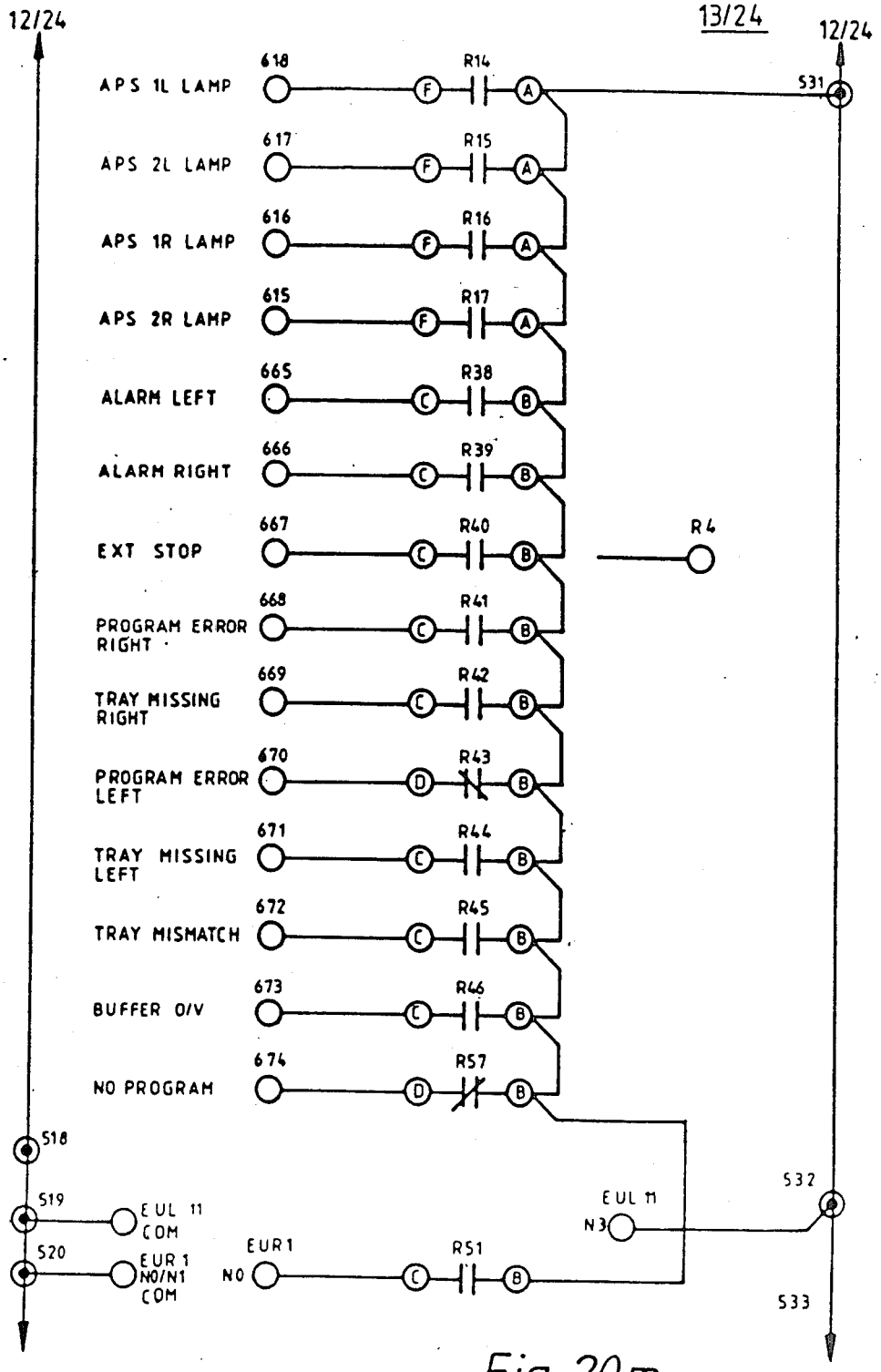
Figure 20N:
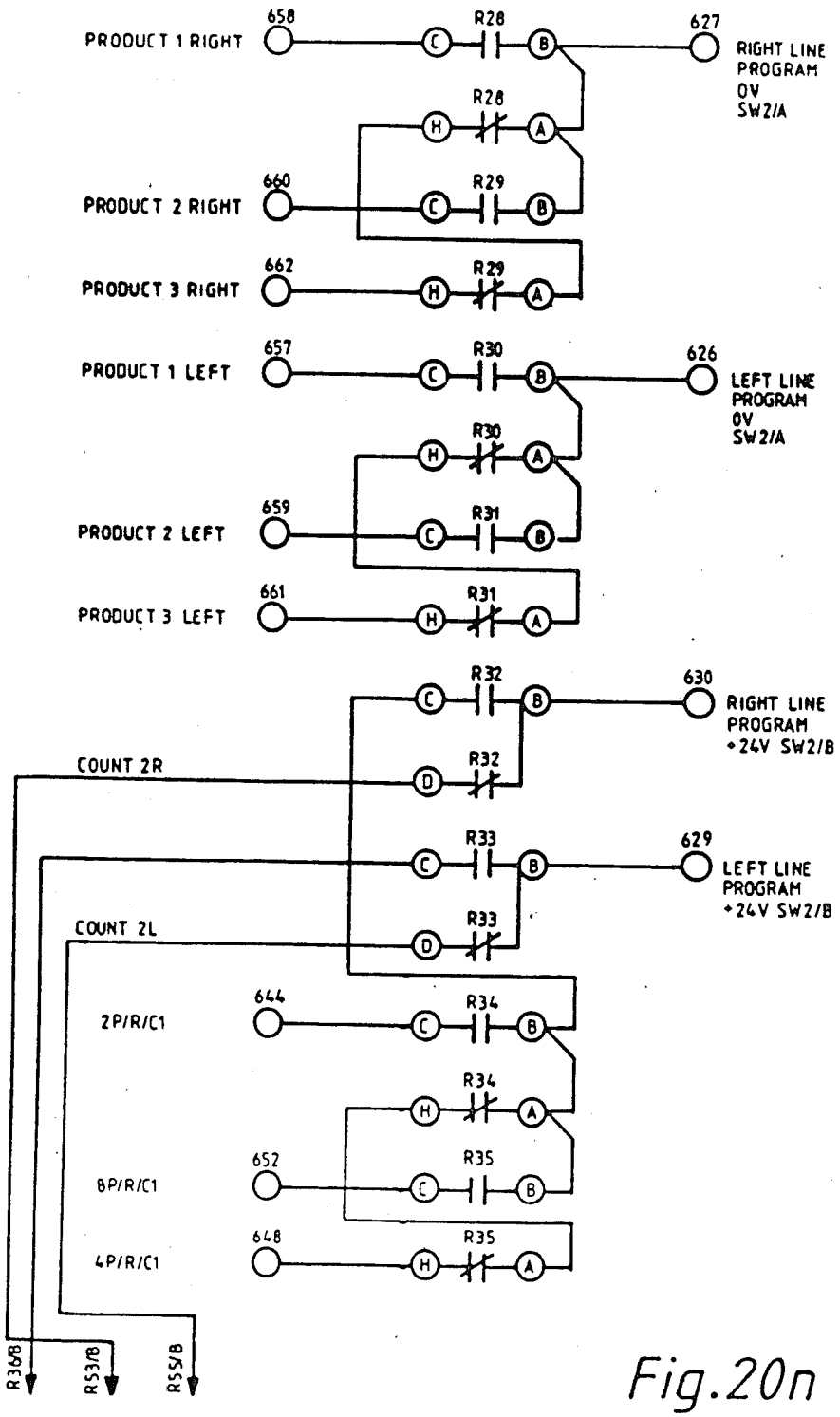
Figure 20P:
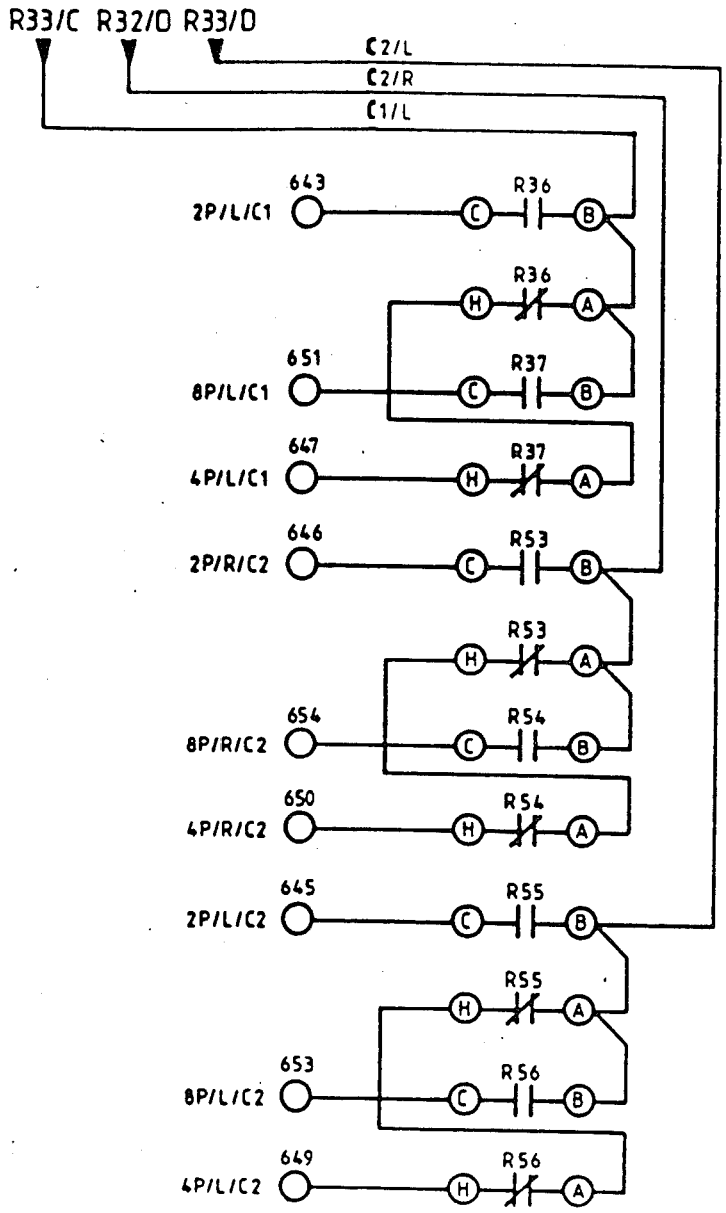
Figure 20Q:
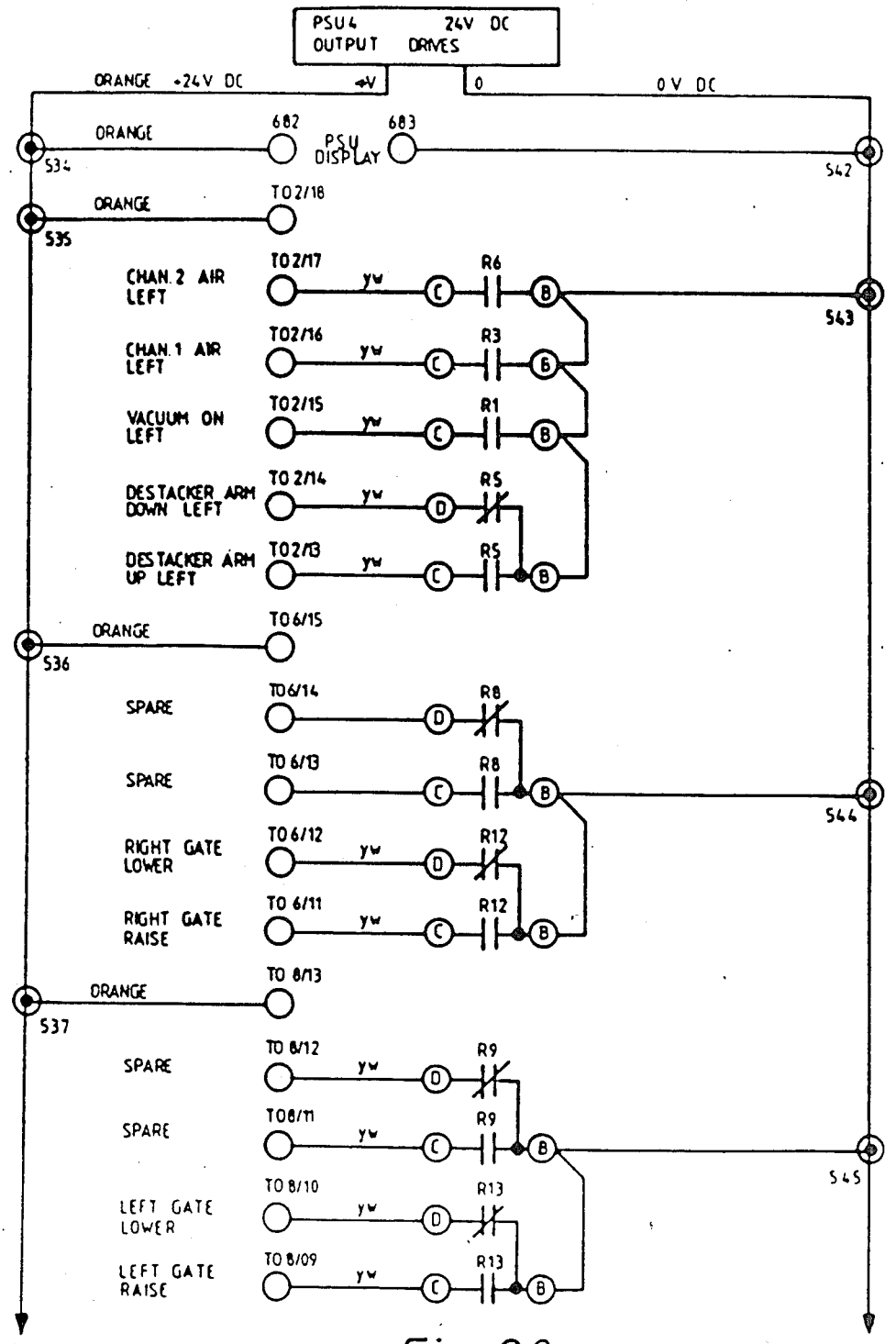
Figure 20R:
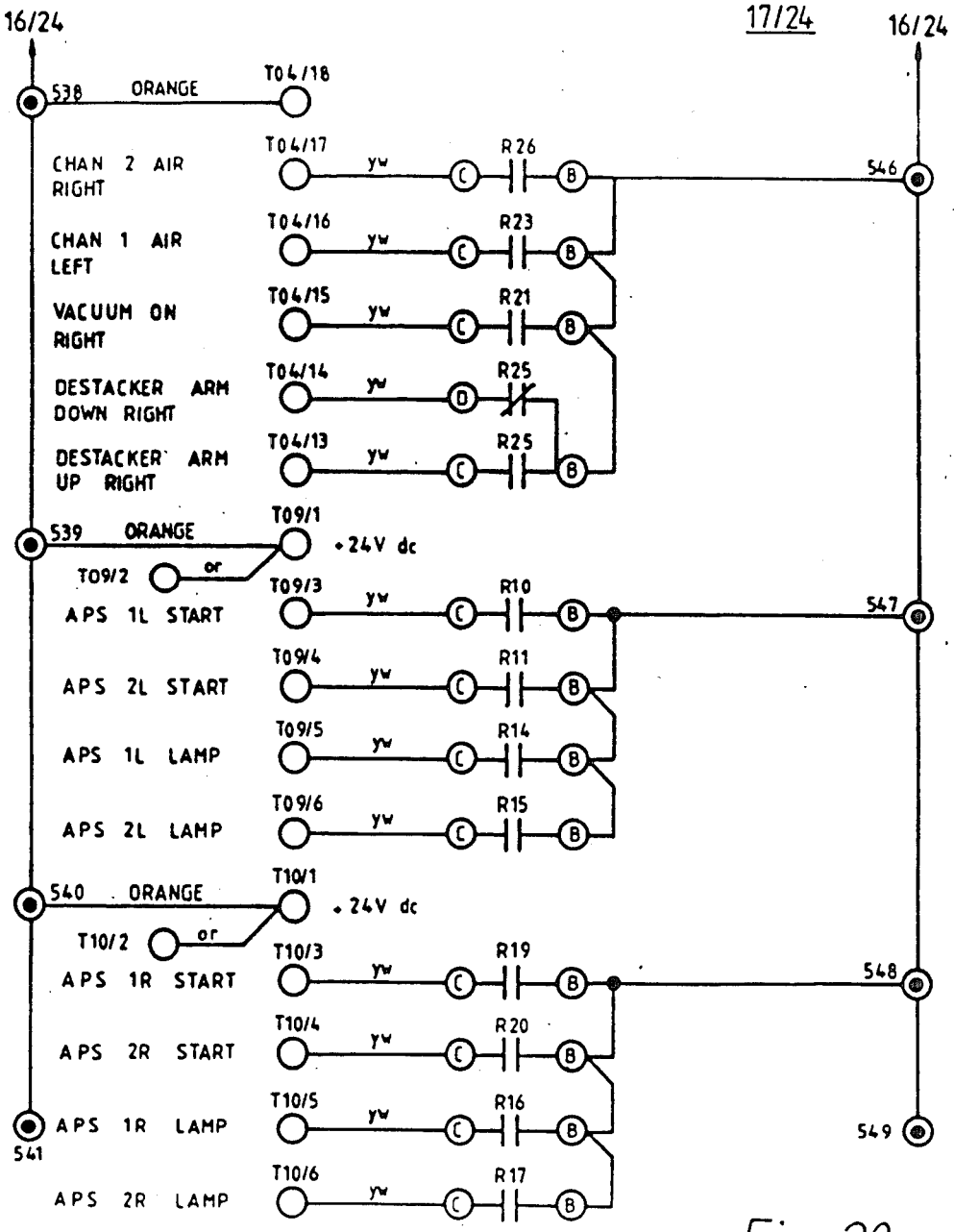
Figure 20S:
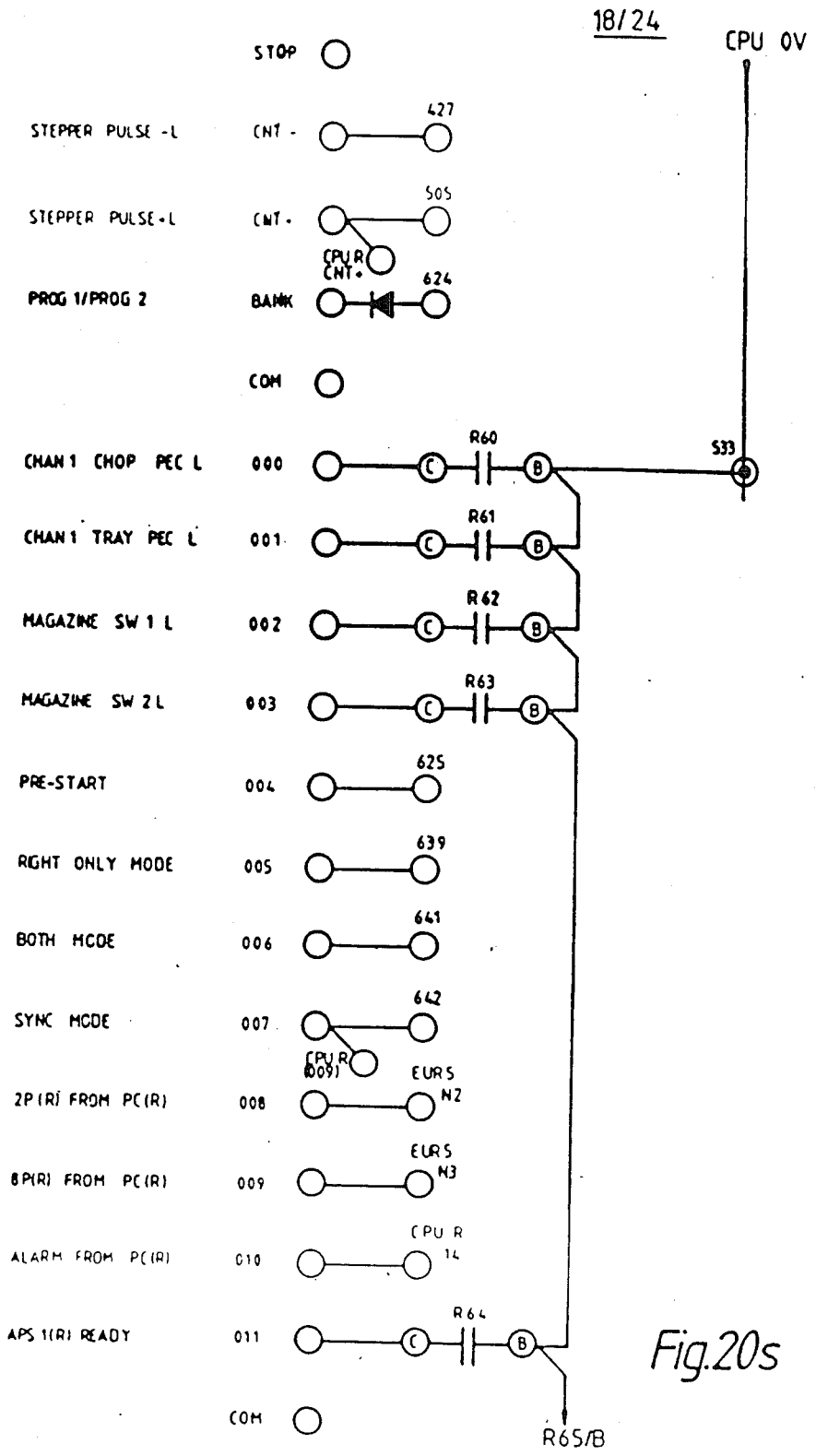
Figure 20T:
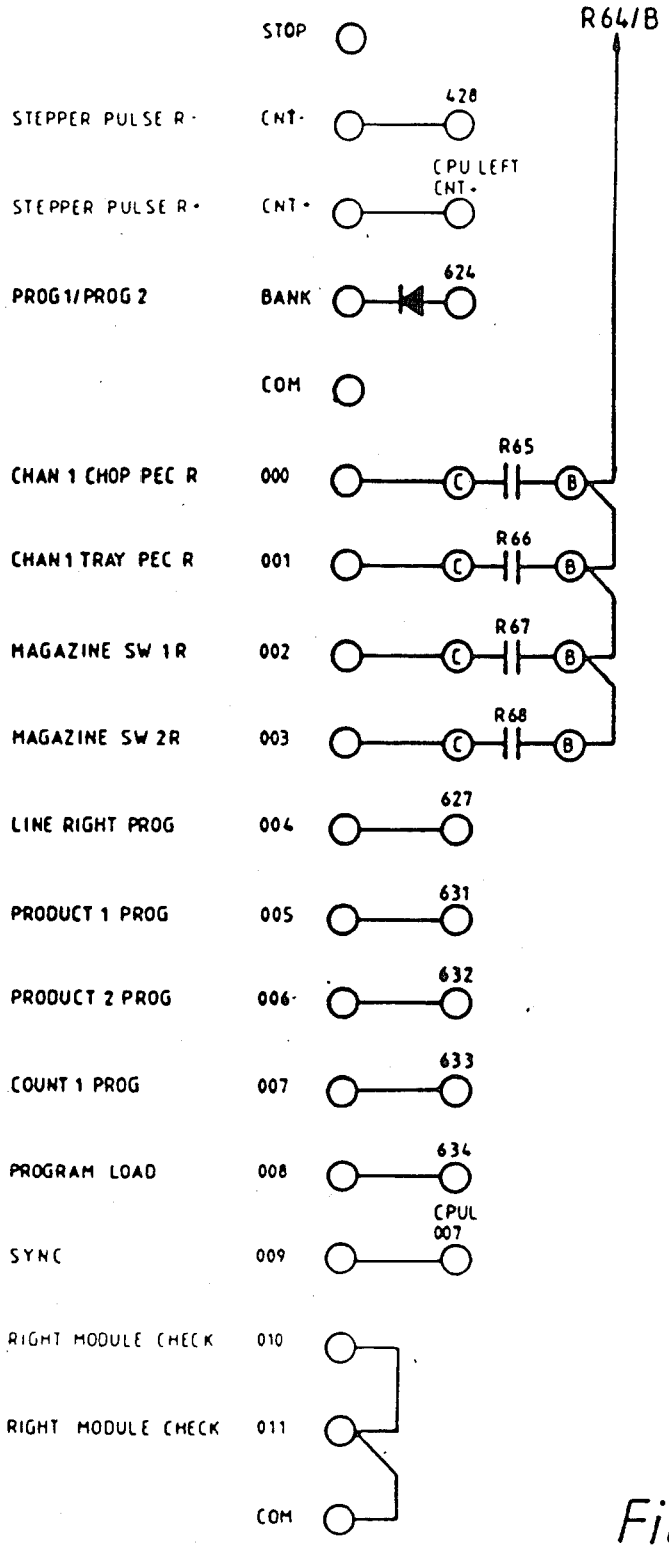
Figure 20U:
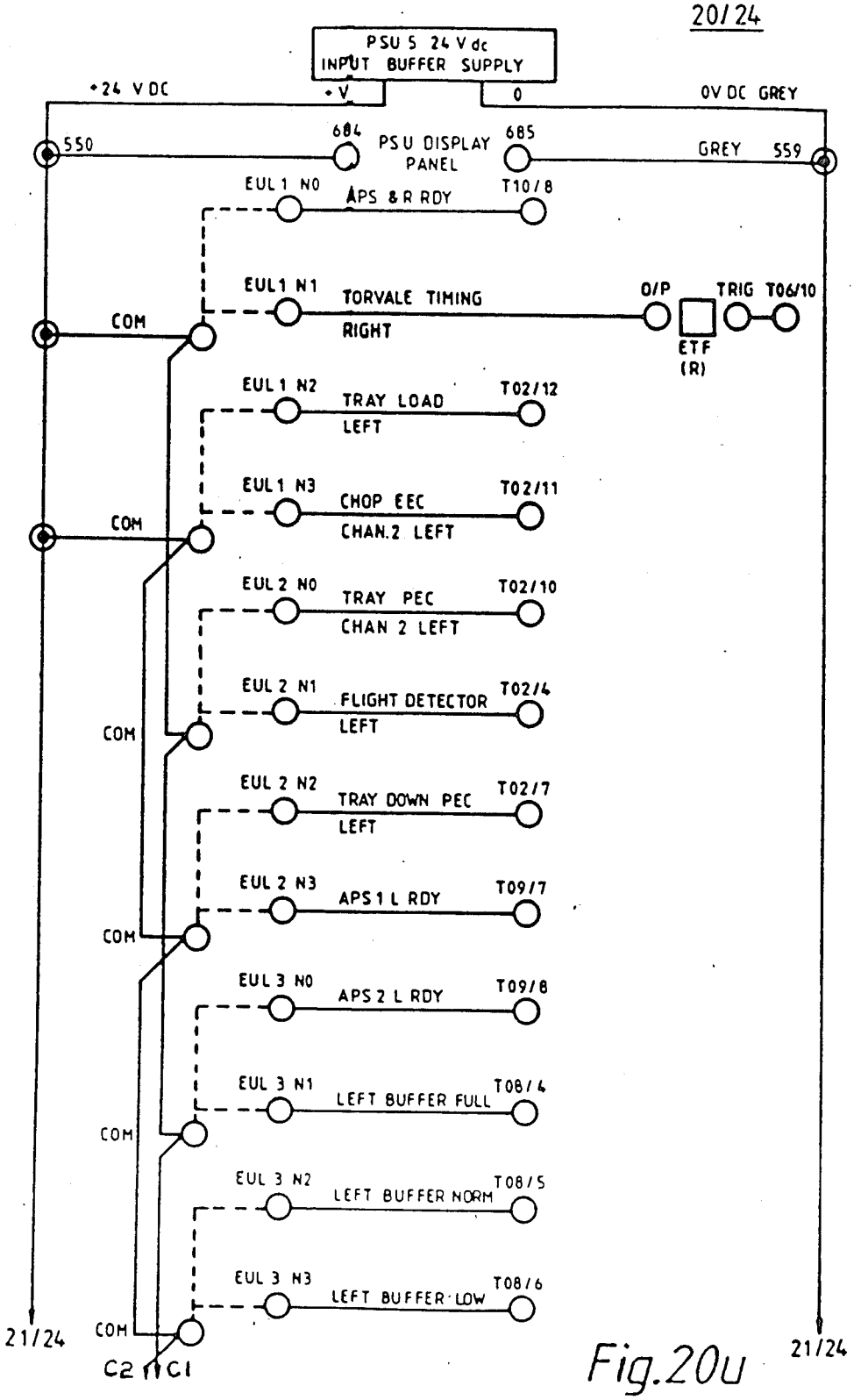
Figure 20V:
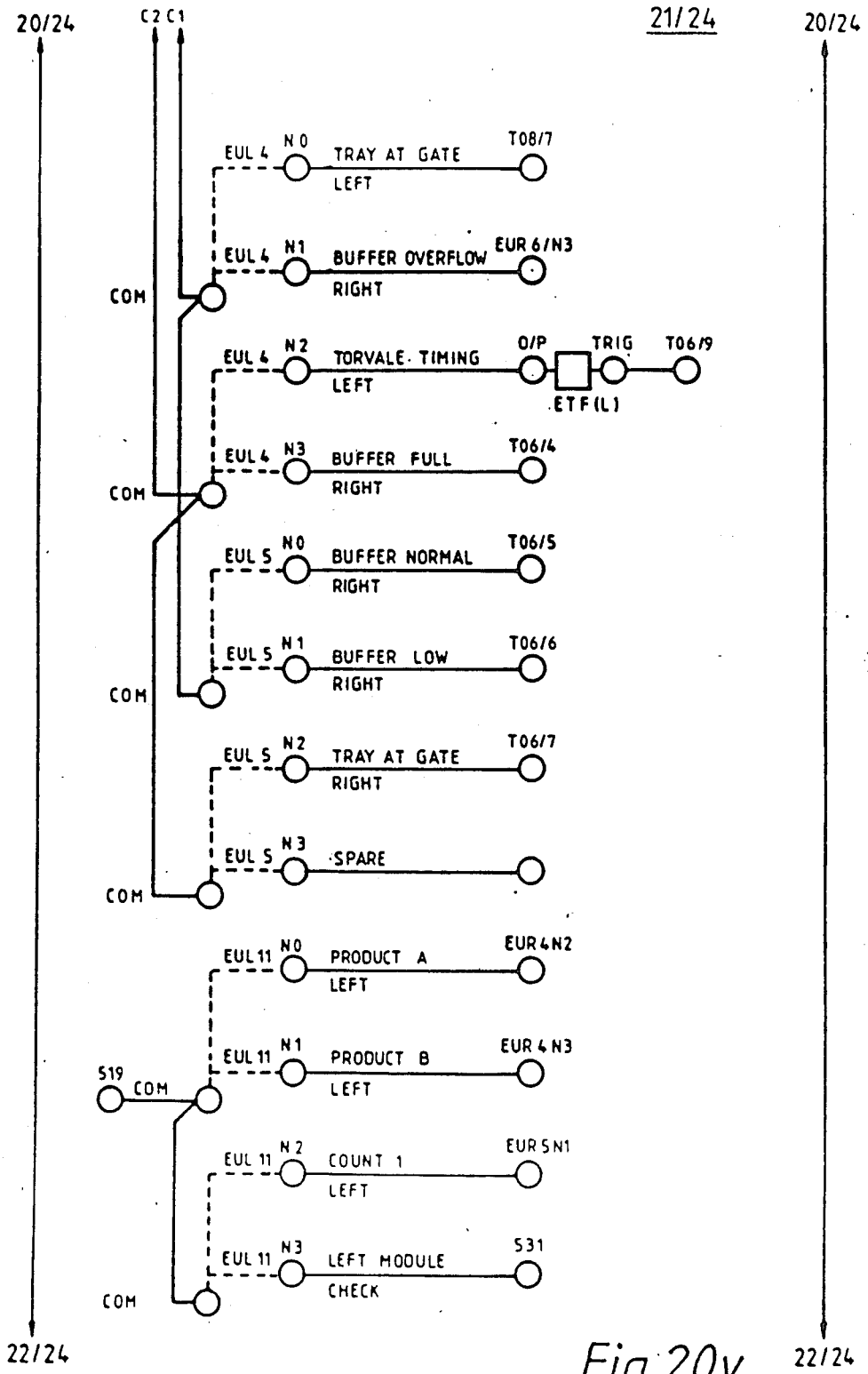
Figure 20W:
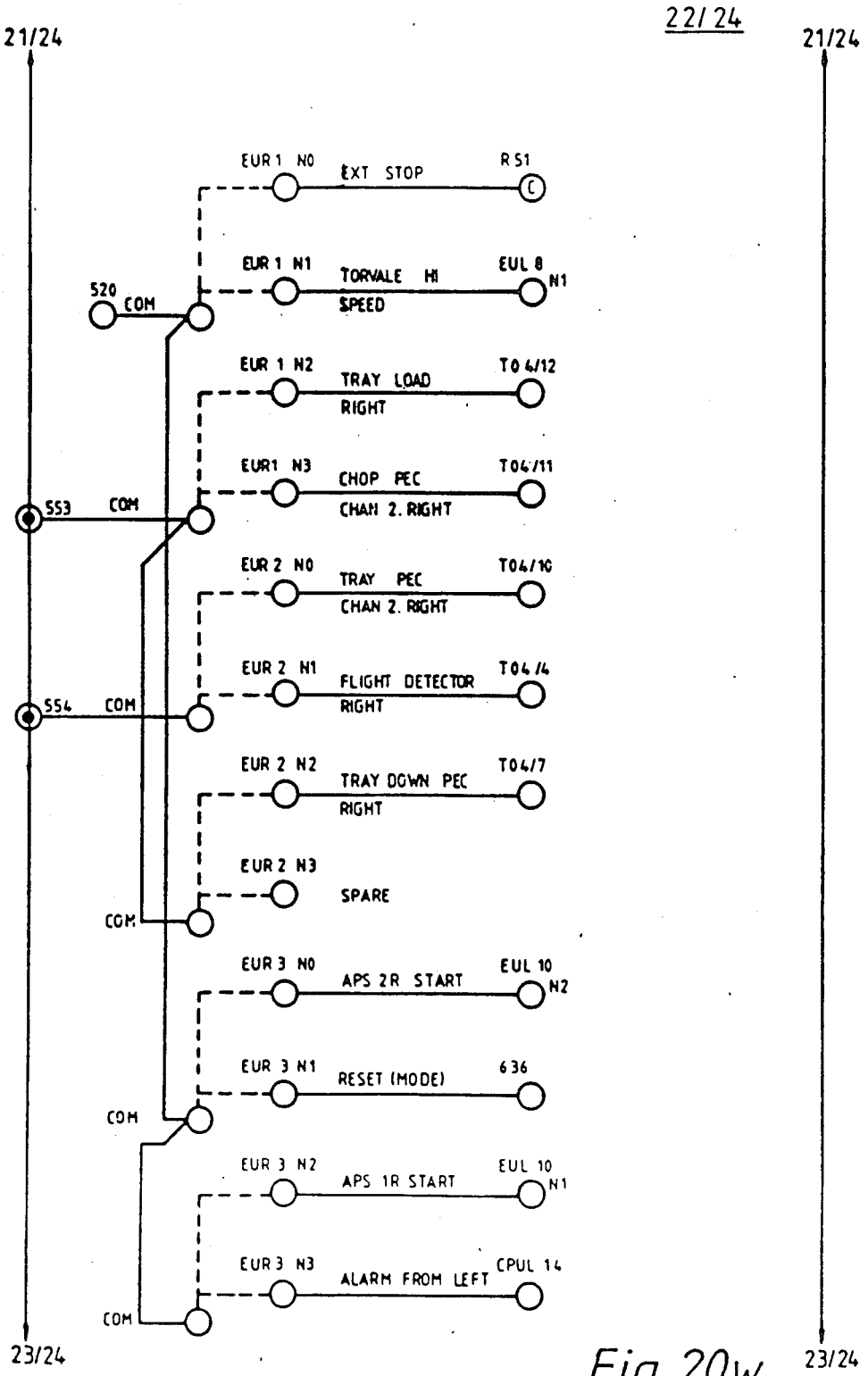
Figure 20X:
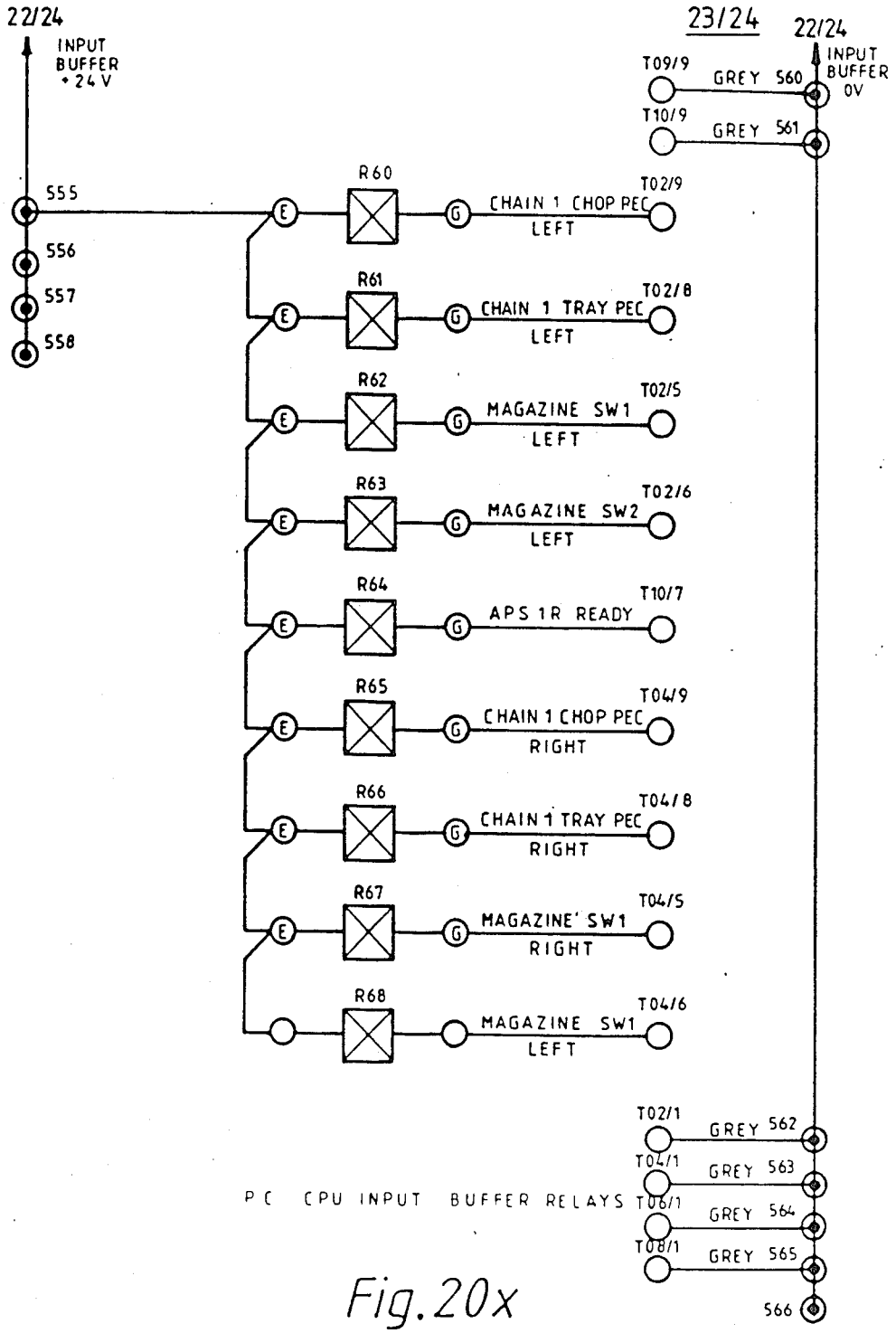
Figure 20Y:
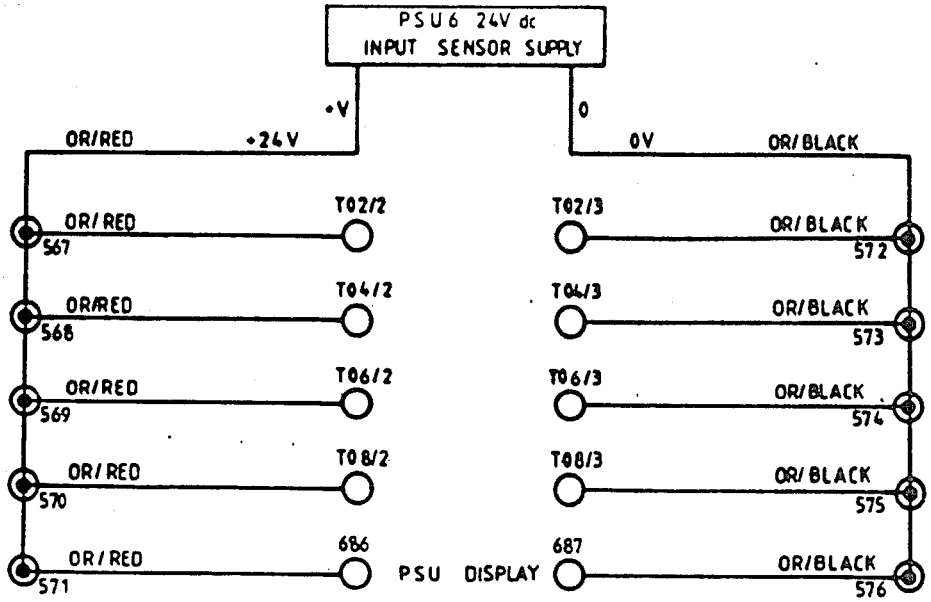
Figure 21:
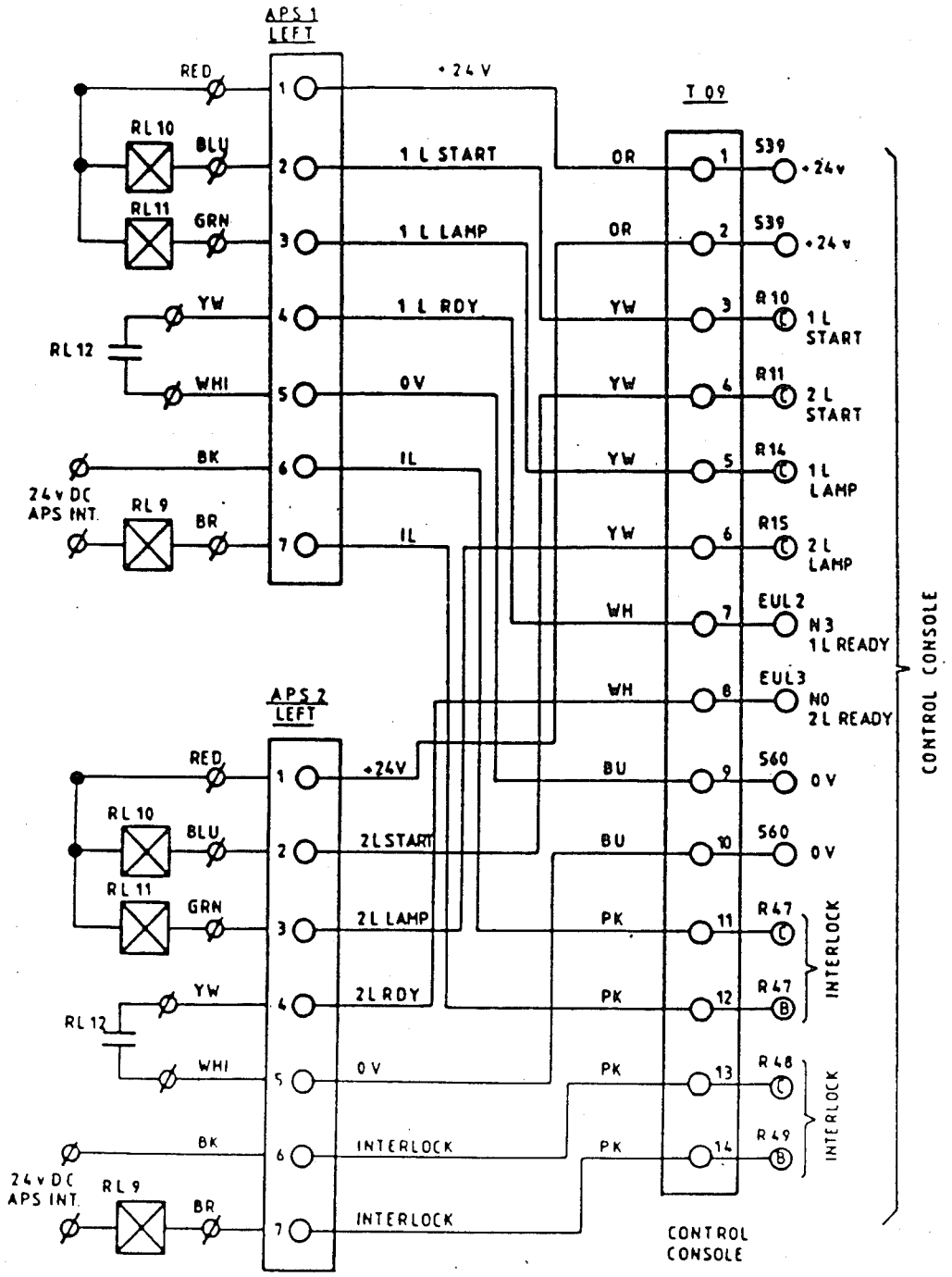
Figure 22:
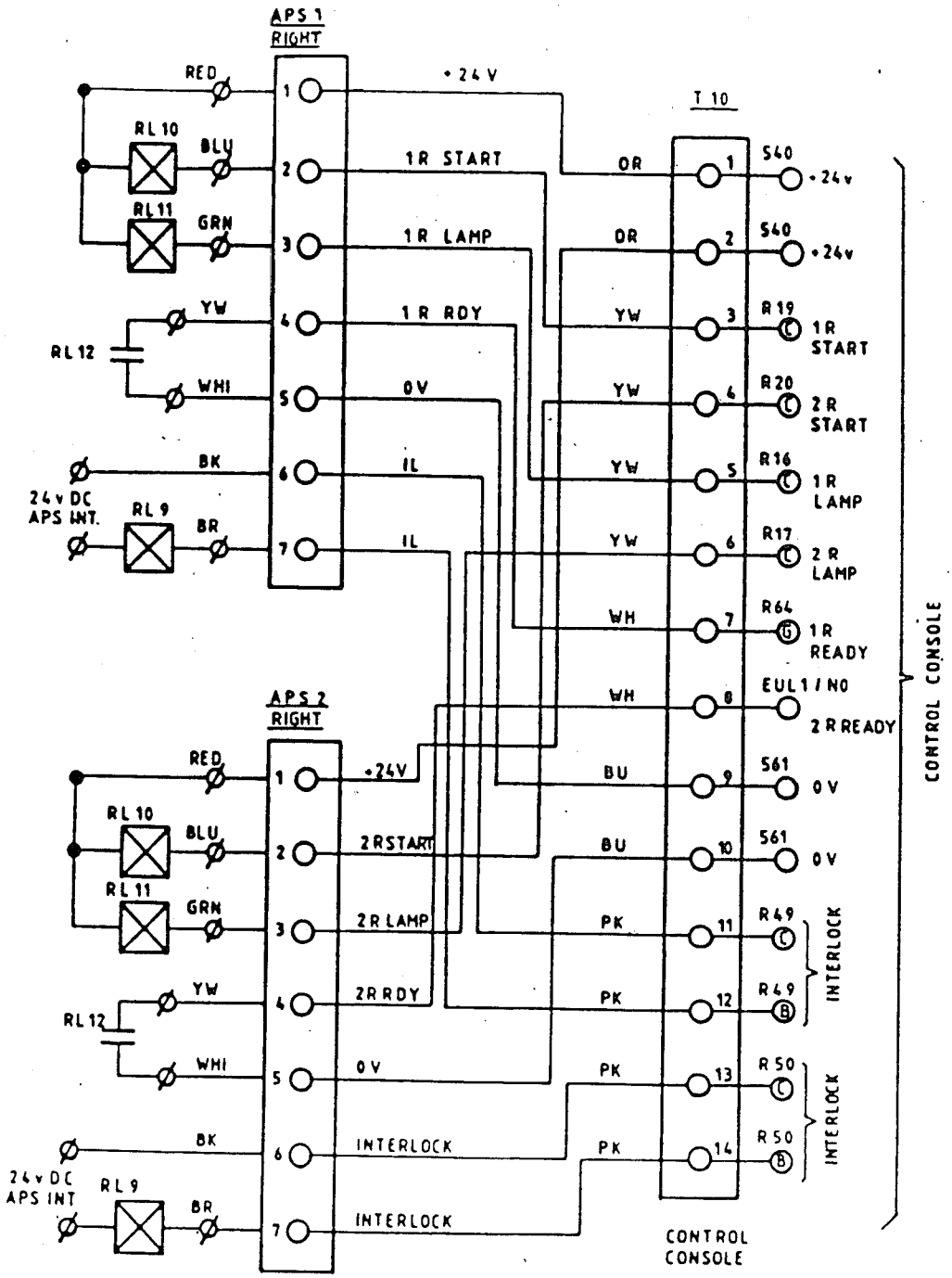
Figure 23:
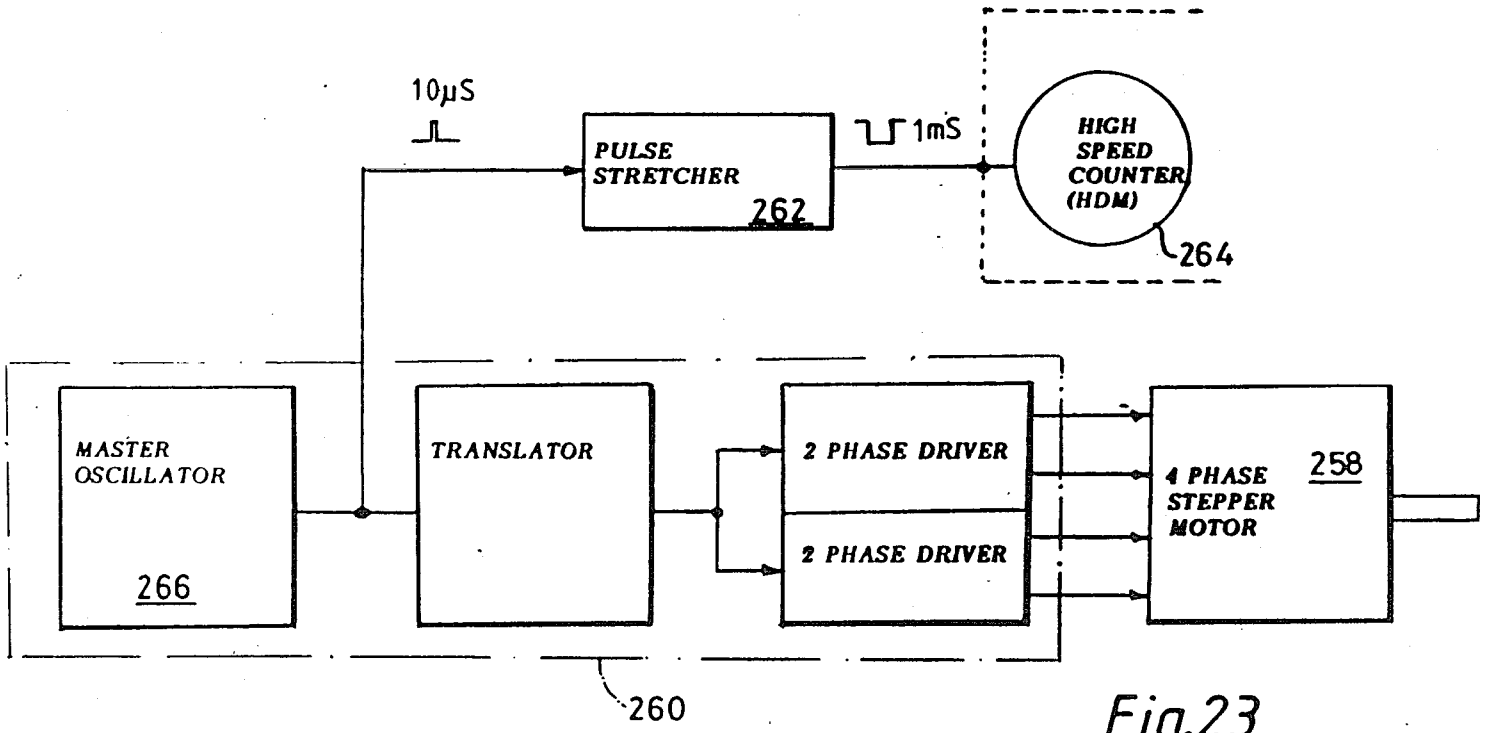

FIG. 14 illustrates the basic control panel for a control system generally moddled on that of FIG. 13, FIG. 15 illustrates the same control panel with an overlay card fitted, FIG. 16 shows the overlay card to a larger scale, FIG. 17 shows how the central control unit of FIG. 13 can be made up of two programmable control computers for delivering control signals to the left and right hand pair of chop cutting machines of FIG. 1, FIGS. 18*a*'—18*a*'', 18*b*'—18*b*'', and 18*c*'—18*c*'' are a listing of the I/O assignments for computer 252, FIGS. 19*a*'—19*a*'', 19*b*, 19*c*'—19*c*'' are a listing of the I/O assignments for computer 254, FIGS. 20*a*–20*n* and 20*p*–20*x* are a complete circuit/-wiring diagram of the control system, FIG. 21 illustrates the connections to some of the chop cutting machines controls from the computer 252, FIG. 22 illustrates the same connections to the other chop cutting machine controls from the computer 254, and FIG. 23 illustrates the essential parts of the speed control system for a stepper motor conveyor drive.

Figure 24:
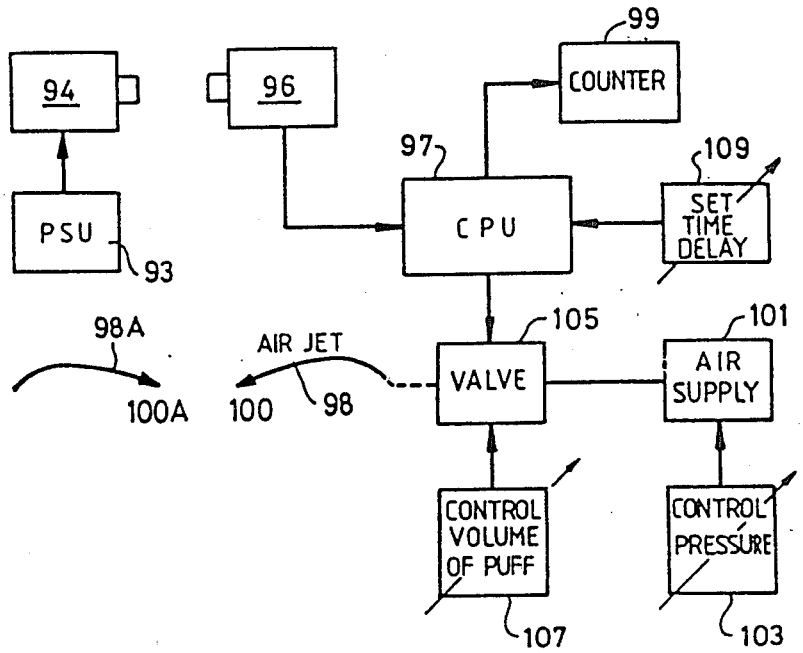

FIG. 24 is a block schematic diagram of part of a control system for controlling an airjet deflector of the invention.

DETAILED DESCRIPTION OF DRAWINGS

FIG. 1 is a plan view of the overall packaging line. The apparatus is designed to cut large pieces of meat into chops or similar slices and two band saw automatic cutting machines shown at 10 and 12. Each includes a carousel 14 and 16 respectively on which can be mounted up to 4 pieces of meat from which chops can be cut as the carousel is rotated past a band saw. The cut pieces leave the cutting station in the direction of the arrow 18 in the case of cutter 10 and 20 in the case of cutter 12.

Conveyors generally designated 22 and 24 deliver the cut pieces to two loading stations generally designated 26 and 28 respectively which will be described in greater detail in relation to later figures.

Trays are stacked at 30 and are removed one by one and positioned on a tray conveyor generally designated 32 which incrementally moves the trays through the loading stations 26 and 28 to a transfer conveyor 34 and from thence to a main delivery conveyor 36, part of which serves as a buffer conveyor at 38 the output from which is controlled by the operation of a gate 40.

Two further meat cutting machines at 42 and 44 are also shown with associated conveyors 46 and 48 for supplying a second tray conveyor 50 having trays supplied from a second stack 52 for delivering filled trays to a second buffer conveyor 54 whose output is controlled by a second gate 56. The second pair of meat cutting machines 42 and 44 are optional and simply indicate how throughput can be increased by parallel operation.

In order to accommodate output from two gates 40 and 56, a two into one conveying station 58 is provided for supplying a single line of filled trays to a wrapping apparatus 59 via a conveyor 61, which can be of conventional types known to the art.

In its simplest form, the apparatus would comprise a single cutting machine such as 10, associated conveyor 22, and related tray conveyor 32 and tray stack and delivery station 30. The second cutting machine 12 simply allows a more efficient operation in that whilst the first cutter is operating, the second cutter can be reloaded and cleaned ready to be put into action as soon as the meat in the operating machine is exhausted.

FIG. 2 is a perspective view of the apparatus in the direction of arrow A in FIG. 1. Thus the two meat cutting machines 10 and 12 can be seen in the background with their associated conveyors 22 and 24 feeding the tray conveyor which will be described in more detail later and which is supported by a framework 60 which extends transversely to the two feed conveyors 22 and 24.

An upright tray magazine is shown at 62 within which are stacked trays 64 one above the other. Each of the trays is generally square or rectangular in plan view, includes a depressed central region into which product can be laid and has a peripheral lip. The form of each tray can best be seen from FIGS. 8 and 9 to which reference will be made later.

The magazine 62 can be lifted clear from a support 66 to allow a fresh magazine to be fitted or simply for the magazine to be filled with trays.

A mechanism which will be described later removes each tray in turn from the bottom of the stack and each such tray is engaged on a conveyor having upstanding driving dogs, one of which is shown at 68 which engage the rear edges of the trays and move them in a direction from beneath the magazine 62 towards the loading stations at the delivery ends of the conveyors 24 and 22.

The path of the conveyor (not shown) containing the dogs 68, is such that the latter rise up at the right hand end of the framework 60, move across the framework 60 from right to left in FIG. 2 and descend in a downward direction at the left hand end of the framework 60 in FIG. 2. At that point the trays are delivered to a further conveyor as will be hereinafter described.

Controls, drives and power supplies (e.g., relays, air solenoid valves and terminal blocks) for the conveyors, tray magazine and for controlling the delivery of cuts from the conveyors 22 and 24 onto the tray conveyor 32 are contained within units 70, 72 and 74 respectively. This equipment receives control signals from a central controller depicted in FIG. 13 and more specifically described hereinbelow.

Delivery Station

FIG. 3 of the drawings illustrates to a larger scale the outlet end of the delivery conveyor 22 of FIGS. 1 and 2 and the interaction of this with the tray conveyor generally designated 32. This interaction forms the delivery station or loading station where cut pieces of product such as meat chops or the like are loaded into a tray.

One such cut piece is shown at 76 and in practice will be preceded and followed by other similar cut pieces all travelling towards the tray conveyor 32.

To one side of the delivery conveyor 22 is an alignment guide 78 made up of a metal leaf spring anchored at 80 and adjustable in position at its downstream end by means of a screwed rod 82 and block 84. Positioning of the leaf 78 determines the precise position of the cut pieces across the width of the delivery conveyor 22 as they approach the exit end or outlet thereof.

Where the conveyor belt 86 of the delivery conveyor 22 passes around the end roller 88, the cut pieces 76 will fall in free flight from the end of conveyor 22 onto a waiting tray, one of which is shown in dotted outline at 90.

The tray 90 is one of a number of such trays lying along the tray conveyor 32 and which are indexed in a forward direction denoted by arrow B in FIG. 3 by means of the tray conveyor drive dogs of which one is shown at 92. These are attached to an endless chain (not visible in FIG. 3) and the latter is driven in a series of incremental movements so as to shunt the line of trays past the loading station. As each tray is positioned in front of the loading station formed by the outlet of the conveyor 22, the cut pieces leave the conveyor belt 86 and after free flight land on the tray below.

Adjacent the exit of the conveyor belt 86 are located two sensors 94 and 96 with an optical link between them so that as a piece of cut product such as 76 arrives at the exit end of the conveyor belt 86 so the optical link is interrupted causing an electrical signal to be generated to serve as a control signal.

Further information is obtained when the optical link is re-established after the passage of a piece of cut material allowing a further electrical signal to be generated indicating that one piece has passed and another can now be expected.

Adjacent the exit end is located an air pipe 98 having an outlet nozzle 100 which pipe is adjustable so as to direct an airstream from the nozzle 100 toward the flight path of cut pieces such as 76 as they leave the conveyor. By appropriate adjustment of the nozzle and appropriate adjustment of the pressure and volume and duration of each air pulse leaving the nozzle, so a cut piece such as 76 leaving the conveyor 86, can be deflected and tilted simultaneously so as to land in the tray in a tilted condition instead of lying flat on the bottom of the tray. This is of great advantage where chops and similar types of meat product are involved since it allows the pieces to be layered in the pack to present the edge regions of the chops or other pieces of meat one overlying the other. A primary purpose of the airstream is to use it to apply a holding force to the cut pieces as they land on the trays. That is, the airstream is adjusted to prevent the pieces from bouncing or sliding off the trays. The angle of the airstream impinging on a piece, the pressure of the airstream, its volume and its duration are important factors which need to be adjusted or selected in achieving a specific desired holding (or tilting) result; however, specific values for these parameters are not of significance in a limiting sense because they depend on the nature of the product being delivered and the trays and can be empirically determined in a specific implementation. For example, with a type of boneless pork chop the airstream may be continuously run to hold each chop as it is loaded; whereas with a heavier chop retaining its bone, the air-stream may be turned on once an empty tray has been placed at the end of a delivery conveyor and turned off after the second chop has been loaded because the remaining chops will retain their positions without the airstream. Whatever actual control is to be implemented, it is implemented through the central control unit subsequently described in response to signals such as from the sensors 94, 96 and a tray sensor subsequently described.

Opposite the delivery end of the conveyor belt 86 are located two spring fingers 102 and 104 which are mounted on pivot blocks 106, 108 and are sprung in a direction so as to cause the fingers to protrude into the path of the trays.

The springing is very light and as each tray is pushed into the position aligned with the end of the conveyor belt 86, so the two fingers 102 and 104 are pushed out of the way by the side wall of the tray. However, there is just sufficient friction between the fingers and the tray edge to restrain the tray so that the latter is prevented from overshooting as it is pushed in a series of incremental steps past the delivery end of the conveyor belt 86 by the movement of a dog 92.

In addition to the fingers 102 and 104, a tray sensor 110 is located immediately below the path of the trays which is itself engaged by the underside of each tray as the latter is moved into position. Control signals from the sensor are used to instigate the operation of the cutting machine and delivery conveyor drive.

In this connection the signals from the sensor link 94, 96 serve to indicate that cut pieces have now arrived at the delivery end of the conveyor 22 and each piece can be counted as it passes between 94 and 96. Overall control of the apparatus is achieved by means of a microcomputer controlled device having a memory into which information is stored concerning inter alia a number of pieces to be laid in each tray and the distance through which tray must be indexed after it has arrived at the loading station so as to accommodate the desired number of cut pieces in a particular configuration within the tray. This control device of the preferred embodiment is more specifically described hereinbelow with reference to FIGS. 13–20. The signal from the sensor 110 thus inititates the process, the signal from the sensor link 94, 96 dictates the number of pieces which are laid in the tray and in the event that no tray supplants the first after the latter has been moved out of the delivery station region, the appropriate signal from the sensor 110 temporarily halts the cutting and delivery of further pieces until the fault has been remedied.

The timing of the jet of air from the nozzle 100 is achieved using as a trigger the signal from the link 94, 96.

As is best seen from FIGS. 3 and 4, the sides of the tray conveyor are made up of pairs of upper and lower guide rails 112 and 114 on one side and 116 and 118 on the other side.

The conveyor bed is stationary and is formed from a pair of elongate plates 120 and 122 separated by a groove 124 through which the dogs 92 extend and along which they can pass.

Tray magazine

The tray magazine 62 as shown in FIG. 2, is shown in greater detail in FIGS. 4, 5, and 6.

Referring particularly to FIG. 5, the magazine is constructed from a number of upright rods some of which are denoted by reference numeral 126 in FIG. 5, forming a cage and bounded at the top and bottom and midway by means of bands 128, 130 and 132 respectively.

The lower band includes pairs of fixing knobs such as 134 and 136 (see FIG. 6) on opposite sides by which the magazine can be secured to two upright flanges 138 and 140 secured to and extending from the support 60.

Two tray support rods 156, 158 extend across the underside of the band 132 on which the lips of the lowermost tray rest and the precise spacing between the rods is adjusted by means of cams 141 and 142 acting on pivoted levers 144, 146. Alternative means could be used, such as lateral bolts which can be manually threaded in or out to adjust spacing between the rods.

Relative outward movement of the rods reduces the amount of overlap between the tray and the rods thereby making it easier to remove the lowermost tray whilst decreasing the spacing, increases the resistance to movement of the lowermost tray and removal thereof.

Actual removal of a tray from the lowest position in the stack is achieved by means of 4 suction cups of which 2 are visible in FIG. 5 and are designated 148 and 150. The suction cups are formed at the upper ends of 4 piston rods of which two are shown at 152 and 154 in FIG. 6. Upward displacement of the rods 152, 154 etc raises the suction cups 148, 150 etc into contact with the underside of the lowermost tray as shown in dotted outline in FIG. 6. Subsequent withdrawal of the piston rods causes the tray impaled on the 4 suction cups to be dragged in a downward direction and by virtue of the deformability of the material forming the tray, the latter can be pulled downwardly past the rods 156, 158.

FIG. 6 shows by way of dotted outline the lowermost tray 160 in the stack of trays contained in the magazine and in solid outline below the last tray to have been removed at 162.

Also visible in FIG. 6 are the two pairs of guide rails 112 and 114 and 116 and 118. Adjustment of the relative spacing between the two pairs of guide rails can be effected by adjusting knob 164. Rotation so as to move the knob to the right in FIG. 6 displaces the rails 116 and 118 in one direction whilst rotating the knob in the opposite sense produces reverse movement of the arm bearing the rails 116, 118.

Similar adjusters are provided at 166 and 168 (see FIG. 5) and by appropriate adjustment so the rails 116 and 118 can be twisted from the position shown in FIG. 6 where the tray will just rest on the upper rails 116 and 112, to the reverse of that shown in FIG. 6 in which the tray can slip between the two upper rails and rest on the two lower rails 114 and 118 and be held captive in an upward sense by means of the two upper rails 116 and 112.

The transition from the position shown in FIG. 6 to the position shown in FIG. 6 to the position in which the rim of the tray is held captive between the pairs of rails on opposite sides of the track of the tray conveyor is effected as the tray is moved from below the stack in the magazine 62 towards the loading station.

Replacement of the magazine 62 with a freshly stacked magazine or simply to facilitate servicing or removal of jammed trays, is simply effected by undoing knobs 134 and 136 and lifting the magazine bodily away from the side cheeks 138 and 140 (see FIG. 6).

Tray Conveyor

FIGS. 7A and 7B illustrate the tray conveyor and also visible is the transfer conveyor onto which the filled tray is passed.

The tray conveyor is an endless chain 170 on which are mounted the driving dogs such as 92. The chain passes around idlers such 172 and driven wheels 174.

The drive for the chain is derived from a stepper motor (not shown) which will accurately index the chain through predetermined distances in response to an appropriate number of electrical pulses supplied to the motor.

In this way the trays can be indexed along the path of the tray conveyor by controlled distances so as to accurately position the trays relative to the discharge conveyor such as 22 and once in position can also be indexed accurately to receive different pieces of the cut product such as 76 at predetermined positions along the length of each tray thereby ensuring that the product is evenly distributed along the length of the tray and can be shingled, that is made to overlay one piece on another, preferably with edge regions shown uniformly.

Beyond the tray conveyor is located a transfer conveyor best seen in FIG. 7B. This is made up of a number of endless belts of which one is designated 176. There are 6 belts in all arranged in two groups of three on opposite sides of the central chain 170 of the tray conveyor.

Rollers such as 178 and 180 are provided at opposite ends of the transfer conveyor path and a constant speed drive (shown in FIG. 7A) at 182 drives the endless belts such as 176. Idlers 184 and 186 take up the slack and provide for the change of direction of the belts.

As shown in FIGS. 7A and 7B in dotted outline, a tray 90 will be pushed by the driving dogs 92 off the platform of the tray conveyor onto the endless belts such as 176 which since they are moving in the direction of the arrow C in FIG. 7A, will cause the tray 90 to be transferred to the left in FIG. 7A.

A take-off conveyor 36 (see FIG. 1) picks up the trays from the transfer conveyor 34 and conveys the now filled trays towards a buffer conveyor 38 and the remainder of the wrapping apparatus.

Take-off Conveyor

The take-off or main conveyor is shown in part in FIG. 10.

Positioned over the surface of the moving section of the conveyor (188) are located two rials 190 and 192 which are adjustable in position by slackening off the knobs 194 and 196 and sliding the arms 198 and 200 through the blocks 202 and 214 respectively to the desired positions. The knobs 194 and 196 can then be retightened.

The main or take-off conveyor serves to convey the filled trays to a buffer conveyor which is made up of a series of rotatable but non-driven rollers on which the trays will queue and shunt towards the outlet as more trays are added from the take-off conveyor 188.

Buffer Conveyor

This item 38 is shown in FIGS. 11 and 12. The filled trays arrive from the main conveyor 36 and are eventually halted in their forward movement over the bed of freely rotatable rollers 206 by means of a gate 208 which is raisable by means of a pneumatic ram 210.

Operation of the gate is controlled by means of the central control system for the overall apparatus and the gate serves to release trays from the buffer in response to the signals from the central control.

The latter is fed with signals from various sensors which are shown at 212, 214, 216 and 218. The signals from the various sensors indicate the arrival of a tray at the gate (sensor 212), the arrival of a sensor just in advance of the gate (sensor 214) and where signals are simultaneously received from sensors 216 and 218, the fact that numerous trays are now backing up on the buffer conveyor indicating that the supply of trays to the buffer conveyor is exceeding the rate at which they are being released by the gate.

Beyond the gate 208 are located driven rollers 220 and a further transfer conveyor similar to the transfer conveyor 34 is provided beyond the driven rollers at 222.

System operation

FIG. 13 shows the control system for part of the apparatus of FIGS. 1 to 12. The heart of the system is a central, processor controlled, control unit 224 the operation of which will become evident from the following description.

On pressing ON-push button 226 CPU 224 sends a signal to a tray de-stacker 228 to remove a tray from the stack 64 (FIG. 2) and initiate operation of tray conveyor drive 230. Passage of a tray past the decoder 232 produces a control signal for CPU 224 to indicate the size of the tray in use and using a look-up table or other device the CPU 224 generates appropriate control signals for the tray conveyor drive to enable the correct step size movement to be achieved as each tray passes through the delivery station 26.

At the same time the cutter drive 234 and delivery conveyor drive 236 are energised and pieces of cut product are delivered to the input end of the delivery conveyor 22. If for any reason product fails to leave the exit end of the conveyor 22, the back-up of product on the conveyor 22 is sensed by a product sensor 238 causing CPU 224 to temporarily arrest drives 234 and 236.

Assuming delivery conveyor 22 is functioning correctly, cut pieces pass between 94, 96 and electrical pulses are supplied to the CPU 224 to indicate the arrival and passage of cut product pieces to the waiting tray. To this end a power supply 240 supplies current for the light source 94.

A counter 242 (which may form part of the CPU 224) accumulates electrical pulses corresponding to the passage of cut product pieces and provides an overflow signal after preset numbers of pieces have been counted—the counter being reset after each preset number has been counted.

CPU 224 is arranged to produce a small increment of travel of the tray at the delivery station for each pulse counted until the overflow signal is generated, whereupon the tray conveyor drive 230 is caused to operate at a higher speed and/or for a longer period of time, so as to shift the tray well clear of the delivery station 26 and replace it with another empty tray.

If at any time the apparatus must be stopped, the push button switch 244 can be pressed, to supply a further signal to the CPU 224, which in response thereto is arranged to halt all drives immediately.

CPU 224 also provides control signals at the correct point in time to a valve 246 for releasing air from a reservoir or pump 248 to the air nozzle 98 (see FIG. 3).

General

Where a second delivery conveyor such as 24 is provided adjacent the same tray conveyor, a second tray sensor similar to sensor 110 is provided within the tray conveyor opposite the end of the other discharge conveyor and control signals for the tray conveyor from the central control unit take account of the fact that trays are being filled at both locations and the control signals for the tray conveyor are arranged to accelerate the latter in the event that a tray has been filled by a first discharge conveyor 24 through the second loading station from the discharge conveyor 22 so that the latter makes no attempt to discharge cut pieces onto a filled tray but is always presented with an empty tray.

Where a second line is provided also fed from one or two cutting machines and discharge conveyors such as 42, 44, 46 and 48 as described with reference to FIG. 1, it is merely necessary to ensure that the outputs from the two buffer conveyors 38 and 54 are themselves synchronised and phased so that the output from one line is mixed with the output from the other line to provide a single line of filled trays ready for wrapping.

Further details of the air deflection nozzle and controls therefor are contained in my copending application filed concurrently herewith and entitled Improvements in and relating to article handling apparatus (ref C190/W).

A more complete description of the control system for the apparatus of FIGS. 1 to 12 now follows with reference to FIGS. 14–23. The system allows up to four chop cutting machines to be operated in any desired mode—i.e., singly or in pairs. Each chop cutting machine is an APS 200 machine as manufactured by AEW Engineering Co Limited of Norwich, England and each is referred to as an APS. Since there are two pairs of such machines arranged in left and right hand lines, the two machines in each line are denoted APS1L, APS2L, and APS1R and APS2R respectively. Thus item 12 in FIG. 1 is APS1L.

FIGS. 14–16 illustrate the control panel of this more complete system—FIG. 16 showing one of a number of overlay cards which can be selected and fitted thereto depending on the mode of operation desired. The card fits over an array of light emitting diodes 250, which can be seen in FIG. 14.

General Description of Preferred Embodiment System and Operation

The control system is used to control the slicing, tray loading and converging of the two lines of trays.

The control system uses two I.M.O. SYSMAC S6 programmable control computers 252, 254 to define the central control unit 224 as depicted in FIG. 17. Each computer controls one tray conveyor, left and right, independently. Additionally both computers drive different sections of the overall control system. For the system to operate correctly BOTH computers must be operational. These computers are responsive to inputs entered through the control panel illustrated in FIGS. 14–16.

The master software for each computer is contained in a programmable read-only memory (PROM) module. TABLE A contains a listing of the program for the computer 252, and TABLE B contains a listing of the program for the computer 254. The modules plug directly into a receptacle on the central processing unit (CPU) of each controller. Each memory module contains two full programs either of which can be selected by the PLC switch 256 on the control panel.

P1=PROGRAM 1

P2=PROGRAM 2

It is essential that only PROM modules containing the correct sofware are plugged into the appropriate CPU. Each PROM is marked with CPU-L or CPU-R. If the wrong PROM is in a CPU the system will not function and the PROGRAM ERROR lamp will light on the ALARM Panel.

CONTROL PANEL

The control panel shown in FIGS. 14–16 is divided into logical sections which will now be described:

MIMIC DIAGRAMS

The mimic diagram shows a diagrammatic representation of the system. Indicator lamps (red) show the status of the 13 emergency stop buttons around the equipment. If an emergency stop button is operated, the whole system will shut down and the appropriate red indicator will light on the panel showing which button has been operated. The system cannot be restarted until the emergency stop button has been released and the corresponding indicator lamp extinguished.

Also on the mimic diagram each APS Slicer has an amber status indicator. These enable the operator to see the status of each machine dependent upon the state of the indicator.

| STATUS INDICATOR | APS STATUS |
|---|---|
| OFF | OFF or loading |
| FLASHING | Standby |
| CONTINUOUS | Slicing |

Additionally these status indicators flash alternately—left pair—right pair for a period of time after pressing the system start button, before conveyors start.

These status indicators on the mimic panel correspond to the red status lamps mounted on top of each APS slicer.

ALARM DISPLAY

In the centre of the panel is the alarm display section. This provides both visual and audible indication of alarm conditions.

SYSTEM PROGRAMMING

The right hand end of the panel is dedicated to SYSTEM PROGRAMMING and enables any of 18 chop/-tray/product combinations to be selected from preset values within each program of a PROM module. Since each PROM module contains two complete programs a total of 36 chop/tray/product combinations is selectable from the panel without changing the prom module.

The program display accepts special overlay cards which refer to a particular program within a particular prom. The indicators which shine through the overlay give visual confirmation that the correct program has been selected.

Also in system programming section are the MODE selection switches.

| | |
|---|---|
| RESET | stops the line and clears out the program registers. |
| L | left line only operative |
| R | right line only operative |
| B | both lines operative independently |
| S | both lines operative in synchronism |

OPERATION

To start both disconnect switches on the doors of the power console are turned on, the main STOP button is released by turning the key, and the POWER ON button is pressed. The red MAINS ON indicator on the control panel will light.

Select the correct overlay card for the program to be run. Ensure that both CPU-L and CPU-R are fitted with correct PROM module and that the module number corresponds with the number written on top of the overlay card.

Place the overlay card over the program display so that the four pins are located in the corresponding holes in the card.

P1/P2 SELECT

Turn the PLC switch to either P1 or P2 to select the program in the PROM modules which corresponds to the overlay card fitted. Confirm by checking that the LED indicator in the top left hand corner of the overlay card, adjacent to the black shaded corner is illuminated.

SELECT MODE

Press the mode button appropriate to the mode of operation required.

The buttons will illuminate confirming which lines and modes will operate.

| MODE | FUNCTION |
|---|---|
| L | Left line and its two APS slicers plus the associated conveyors and converger will operate. |
| R | Right line and its two APS slicers plus associated convergers will operate. |
| B | Both lines, all four APS slicers plus associated conveyors and convergers will operate. |
| S | As mode B but APS slicers will start slicing at the same time, in pairs. In this mode APS 1L and 1R are coupled as a pair and APS 2L and 2R are coupled as a pair. |

SELECT PROGRAM

LINE

Select the line switch to program either left line (L) or right line (R). This switch is used in mode L, R, or B. In L or R mode, obviously, the program must be loaded into the line to run (L or R).

In B mode each line can be programmed differently.

In S mode selection of L or R on the line switch is irrelevant since both lines are programmed to the first program, automatically.

TRAY SIZE SELECTION

The tray size 8p, 4p or 2p is made automatically by the size of tray dispenser magazine fitted to each tray conveyor. In B or S modes both tray conveyors must run the same size trays. If different magazines are fitted on each tray conveyor a TRAY MISMATCH alarm will result and the system will not operate.

SELECT PRODUCT

Turn the product select switch to A, B, or C. This sets the system to correspond with row A, B, or C on the overlay card.

The system is now set up for a particular tray size from tray magazines which selects the main column of the overlay card and the product code which selects the appropriate row on the overlay card.

SELECT CHOP COUNT

All that remains is to select the required chops/tray count of the two available in the previously selected TRAY/PRODUCT slot. Move the chop count switch to either the count 1 (C1) or count 2 (C2) position.

PROGRAM LOAD

Check that the program switches are now set as required. If correct, press the PROGRAM LOAD button. The program as set up on the switches is now loaded into memory and the computer confirms the loading by illuminating the appropriate LED indicators beneath the overlay card.

If the wrong program has been selected, press the RESET mode button and repeat the programming process using the correct switch settings.

OTHER LINE

If B mode is being run, move the line selector switch to the other line and program that line in the same way.

This is not necessary if S mode is selected since both lines are programmed simultaneously.

GENERAL

Once both lines have been programmed, either program may be confirmed by moving the LINE switch either to the L or R position. This simply switches the program display to either the left line or right line for confirmation of the program which has been loaded.

The program load button is locked out once a line has had a program loaded. To reprogram a line the RESET mode switch must first be operated both lines reprogrammed as necessary.

If the system is running and the RESET switch is operated the entire line including the APS slicers will SHUT DOWN.

To start the system once properly programmed simply press the SYSTEM START button. The amber status indicators on the mimic diagram will flash alternately in pairs (left pair then right pair) at half second intervals for about 25 seconds. At the end of that period, the conveyors on the line or lines selected by the mode switches will start automatically.

EMERGENCY SHUT DOWN

Up to 13 emergency stop buttons (not shown) are located on the equipment. In the event of an emergency, the system can be shut down by operating any of these emergency stop buttons in the plant. Additionally the system can be shut down by operating the red STOP button on the main control panel or by turning off one or both of the disconnect switches on the power console access doors.

When an EMERGENCY STOP switch is operated in the plant the system will shut down and location of the switch which has been operated is signalled on the mimic diagram of the control panel by illumination of the appropriate red LED indicator.

ALARMS

The alarm panel provides audible and visual warning that an alarm has occured. The following situations generate alarms:

OVERLOAD TRIP

One of the motor protection thermal relays in the power console has operated. System will not operate.

NO PROGRAM

An attempt was made to run the system before loading a program from the programming switches. System will not operate.

TRAY MISSING

One of the two tray stations on a line has no tray in that position. The alarm shows whether the fault is on the left or right line. Related APS slicers will stop until trays properly located.

PROGRAM ERROR

This indicates that the left CPU is fitted with a PROM module programmed for the right CPU or visa versa. System will not operate.

TRAY MISMATCH

An attempt to operate the system in Mode S or B with different size tray dispenser magazines on left and right lines was made. System will not operate.

BUFFER OVERFLOW

The pick-off rate of the converger was insufficient to reduce the line of trays on the buffer conveyor to normal length in an acceptable time period or the trays have jammed on a buffer conveyor or their movement has been inhibited. APS slicers stop slicing until backlog is cleared, then slicing resumes automatically.

EXTERNAL STOP

This is reserved for a halt state which can be invoked by processes which are not directly part of this system.

APS SLICER STATUS LAMPS (256–262) FIG. 14

OFF—This indicates that a particular APS slicer is not being used. It can mean simply that the machine is turned off or that the operator has taken control of it i.e. for product loading.

FLASHING—A flashing status lamp means that the APS is in stand-by mode. The machine is running, loaded and the guards are closed. The operator has pressed the DRUM START (slicing start) button, which hands control of the APS to the computer. The computer will then start the APS slicing at the appropriate time.

CONTINUOUS—The particular APS is slicing.

OPERATOR/COMPUTER CONTROL OF APS

The operator's control panel on the APS 200 slicer at all times has priority over the computer. An operator can stop an APS at any time regardless of commands being issued by the computer.

An operator hands over control of an APS to the computer by pressing the DRUM START button on the APS panel. This is only operative if the blade is running and all guards are closed. The computer acknowledges acceptance of APS control by illuminating the red status lamp on top of the APS either to continuous illumination in which case the APS will start slicing immediately or by flashing the status lamp. A flashing status lamp means that the computer has assumed control of the APS but slicing cannot start, because conditions are not correct. This could be because of an alarm condition or because the APS on the other channel of the same line is already slicing or, in Mode S, the APS is waiting for its counterpart on the other line to be loaded so the pair can start slicing together.

Each programmable control computer 252–254 includes a number of inputs and a number of outputs, a processor, related peripherals, RAM, ROM and provision for a programmable read only memory (PROM) device to be included. The operating system for the processor is stored in the ROM. Some of the RAM is used as a scratch pad by the processor e.g., for holding I/O conditions and the like, the remainder houses the logic which control the outputs depending on the signals at the inputs.

The control logic can be keyed into RAM during development of the system and after it has been proved, can be stored in PROM for subsequent downloading as required—e.g. whenever the system is thereafter turned on.

In the computer selected for this system, the RAM capacity is such that up to 512 single instructions can be stored in addresses 0000 to 0512.

Thus some of the addresses in each of the two computers are reserved for the operation of the tray conveyors of the lines to which the computers are connected. Other addresses provide for the operation of an air jet where chops are detected at the delivery end of the conveyors 46, 48 etc. (see FIG. 1) as required.

The computer chosen for this system has an additional and useful facility—namely the production of control signals for a printer to enable the logic instructions stored in the PROM to be printed out as either a mnemonic listing or a so-called ladder diagram. Table A comprises the mnemonic listing for the computer 252 and Table B that for computer 254.

FIG. 18 is a listing of the I/O assignment for computer 252 and FIG 19 is the same for computer 254. In the system described, only parts 000–064 are externally available and the higher number parts are only accessible within the software.

In addition to the I/O listing, FIGS. 18 and 19 describe the functions allocated to the software bistable relays KR00–KR07, the 32 registers (outputs 00–31) of reversible up/down software counter RDM, the 32 outputs of the high speed software counter HDM (00–31), the eight software counters TIM0–TIM7 and the eight software counters CNT0–CNT7 in each of the two computers 252, 254. FIGS. 18 and 19 are to be read in conjunction with the description of TABLES A and B given further hereinbelow.

FIG. 20 is made up of 24 sheets and comprises the circuit diagrams of the numerous parts of the control system for the chop shingling apparatus of FIGS. 1 to 12, particularly those circuits of the central control unit 224. In general, FIGS. **20*a* and 20*c* show circuits for the start-up and emergency stop operations of the central control unit 224; FIG. 20*b* shows the power circuitry; FIGS. 20*d* and 20*e* show the control console manual switch circuits; FIG. 20*f* pertains to the control console disply; FIGS. 20*g*–20*l* primarily pertain to the relay control coils used for controlling corresponding relay contacts shown in other drawings of FIG. 20; FIGS. 20*m*–20*p* depict the status indicator control relay contacts; FIGS. 20*q*–20*r* show control relay contacts for signals to be communicated to equipment of the conveyor assembly shown in FIGS. 1–12; and FIGS. 20*s*–20*x* show the circuits for receiving inputs into the computers of the central control unit 224. These drawings are otherwise believed to be self-explanatory in that they are simple circuit diagrams primarily showing wiring of switches, relay coils, and normally open/-closed relay contacts among various terminals. These components are located with the computers 252, 254, which can be spaced (such as in a separate control room) from the conveyor equipment shown in FIGS. 1–12**.

FIG. 21 illustrates the connections between the interface associated with the control system for APSL1 and APSL2 and the control console containing the control panel of FIG. 14 while FIG. 22 illustrates the same connections from the ASPSR1 and APSR2 control system and the control panel.

In this system static inverters are used to power inductive motors for driving those conveyors whose speeds need to be closely controlled and easily varied, such as the conveyors 22, 24, 46, 48 shown in FIG. 1.

By way of example, for the delivery conveyor drive 236 of the conveyor 22, a static inverter takes a normal AC supply and applies it to a full wave rectifier. The resultant intermediate DC voltage is then applied to solid state output devices which are turned on and off in a three-phase switching sequence by the internal control logic of the inverter. This produces an output which is effectively a rebuilt 3 phase AC waveform. The switching logic is driven by a master oscillator so by varying the frequency of that oscillator, the frequency of the 3 phase output is also varied. Since the rotational speed of a standard squirrel cage induction motor is a function of the supply frequency, it is also varied by the change in master oscillator frequency.

The invertes used in this system are IMO JAGUAR units, IN1–5, housed in the power console, as manufactured by IMO Precision Controls Ltd, 1000 North Circular Road, Staples Corner, London, England. Inverters IN1–4 are the VN 75 model having a 1 hp rating and IN5 is the 2 hp, VN150 model. The output of all these units is 220 V 3 phase 2–100 Hz and the input power is 220 V 1 phase 60 Hz. The master oscillator frequency is controlled by a 10k ohm linear track potentiometer. In the case of IN5 which controls the converger speed, the 10k ohm potentiometer is replaced by speed selector module SSM-1 AEW 2158/2. Speed control of the converger is achieved using a specially designed control module (SSM-1) and basically comprised 10×1k-ohm resistors connected in series and this chain is connected across IN5 terminals 4 and 6, normally connected across the track of the speed control potentiometer. IN5 terminal 5 normally connected to the wiper of the potentiometer is connected to the end of a chain of relay contacts. The relays are operated by the computer and enable it to select speeds from 0 to 100% of full speed in 10% steps by tapping off at the junctions of the 10×1k-ohm resistors. IN5 is set so that full speed of the converger represents an outfeed rate of 100 trays/min. The 10 speed tappings therefore each represent a change of 10 trays/min from the adjacent tappings.

The computer selects on of three speeds high (HI), normal (NORM) or low (LO) for each of three tray sizes (2P), (4P), (8P).

The Jaguar inverters have both acceleration and deceleration ramp controls. Since the speed of the converger materially affects the transfer timing of a tray from the buffer discharge release gate to the next set of converger slats, it is important that acceleration and deceleration ramps of IN5 are set to match the inherent rate of change of the mechanical and electrical controls of that part of the system. In practice, these are quite slow ramps which have to be determined by trial and error.

The delivery conveyors (46, 48; 22, 24) are responsible for delivering a chop into a tray. The speed at which the chop is travelling is important. Too fast, and the chop will overshoot, too slow, and it will undershoot. The correct speed for these conveyors has been found to be 43.7 meters/min (143.4 feet/min).

The set-up is therefore quite simple. Using a tachometer with a linear speed wheel, the speed potentiometers are adjusted on each inverter IN1–4 until the appropriate conveyor is running at the correct speed.

No acceleration ramp or deceleration ramp is required on these conveyors. They need to start and stop as quickly as possible.

Reference is made to the IMO Jaguar Introduction Manual for details of the operation of these devices.

The tray conveyors 32 and 50 are driven by stepper motors of the tray conveyor drive 230 depicted in FIG. 13. The drive system for one such motor 258 comprises the following major components shown in FIG. 23;

1×SLO-SYN TM 600U TRANSLATOR (260) as manufactured by The Superior Electric Co., of Bristol, Conn. 06010, United States of America, and 1×SLO-SYN M112 FJ8030 STEPPER MOTOR (258), and 1×PULSE STRETCHER AEW 2158/1 (262) as manufactured by AEW Engineering Co Ltd of Norwich, Norfolk, England.+the high speed counter (HDM) of the SYSMAC S6 (264).

The rotor of a stepper motor rotates in discrete angular steps, in this case 200 steps per revolution or 1.8 degrees of rotation per step. A master oscillator (266) in the TM 600U drive electronics provides a stream of pulses to the transistor logic. On each pulse of the oscillator, the translator connects the four phase windings of the stepper motor to a DC supply in a particular pattern and the rotor rotates just one step. By sending the translator a known number of pulses, the motor will rotate through a pre-set number of degrees and then stop. The frequency of the master oscillator's output determines the speed of rotation of the motor. Since the master oscillator frequency is variable, the speed of rotation of the motor is also variable.

The stepper motor directly drives the chain (170) of the tray of the conveyor (see FIG. *7a*) so one oscillator pulse rotates the stepper motor shaft 1/200th of a revolution which results in a known linear motion of the tray.

The extent of that linear motion is controlled in this system by the High Speed Counter (HDM) (264) of the SYSMAC S6 PC. After a chop has landed in a tray the PC starts, and in response to the signal from the sensors 94, 96, the oscillator of the TM 600U and the stepper motor starts rotating, driving the chain and moving the tray. The master oscillator pulses are tapped off and fed to the pulse stretcher module (AEW 2158). This acts as an interface between the TM600U and the SYSMAC S6. The HDM input of the SYSMAC S6 has a maximum frequency response of 1 kHz and the TM 600U oscillator produces pulses only 10 micro-seconds wide. The pulse stretcher therefore expands these pulses to a width of 1 milli-second to match the response of the HDM input.

It is important to note from this that in modes of operation where an exact number of steps is required in this system, the master oscillator frequency must not exceed 1 kHz otherwise the HDM counter will be unable to follow the pulse train. Thus as the tray moves, the number of oscillator pulses fed to the translator is counted by HDM. When this number is the same as the preset value of the appropriate HDM register, the SYSMAC S6 stops the master oscillator and consequently, the movement of the tray.

In this way, the spacing between chops is determined and controlled. It should be noted that only during this 'INDEX' phase of tray movement are pulses counted by the HDM. In other phases such as 'TRAY LOAD' and 'TRAY CHANGE' the stepper motor is used as an ordinary drive in that it rotates continuously but the STOP command is derived from tray position sensors rather than by pulse counting. In these other modes, therefore, the oscillator frequency can exceed 1 kHz since it is not limited by the maximum frequency response of the HDM counter.

The TM 600U may also be connected in 'HALF STEP MODE' which results in a finer resolution at the stepper motor which then has as many steps per revolution i.e. 400 STEPS/REV. Half step mode gives smoother operation at low speeds.

Full details of the operation of the TM 600U are given in the manual for that unit produced by The Superior Electric Co.

In this system, at 'TRAY LOAD' and 'TRAY INDEX' speeds, the stepper motor is used in HALF STEP MODE; and at 'TRAY CHANGE' speed, FULl STEP MODE is used.

The linear movement of the tray achieved per step of the stepper motor or per pulse of the oscillator is only of consequence in TRAY INDEX mode, since this is the only time when the HDM is used to count pulses to determine the spacing between chops.

Since the stepper motor directly drives the chain on the tray conveyor the distance per step may be determined as follows:

| | | |
|---|---|---|
| DRIVE SPROCKET | = | 30 TEETH |
| CHAIN PITCH | = | ⅜ in (9.525 mm) |
| thus 1 REV OF SPROCKET | = | 30 × ⅜ ins chain movement |
| | = | 11¼ ins (285.75 mm) |
| and 1 STEP OF STEPPER MOTOR | = | (11¼) 200 ins chain movement |
| | = | 0.0565 ins/step (1.429 mm/Step) |
| so ½ STEP OF STEPPER MOTOR | = | 0.028 ins/step (0.714 mm/Step) |

The stepper motor is used in half-step mode for indexing the tray between chops so each oscillator pulse gives 0.028 ins of tray movement (0.714 mm). If the appropriate HDM register was set to a value of 10, the tray would move for 10 oscillator pulses between chops or 10×0.028 ins=0.28 ins (7.14 mm).

However as detailed later under the section relating to differential spacing, the SYSMAC logic selects the value in the software counters C004 and C005 and effectively multiply the HDM pre-set value by the value set in the C004 counter for first spacing and C005 counter for the second spacing. Only if these counters are set to 1 will a tray move as calculated above.

Thus the actual formula for calculating the chop spacing is as follows:

SPACE BETWEEN FIRST AND SECOND CHOP

SPACE 1=HDM SETTING×C004 SETTING×0.028 INS

SPACE BETWEEN SUBSEQUENT CHOPS

SPACE 2=HDM SETTING×C005 SETTING×0.208 INS

EXAMPLE

Suppose C004 is set to 3, C005 is set to 2 and Program 1 is selected so HDM 000 is in use and set to, say, 10

| | | |
|---|---|---|
| SPACE 1 | = | HDM 000 × C004 × 0.028 |
| | = | 10 × 3 × 0.028 |
| | = | 0.84 ins (21.34 mm) |
| SPACE 2 | = | HDM 000 × C005 × 0.028 |
| | = | 10 × 2 × 0.028 |
| | = | 0.56 ins (14.22 mm) |

Obviously if C004 and C005 both contain the same pre-set value then all chops in a tray will be spaced equally.

It can be seen that by adjusting the values of the HDM register settings and the values of C004 and C005, a wide rane of finely controlled spacings can be achieved.

Detailed description of operation with reference to the SYSMAC logic mnemonic listing of TABLE A for computer 252. Specific addresses in the listing are identified and described below. The following description of TABLE A is to be read in conjunction with the software implemented devices defined in FIG. 18 and the hardware implemented devices numerically designated in FIG. 20.

0000 CHOP DETECTION

As a chop reaches the end of a delivery conveyor it breaks a light beam across the end of the conveyor between two fibre-optic cables.

The channel 1 sensor is coupled to input 0000.

The channel 2 sensor is coupled to input 0023.

Obviously only one channel is operative at any one time so each sensor is enabled by the appropriate APS RUN/STOP relay.

Thus channel 1 (0000) is enabled by APS 1 RUN (0044);

channel 2 (0023) is enabled by APS 2 RUN (0045).

Since the sensors are through-beam types their inputs are assigned normally closed logic.

The entire chop detection circuit can be disabled by the normally closed contact of timer T006 (100 ms). This prevents the system cycling should a chop or any other material remain at rest in the sensor beam.

Thus considering channel 1 operation, only contact 44 is closed because APS 1 is operating and T006 is closed. Contact 65 is closed and bistable contact K000 is closed. Contact 0000 is open because the sensor beam is unbroken. When a chop passes through the beam, the sensor turns off so the input to 0000 is removed and contact 0000 closes operating the coil of relay 0064 and starting timer T000 (200 ms). Relay 0064 then latches via contact 0064.

After time delay T000 which allows transit time and settling time for the chop to transfer from the launch conveyor to the tray and to settle in the tray the T000 contact at address 0020 closes and provided no alarm condition exists (0014) Relay 13 is energised and starts the tray conveyor advancing at index speed.

0019 CHOP SPACING CONTROL

As the stepper motor rotates to advance the conveyor at index speed the pulses from the stepper translator are processed by the pulse stretcher module in the power console to 1.0 ms width to match the CPU count input specification.

These pulses are applied to the EXT point of the High Speed Counter HDM and HDM starts counting the pulses when its STA (start) input is enabled by the contact of timer T000.

HDM has 32 outputs (H000–H031) which can be individually programmed to change states and different values of the HDM counter.

In this system only 18 (H000–H017) of the outputs are used. The outputs will have been selected by the program set on the programming panel (See Program Decoding). For this description consider that program 0 is being run. Thus contact 0079 (address 0125) is closed and 80 through 96 are open. When the main HDM register has counted a number of stepper pulses equivalent to the number preset in HDM sub-register H000, the contacts H000 will close and operate relay 97 via program 0 contact 79. The contacts of relay 97 at address 120 close and reset the main register of HDM to zero.

0179 DIFFERENTIAL SPACING

Differential spacing is a provision in the Software to allow a large space between the first and second chops in a tray which in some cases gives a more stable load in a tray. It is controlled by two counters, C004 and C005. C004 is shown set for a count of 2 and C005 is shown set for a count of 2.

When the HDM register has completed its count relay 97 closes, resets HDM to zero and bumps counter C004 and C005. These now both contain a value of 1 so their outputs to do not change state, thus relay 0065 (address 0185) remains unenergised so the chop detection circuit (address 0000) remains latched and HDM starts counting up from zero again (tray still moving). This time when HDM reaches its preset value, H000 again closes and operates relay 97. 97 again zeroes HDM and bumps counters C004 and C005. On this pass both counters now contain 2 so their outputs change state. At address 185, therefore C004 and C005 close. Since we are considering the first chop into a tray only has an effect because RDM counter output R031 is set to change state at a count of 2 or greater (see CHOPS/-TRAY COUNT). Thus the closure of C004 energises 0065 whose normally closed contact at address line 0000 opens and the entire chop detection circuit is unlatched and ready for the second chop.

It can be seen from the above that the full movement of the tray index for the first chop required two complete cycles of HDM controlled by C004. For all subsequent chops into that tray the number of HDM cycles will be controlled by C005 because the chop counter RDM will have counted more than one chop into the tray so R031 (address 0185) changes state.

If a greater spacing is required between the first and second chops in a tray then the value of C004 is simply increased.

i.e.

if C004=3
and C005=2 then the space between the first and second chops in a tray will require 3 HDM cycles as opposed to 2 HDM cycles for subsequent chops. Thus the space between the first and second chops in a tray will be 50% greater than that between subsequent chops.

C004 and C005 can be loaded with any value or combination or values to give different spacing arrangements.

0193 CHOPS/TRAY CONTROL

The chops/tray control uses the RDM reversible counter in the SYSMAC which has 32 outputs each of which may be programmed to changed state at different values of the main RDM counter.

The count input IN is driven by a contact of timer T000 which closes a short time after a chop has landed in a tray.

The counter can be reset by the tray change bistable K000 or the tray load push button 0019 or at power-up by 0109.

Thus after initial tray loading the counter is set to zero and as slicing commences, it then counts the number of closures of the T000 contact which is the same as the number of chops in the tray. One of the outputs of the RDM counter R000–R017 will be selected by the program decode contacts 0079–0096 (see PROGRAM DECODING).

When the counter reaches the pre-set value of the selected output, the corresponding output contact closes and energises the COUNT DONE relay 0069 (address line 0200). This signal is used to indicate TRAY FULL i.e. the tray now contains the required number of chops. The operation of 0069 initiates the tray change sequence.

0279 TRAY CHANGE CONTROL

When the appropriate RDM chop count is reached the 0069 contact closes and since this count is based on chops breaking the detector beam the T000 contact also closes and the bistable (latching relay) K000 is set. The contacts of K000 change state and perform the following functions:

1. Resets chop detection circuit (address line 0000)
2. Selects tray conveyor high speed by operating relays 0013 and 0019 (address lines 0020 and 0030)
3. Inhibits RDM counter (address line 0193)
4. Zeroes RDM counter (address line 0196)

Thus the full tray is moved away from the chop discharge position at tray change speed. When the next empty tray approaches the chop discharge position its leading edge is sensed by the sensor at the channel two tray position, connected to input 0024. The contact 0024 at address line 0256 operates relay 0070 which self latches through the normally closed contact of timer T001 and at the same time starts timer T001 timing. Similarly, at address line 0260 another contact 0070 operates relay 0072. 0072 is then de-energised when T001 times out.

The contacts of relay 0072 therefore pulse when the channel 2 tray detector is switched by a tray giving a one-shot output. At address line 0281 the pulse from contact 0072 resets the tray change bistable KR000 which in turn releases relays 0013 and 0019 stopping the tray conveyor and bringing the new tray to rest in the correct positon for receiving the first chop.

It is important to note that trays are alwasy aligned to the channel 2 sensor regardless of which channel is currently discharging chops. The channel 1 tray sensor is used only to check for the presence or absence of a tray in that position.

0263 TRAYLOAD AND 2-TRAY SKIP

Trays from the tray magazine are loaded onto an empty tray conveyor when the tray load push button is depressed. This button is connected to input 0022. At address 0265 the contact of 0022 closes when the button is operated, and causes the latching relay K002 to be set. Also at address 0276 another contact of 0022 closes and zeroes the counter C000.

At address 0028 a contact of K002 energises output relay 0019 which selects the lowest of the three speeds of the tray conveyor, 'tray load speed'.

As the conveyor creeps along trays are deposited between the pusher flights (see DESTACKER ARM CONTROL) and proceed towards the channel 2 tray sensor. As the first tray is detected the tray sensor one-shot output contact 0072 (see TRAY CHANGE CONTROL) at address 0273 bumps the counter C000 to 1. Similarly the next tray bumps the counts to 2. When the leading edge of the third tray is detected the count C000 goes to 3 which is its preset value, so its outputs change state.

At this point, at address 0269, the channel 2 tray sensor is operated so contact 0024 is closed. Contact K002 is closed from the initial operation of the tray load push button and contact C000 is closed because that counter has just reached its preset value. These contacts therefore energise T005. The tray currently over the channel 2 sensor continues to creep forward at tray load speed until T005 times out. At this time the T005 contacts change state and at address 0266 the T005 contact resets latching relay K002 and the whole tray load operation stops. Thus there is now an empty tray correctly positioned at the channel 2 chop discharge point, two empty trays ahead of it, and, by implication, an empty tray two positions behind, at the channel 1 chop discharge point.

T005 is the initial position overrun timer. It is included because it is necessary to position an empty tray at tray load in the same position as it would be positioned by tray change. Tray change, of course, happens at very high speed whereas try load is executed at very low speed to enable the destacker mechanism time to operate. The function of T005 therefore is to simulate the system's mechanical overrun which occurs at tray change when the conveyor is braked from high speed. The overrun at tray load speed is very much less. In this way the leading edge of a tray stops in the same position when the conveyor is braked from either speed.

The tray load sequence can also be initiated by contact 0045 at address 0260. This contact means that APS 2 on channel 2 is about to start slicing. The system therefore moves two trays past the channel 2 chop discharge position before the APS starts. This prevents channel 2 discharging product into trays which have been previously filled by channel 1 output. The movement of the two trays is achieved exactly as described above. It should also be noted that the APS 1 (channel 1) slicer run contact 0044 at address 0274 zeroes the tray skip counter C000 to ensure the two tray skip is properly executed next time the channel 2 APS starts working.

0284 DESTACKER ARM CONTROL

The destacker arm sequence is initiated when a conveyor flight breaks the 'flight detector' through beam sensor which is connected to input 0025.

At address 0286 the contact 0025 closes when the beam is broken and resets the latching relay K001, provided the conveyor is not running in high speed (contact 0016) which is too fast for the destacker to position the trays between the flights. When K001 is reset its contact, address 0289, opens turning 0017 output relay off. The arm therefore descends, with a tray on its suctions cups. As soon as the tray is on the conveyor it is detected by the 'tray down' sensor connected to input 0026. At address 0294 the contact 0026 opens as soon as the tray reaches the conveyor and output relay 0012 turns off the vacuum generator's air supply so the tray is released from the destacker arm's suction cups, and is free to be moved along by the conveyor. As the tray moves away, the tray down sensor 0026 is released and its contact at 0291 starts timer T003 which holds the destacker arm in the down position for a short dwell time to ensure the trailing edge of the tray just loaded has cleared. When T003 times out it sets K001 at address 0284 which then energises output relay 0017 at address 0289 and the arm rises to collect the next tray. Since there is now no tray over the tray down detector the vacuum generator air supply is turned on again at address 0294.

Thus the destacker arm parks in the UP position with vacuum on, until the next conveyor flight is detected.

0099 TRAY SIZE DECODING

The magazines which hold the trays at the head of the tray conveyor are each fitted with a plastic block containing up to two stainless steel pins. These pins are sensed by the magazine sensors connected to CPU inputs 0002 and 0003. The pins are arranged in a binary code so the system can identify the tray size to be run from the pin combination on each magazine.

| | Coding: | | |
|---|---|---|---|
| Input 003 | Input 002 | Output Relay | Tray Size |
| OFF | ON | 0042 | 2P |
| ON | OFF | 0071 | 4P |
| ON | ON | 0043 | 8P |

0108 CROSS LINE TRAY CHECK

When both lines are operating (SYNC. or BOTH mode) the two outputs of trays are merged to a single stream by the converger. Since these are fed to a single overwrap machine the possibility of each line operating with different size trays must be prevented.

The decoded tray sizes from the right line processor are fed to the left line processor via input 0008 (2P) and 0009 (8P). The inputs default to 4P.

Thus at address line 0108 a check is made

2P Right AND NOT 2P left at the next line the check is ([Not 2P Right AND NOT 8P Right]=4P Right) AND NOT 4P Left and on the next line

8P RIGHT AND NOT 8P LEFT

If any of these three conditions is true and the mode selector switches are set to SYNC or BOTH (contact 0006 closed) then relay 0059 will operate giving a TRAY MISMATCH alarm. (See ALARM CONTROL).

0035 PROGRAM PANEL DECODING

The programming panel on top of the control console enables 18 different product/count/tray combinations to be selected. This selection may be represented diagrammatically as follows:

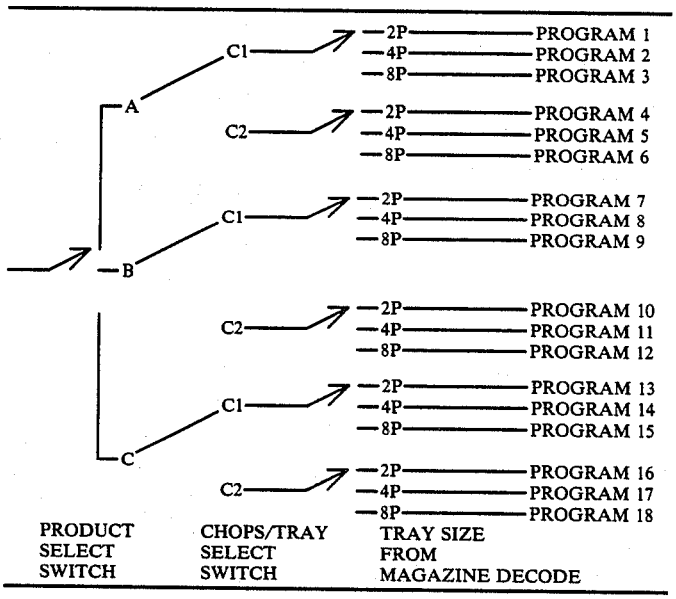

The software decoding is first divided into the 3 product groups; product A at address 0035 by closure of input contact 0060; product B by closure input contact 0061 at address 0056; and product C by default of NOT A AND NOT B so contact 0060 AND 0061 are closed at address 0077.

Thus only one of the three software decode networks is activated at any one time.

Within the selected group (in this example consider product A is selected to 0060 is closed at address 35) the tray size decoding network will have closed one of the three tray size relays 0042, 0071, or 0043. Assume a 2P tray is fitted, then the contacts of 0042 are closed.

Finally the chops/tray selector switch which is coupled to input 0062 completes the routing. So if that switch is set to COUNT 1 then the normally open contact of 0062 on address line 0035 is closed and the normally closed contact on the next line is open.

Thus relay 0079 is energized and PROGRAM 1 is selected.

In this way any one of the 18 PROGRAM relays may be uniquely selected.

It is these program relays which activate the corrrect corresponding HDM (chop spacing) and RDM (chops/tray count) registers and each of these 18 available registers may be pre-set with any chop spacing or chop count for tray loading provided the product will fit in the tray.

0296 AIR BLAST CONTROL

An air blast is provided at the channel 1 and channel 2 discharge positions. This assists in correctly positioning the first chop in each tray against the leading edge of the tray. The air blast is turned on at the current channel only whilst the first chop is, or in another embodiment while the first two chops are, loaded into the tray.

A master relay 0066 selects air blast on and the signal is further directed at address 0302 to channel 1 air blast control relay 0015 if APS 1 is running (contact 0044 closed) or to the channel 2 air blast control relay 0018 if APS2 is running (contact 0045 closed).

FIG. 24 illustrates part of a particular implementation which is to be controlled by the foregoing and which is adapted to handle cut pieces of meat such as pork meat chops. This is to be adapted into the overall system described hereinabove, but for purposes of convenience it is here described as a separate assembly.

A power supply 93 drives a lamp (not shown) in the light source 94 and a light detector (not shown) is located in the receiver/sensor 96. The electrical signal output from the detector in 96 provides one input to a control processor unit 97 (i.e., the controller 224 in the overall system). Each interruption in the signal from 96 is counted by a counter 99.

The pressure of the air from a supply 101 is controlled by a pressure control 103 and air is released to the tube 98 and nozzle 100 by control signals from the CPU 97 which control the operation of a valve 105 in the supply line to the nozzle.

The volume of air in each puff is controlled by a further control 107 by which the throughput of the valve can be adjusted.

The timing and duration of each puff is controlled by the control signals from the CPU 97.

A second nozzle 100A at the end of a second tube 98A may be provided, as shown, supplied either from the same valve 105 or from a second air supply system similar to the system made up of 101, 103, 105, 107 which may be controlled by the same control signals from the CPU 97 or from a further set of control signals produced by the CPU 97.

The delay between the detection of an article between 94, 96 and the generation of a control signal to the valve 105 (and any other similar valves in duplicated control systems not shown) is controlled by a time delay adjuster 109.

Further information is obtained when the optical path is reestablished after the passage of a piece of cut material, allowing a further electrical signal to be generated indicating that one piece has passed and another can now be expected.

Adjacent the exit is located an air pipe 98 having an outlet nozle 100 which is adjustable so as to direct an airstream from the nozzle 100 towards the flight path of cut pieces such as 76 as they leave the conveyor. By appropriate adjustment of the nozzle and appropriate adjustment of pressure and volume and duration of each air pulse leaving the nozzle, so a cut piece such as 76 leaving conveyor 86 can be deflected and tilted simultaneously, so as to land in the tray in a tilted condition instead of laying flat on the bottom of the tray. This is of great advantage when the objects are to be layered in the pack to present the edge regions thereof overlying one another. This is of particular advantage when the pieces of product which are being packed in this way are meat chops or the like. The airstream can also be used merely to apply a holding force to the objects as they land on the trays so that the objects do not bounce or slide off.

0308 APS CONTROL

Provided an APS is running, loaded, has all its guards closed and the operator has pressed the 'DRUM START' button the control system can stop and start the slicing dependent upon certain conditions by stopping or starting the rotation of the magazine drum.

At all times the APS operator's control panel has priority over the computers' control of APS operation, for safety reasons. If an APS operator signals an APS to stop either by opening a guard or pushing a stop button, the machine will stop regardless of any instruction to the contrary from the computers.

If the operator signals an APS to start slicing, it will only start when the line conditions are correct. If the 'DRUM START' button of the APS has been correctly operated but the computer is not ready to handle product from that machine, then the APS will go to 'STANDBY' mode and will start slicing at a later time when the line conditions are correct and the computer issues the START command.

The APS control part of the software also provides a time bias between APS 1 and APS 2 to prevent a race condition being set up if both APS machines on a line are signalled to start slicing by two operators, simultaneously.

At address 0308 the entire APS control logic is interlocked to relay contact 0056. This contact is closed only when the system start sequence has been completed and the conveyors are running. Thus the APS machines cannot be operated until the system has been properly powered up.

The first section of the APS control logic checks that each machine is clear to start. Considering address line 0308 for APS 1L input relay 27 closes when the APS operator has pressed the drum start button on APS 1L. (This will latch the drum start relay inside the APS if and only if all guards on the APS are closed and locked, the load area access door is closed and the blade is running and up to speed).

The next relay contact in the line is 0068 (normally closed). This will be open if APS 2L is operating, preventing the operation of APS 1L until 2L is stopped. If APS 2L is stopped then the next contact in the line is 0005 (normally closed). Relay 0005 is connected to the 'RIGHT LINE ONLY' mode push button. In this case, this is the normally closed contact i.e. NOT RIGHT-=Left Line Selected.

Alternatively this contact 0005 may be by-passed by 0006 which is closed if either 'SYNC' or 'BOTH' mode switch is depressed.

If these conditions are correct then relay 0067 is operated signalling APS 1L CLEAR TO START.

At address 0316 this clear to start signal is applied to the reset input of counter C002 holding it at zero. This counter normally counts 4 one second pulses from the relay contacts 0107 (see SYSMAC S6 MANUAL). It is this counter which is used to generate the bias delay between APS 1L and 2L, to prevent the race condition previously described, by holding off APS 2L with C002 contact in series with address line 0319.

The last stage of processing to start APS 1L slicing is at address line 0342. Contacts 0067 are closed from above (1L READY). If 'SYNC' mode is not selected the normally closed sync contact 0007 is closed. Thus if no alarm condition exists (0014 closed) then output relay 0044 is energised and completes the drum control circuit in the APS, and the machine starts slicing.

It should be noted that contact 0033 is reserved for EXTERNAL STOP signal processing for a signal received from some further process not directly part of this system.

Had 'SYNC' mode been selected then input contact 0007 would divert the APS 1L START signal processing to address line 0346. In this case APS 1L will not start unless and until APS 1R is also clear to start 0073 closed. Also in this 'SYNC' mode the APS 1L start relay is connected in self-holding mode. This logic ensures that in 'SYNC' mode both APS 1L and APS 2L will start slicing simultaneously but the self-holding contacts ensure that, once started, they can stop independently of one another.

Thus when 'SYNC' mode is selected APS 1L and APS 1R operate as a synchronised pair and APS 2L and APS 2R operate as a synchronised pair.

The READY and START logic for the rest of software down to address 0388 is the same.

0400 APS STATUS LAMP CONTROL

Each APS is fitted with a red status lamp on top of the machine. These serve three purposes:

1. To indicate that the system start sequence is being processed and that the conveyors are about to start.
2. That an APS is in stand-by mode and may start slicing at anytime under computer control.
3. That an APS is slicing.

These lamps are repeated by four amber LED indicators on the system control panel mimic diagram.

When the SYSTEM START button has been depressed latching relay contacts K006 close at address lines 0400, 0409, 0418, 0427.

The left APS pair status lamp control relays are then operated through the normally closed contacts of the ½ second pulse relay 0107 (see SYSMAC S6 Manual) and the APS right pair status lamp control relays are operated through the normally open contact of 0107. Thus during the system start delay the left pair lamps and the right pair lamps alternately flash ON and OFF at ½ second intervals.

Considering APS 1L status lamp at address 0408 if contact 0027 is closed (APS 1L drum start relay latched) and 0056 is closed (system start completed and conveyors running) and relay 0044 is not operated (APS 1L not slicing) then APS 1L status lamp control relay 0052 will pulse on and off, driven by pulse relay contact 0107 (see SYSMAC S6 Manual) causing the lamp on APS 1L to flash ½ second ON, ½ Second OFF.

Once APS 1L starts slicing, relay 0044 is operated so its normally open contact at address 0408 holds APS 1L status lamp control relay permanently operated so the status lamp emits a steady light.

0389 SYSTEM START CONTROL

System start is provided to enable the system to be powered up in the correct sequence by the use of a single push button.

The system start button is connected to CPU input 0004. When the button is operated, the 0004 contacts at address 0389 close and set the latching relay K006. This releases the reset of counter C001 which is then able to count pulses from pulse relay 107 (see SYSMAC S6 MANUAL) when 21 pulses have been counted (21 seconds later) C001 contacts at address 0397 close and operate output relay 0056 which is connected in self-holding mode. This relay starts the system conveyors and other contacts of 0056 zero the system start delay counter C001 and reset the latching relay K006.

During the 21 second delay the APS status lamps are caused to flash (see APS LAMP CONTROL) to warn personnel in the vicinity of the equipment that the conveyors are about to start under computer control.

0436 BUFFER HEAD/CONVERGER SPEED CONTROL

The purpose of this part of the logic is to sense the length of line of trays waiting to transfer to the converger and to adjust the length of that line to a mean position by varying the speed of the converger and hence its pick-off rate. This is to try to obtain optimum converger belt usage and minimise the number of gaps in the single line of trays at the converger outfeed.

As previously described the converger speed is controlled by a static inverter housed in the power console and the computer can select HI, LO and NORMAL speeds via a special speed selector module SSM1 also in the power console. This module provides three speeds from a possible total of 10 speeds.

3×14 Pin Dip Headers are provided on the module to enable different set of 3 speeds to be pre-set for 2P, 4P and 8P trays if necessary.

Latching relay K003 at address line 0436 is used in negative logic mode to select converger speed HI. This is because a long line of product on either the left or right buffer must have priority and force the converger to high speed to clear the back-log and make room for more trays entering the buffer, else buffer over-flow will occur.

The use of K003 in negative logic mode enables its primary inputs to be tied to the reset input which has logical priority over the set input (see SYSMAC S6 MANUAL).

The length of line of trays on the buffers is sensed by three equally spaced photo sensors on each buffer (LO—OK—HI).

The buffer sensors are connected as follows.

| INPUT RELAY | SENSOR |
|---|---|
| 0029 | LEFT HI |
| 0030 | LEFT OK |
| 0031 | LEFT LO |
| 0035 | RIGHT HI |
| 0036 | RIGHT OK |
| 0037 | RIGHT LO |

So, if all three sensors on one side are blocked the line is too long and high speed must be selected.

Thus at address 0440 if 0029 AND 0030 AND 0031 contacts are closed and left line (0005) OR both or Sync. Mode (0006) is selected then K003 is reset regardless of the condition of the right buffer.

Therefore, at address 0463 the normally closed contact K003 closes, 0029 is already closed so relay 0049 is operated selecting HI speed on the converger.

The same sequence of events applies to the right buffer. At address 0046 if the HI and OK sensors of both left and right buffers are clear the K003 is set and relay 0049 turns off. Provided LO speed is not selected then relay 0050 address line 0467 is also off so the converger runs at NORMAL speed.

Should the tray line further reduce in length then the LO sensor 0031 and 0037 at address line 0454 will clear causing latching relay K004 to be set, turning on the converger speed control relay 0050 reducing the converger speed to LO. Since the pick-off rate of the converger in LO speed takes less trays in a given time off the buffer than are arriving at the buffer infeed end, the line is allowed to build up again until the left or right LO and OK sensors are blocked. This resets K004 turning off the LO speed relay 0050 and accelerating the converger to the NORMAL speed and pick-off rate.

0469 BUFFER GATE CONTROL

As described with reference to FIGS. 11 and 12 the departure of a tray from the buffer conveyor is synchronised with the arrival of the converger slats to which it must transfer, by a pneumatically operated gate 208, which blocks the transfer point until a timing signal generated by the converger and processed by a special electronic tracking module (ETF) and the computer is used to open the gate at the correct time.

The ETF module takes the timing from the converger timing switch and delays passing that signal to the computer for a period of time which varies with the current speed of the converger. An analogue signal, from the static inverter IN5 (which controls the converger speed and has a voltage level proportional to the converger speed) is fed to the ETF module, and determines the correct time delay applied to the timing signal. This ensures proper tray placing on converger slats at the three converger speeds and at any time on the acceleration/deceleration ramps between those speeds.

On receipt of a timing pulse from the left ETF module, input relay contact 0034 at address 0483 closes and provided the contacts of counter C0006 are closed control relay 0098 is operated.

Counter C006 at address line 0469 is enabled by the "tray at gate" sensor coupled to input relay 0032 and counts 5×0.02 second pulses from relay 0105 (see SYSMAC S6 MANUAL) to introduce a small time delay in the operation of the "tray at gate" sensor.

Thus when the processed converger timing signal and the delayed gate sensor signal are received at address line 0483 relay 0098 operates and holds. These two signals then operate output relay 0048 which raises the gate to release the tray to the converger.

0491 ALARM CONTROLS

This part of the logic is used to shut down the line when operational abnormalities occur. When an alarm condition arises an audible warning device sounds on the control system panel and an LED indicator lights on the alarm section of the panel to alert the operator to the fault condition. T002 on address line 0491 is the watchdog time. This is coupled to the Channel 1 and Channel 2 tray sensors 0024 and 0001. If a tray is missing from either of these positions for more than 400 ms, then T002 times out and operates relay 0051 to illuminate the 'tray missing' alarm indicator, address line 0495, and relay 0014 the general alarm relay which inhibits further operation of the system until the alarm condition is cleared. The tray missing alarm is also generated by K002 which is the 'tray load' latching relay since by implication, trays are missing if tray load is activated.

At address 0506 input 0063 is hard wired to signal common so relay 0046 is permanently energised. This program line makes a program module unique to the left line CPU (CPU-L). If a module were inserted which did not contain this line or contained the CPU-R coding line, the wrong module 'memory error' alarm would be activated.

The general alarm relay 0014 can also be triggered by relay 0059 the tray mismatch relay. (See CROSS-LINE TRAY CHECK).

At address 0501 if 'SYNC MODE' is selected (0007) and CPU-R signals to CPU-L that the right line is in an alarm condition via input relay 0010, then a left line alarm is also generated to stop the line, in an attempt to retain synchronism.

Finally at address 0504 the input relay 0033 is reserved so that an alarm input from a further process not directly part of this system can also shut down the line by causing the general alarm relay 0014 to be operated.

The right hand CPU 254 controls its tray conveyor in much the same way as the left hand CPU and TABLE B contains the nmeumonic listing of the logic instructions for computer 254.

The main functions: CHOP DETECTION, PROGRAM PANEL DECODING, TRAY SIZE DECODING, CHOP SPACING, DIFFERENTIAL SPACING, CHOPS/TRAY CONTROL, TRAY CONTROL, DESTACKER CONTROL, AND AIR-BLAST CONTROL are all as described in the detailed operation description so far and are not covered again. Thed remaining functions of the RH computer 254 are as follows:

0304 PROGRAM PANEL LOAD/DECODE

This section of software is unique to the right hand CPU and must appear in any software intended for use in that computer of this system. The main function of this section is to decode the settings of the programming switches on the control panel and to drive the LED indicators on the program display section of the control panel. The circuit decodes

PRODUCT A, B, C,/COUNT 1, COUNT 2 for the left line and the same for the right line. The result culminates in the operation of the appropriate relay within each group, left and right. The output relays are mutually exclusive and connected in self-holding mode. Once the required program is set on the panel switches, the program is loaded by operating the 'program load' push button, which is connected to input relay, 0008. Programs may be entered independently for the left-line and right-line by appropriate selection of the left/right program switch, connected to input relay 0004, before operating the program load button. However if 'SYNC' mode is selected then by definition, the same program must be set up for both lines. The 'SYNC' mode switch is connected to input relay 0009 and in this mode the left/right program switch becomes irrelevant since at the first depression of the 'program load' button, the selected program is automatically loaded for both lines.

Once the program load button has been operated for a particular line it will not operate again for that line unless the 'RESET' mode button (0029) is operated first. Final display decoding is accomplished in hard wired logic of the control console output relays. (See control console wiring sheet 14/24 and 15/24).

At address line 0412 it can be seen that program load button and the Reset mode switch are used also to set and re-set latching relay K003 which in turn drives output relay 0044 to turn on the program display panel.

0418 ALARM CONTROL

In essence, the alarm control circuits are much the same as previously described for PC-L. In the right processor, however, there are some extra alarm functions.

First at address 0433 input relay 20 is reserved for an external stop signal from a further process not directly connected with this system.

Input relays 0010 and 0011 are hard wired to the control common to check that only a module programmed for use in the right CPU has been loaded. All programs intended for use in the right line CPU must contain this line. If a module is used which does not contain this line, the 'wrong module' or 'memory error' alarm is output on line 0435 via output relay 0041.

A further alarm is added at address 0440. Input relay 0021 is activated on the left line computer when a full buffer conveyor is detected and the converger is set to high speed. If the high speed condition is held for a time equivalent to or greater than the setting of T007 it is assumed that the high speed pick-off rate of the converger was insufficient to clear the back log of trays and so a buffer overflow has occurred. Thus when T007 times out its contact at line 0042 closes and operates relay 0043 causing a general alarm and the corresponding buffer overflow panel indication. Also the APS machines stop slicing, so suspending the flow of trays to the buffer until the backlog is cleared when slicing will recommence automatically.

I claim:

1. Apparatus for loading trays with cut product comprising:

(a) a delivery conveyor having an input end onto which are delivered the pieces of cut product in sequence so as to lie one after another along the length of the delivery conveyor;

(b) a delivery station to which the cut pieces are delivered by the conveyor;

(c) a source of trays onto which the cut pieces are to be loaded;

(d) a tray conveyor extending transversely to the delivery conveyor through the delivery station and adapted to deliver in succession from the said source, a plurality of trays to the delivery station to receive cut product from the delivery conveyor;

(e) product sensing means at the delivery station to detect the passage of each cut piece therethrough;

(f) drive means for the tray conveyor operable in response to drive signals which are generated in response to the detection of cut pieces by the product sensing means, each signal serving to move the tray conveyor through a distance sufficient to present the next available region of a tray to the delivery station, to receive the next piece of cut product, so as to fill each tray in turn;

(g) transfer conveyor means downstream from the delivery station onto which filled trays pass after being filled, the transfer conveyor means serving to move the filled trays away from the delivery station; and wherein said apparatus is adapted to be used with different sizes of tray which are coded along an edge region thereof according to size, said apparatus further comprising decoding means provided at a position along the tray conveyor for determining the particular tray size and generating control signals indicative thereof for controlling the operation of the tray conveyor.

2. Apparatus as set forth in claim 1 wherein the drive means for the tray conveyor operates in a series of incremental steps and the step size making up each transfer movement of the tray conveyor is controllable in response to the signals from the tray decoding means.

3. Apparatus as set forth in claim 1 wherein the drive means for the tray conveyor operates in a series of incremental steps and the number of incremental steps making up each transfer movement of the tray conveyor is controllable in response to the signals for the tray decoding means.

4. An apparatus for loading trays with cut pieces of meat, comprising:

cutting means for cutting meat into cut pieces;

first conveyor means for conveying the cut pieces away from said cutting means;

tray magazine means for carrying a plurality of trays into which the cut pieces are to be loaded;

first input means for identifying from a plurality of tray sizes a size of tray carried by said tray magazine means;

second conveyor means for conveying trays from said tray magazine means to said first conveyor means;

second input means for identifying from a plurality of meat products one meat product to be provided from said cutting means as the cut pieces;

third input means for identifying, for the tray size identified by said first input means and the meat product identified by said second input means, from a plurality of counts one count of the number of the cut pieces to be loaded into a tray conveyed by said second conveyor to said first conveyor means from said tray magazine means; and control means, responsive to said first, second and third input means, for actuating said second conveyor means to move a tray from said tray magazine and relative to said first conveyor means so that the number of cut pieces identified by said third input means for the size of tray identified by said first input means and the meat product identified by said second input means are loaded from said first conveyor means onto the tray moved from said tray magazine on said second conveyor means in response to said control means.

5. An apparatus as defined in claim 4, further comprising:

display means, connected with said second and third input means and said control means and including a plurality of light emitting means, for illuminating respective ones of said light emitting means in response to said first, second and third input means; and a selected overlay card containing indicia designating said plurality of tray sizes, said plurality of meat products and said plurality of counts, said selected overlay card removably mounted on said display means in overlying relation to said light emitting means.

6. An apparatus as defined in claim 4, wherein said control means includes means for actuating said first conveyor means so that said first conveyor means moves the cut pieces towards said second conveyor means at a speed of about 43.7 meters per minute to launch the cut pieces into free flight from said first conveyor means towards said second conveyor means and the tray moved from said tray magazine on said second conveyor means in response to said control means without overshooting or undershooting the tray.

7. An apparatus for loading trays with cut pieces of meat, comprising:

cutting means for cutting meat into cut pieces;

first conveying means for conveying the cut pieces away from said cutting means, said first conveyor means including a supported end roller and an endless belt supported on said end roller to define an end of said first conveyor means;

second conveyor means for conveying a tray to said first conveyor means so that the edge of the tray closest to said end of said first conveyor means and parallel to said end roller is disposed vertically below and horizontally outwardly from said end of said first conveyor means; and means for moving said endless belt of said first conveyor means at a speed of about 43.7 meters per minute so that the cut pieces of meat to be loaded into the tray conveyed by said second conveyor means are put into free flight from said endless belt at said end of said first conveyor means with a trajectory which will prevent the cut pieces from undershooting or overshooting the tray.

8. A method for loading trays with cut pieces of meat, comprising:

cutting meat into cut pieces;

conveying the cut pieces on a conveyor including an end roller and an endless belt supported on the end roller to define an end of the conveyor;

conveying a tray to the conveyor so that the edge of the tray closest to the conveyor and parallel to the end roller is disposed vertically below and horizontally outwardly from the end of the conveyor; and moving the endless belt of the conveyor at a speed of about 43.7 meters per minute so that the cut pieces of meat to be loaded into the tray are put into free flight from the end of the conveyor with a trajectory which will prevent the cut pieces from undershooting or overshooting the tray.

9. An apparatus for loading trays with cut pieces of meat, comprising:

first cutting means for cutting a first piece of meat into first cut pieces;

first conveyor means for conveying the first cut pieces from said first cutting means;

first tray magazine means for carrying a first plurality of trays into which the first cut pieces are to be loaded;

first input means for identifying the size of tray of the first plurality of trays carried by said first tray magazine means;

second conveyor means for conveying trays from said first tray magazine means to said first conveyor means;

second cutting means for cutting a second piece of meat into second cut pieces;

third conveyor means for conveying the second cut pieces from said second cutting means;

second tray magazine means for carrying a second plurality of trays into which the second cut pieces are to be loaded;

second input means for identifying the size of tray of the second plurality of trays carried by said second tray magazine means;

fourth conveyor means for conveying trays from said second tray magazine means to said third conveyor means; and control means for stopping the operation of said first and second cutting means and of said first, second, third and fourth conveyor means in response to said first and second input means identifying different sizes of trays.

10. An apparatus for loading trays with cut pieces of meat, comprising:

a first line for loading trays with cut pieces of meat, said first line including:

first cutting means for cutting a first piece of meat into first cut pieces;

first delivery conveyor means for conveying the first cut pieces from said first cutting means;

second cutting means for cutting a second piece of meat into second cut pieces;

second delivery conveyor means for conveying the second cut pieces from said second cutting means; and first tray conveyor means for conveying trays from a first plurality of trays to said first and second delivery conveyor means;

a second line for loading trays with cut pieces of meat, said second line including:

third cutting means for cutting a third piece of meat into third cut pieces;

third delivery conveyor means for conveying the third cut pieces from said third cutting means;

fourth cutting means for cutting a fourth piece of meat into fourth cut pieces;

fourth delivery conveyor means for conveying the fourth cut pieces from said fourth cutting means; and second tray conveyor means for conveying trays from a second plurality of trays to said third and fourth delivery conveyor means;

mode select means for selecting one of four modes of operation, said four modes of operation including:

L mode wherein said first and second cutting means, said first and second delivery conveyor means and said first tray conveyor means are operated;

R mode wherein said third and fourth cutting means, said third and fourth delivery conveyor means and said second tray conveyor means are operated;

B mode wherein said first line and said second line are both operated but independently of each other; and S mode wherein said first line and said second line are operated with said first and third cutting means operated synchronously and with said second and fourth cutting means operated synchronously; and control means for operating said first and second lines in response to said mode select means.

* * * * *